US012503927B2

(12) United States Patent
Emmett et al.

(10) Patent No.: US 12,503,927 B2
(45) Date of Patent: Dec. 23, 2025

(54) CASING STRING ROTATION SYSTEMS AND METHODS

(71) Applicant: Cactus Wellhead, LLC, Houston, TX (US)

(72) Inventors: Jacob Charles Emmett, Houston, TX (US); Javier Roel Hernandez, League City, TX (US); Thomas Henry Holtkamp, Friendswood, TX (US); Lu Huang, Houston, TX (US)

(73) Assignee: Cactus Wellhead, LLC, Houston, TX (US)

( * ) Notice: Subject to any disclaimer, the term of this patent is extended or adjusted under 35 U.S.C. 154(b) by 0 days.

(21) Appl. No.: 18/897,079

(22) Filed: Sep. 26, 2024

(65) Prior Publication Data

US 2025/0101828 A1 Mar. 27, 2025

Related U.S. Application Data

(60) Provisional application No. 63/540,696, filed on Sep. 27, 2023.

(51) Int. Cl.
*E21B 33/04* (2006.01)
*E21B 17/10* (2006.01)

(52) U.S. Cl.
CPC ..... *E21B 33/0415* (2013.01); *E21B 17/1078* (2013.01); *E21B 33/0422* (2013.01)

(58) Field of Classification Search
CPC .. E21B 33/04; E21B 33/0415; E21B 33/0422; E21B 33/047; E21B 17/1078
See application file for complete search history.

(56) References Cited

U.S. PATENT DOCUMENTS

| | | | | |
|---|---|---|---|---|
| 3,720,261 | A | 3/1973 | Heilheckler et al. | |
| 5,964,286 | A | 10/1999 | Cuppen | |
| 8,528,650 | B1 * | 9/2013 | Smith | E21B 19/06 166/208 |
| 9,458,690 | B2 | 10/2016 | Moellendick | |
| 9,689,229 | B2 | 6/2017 | Hanson et al. | |
| 9,909,385 | B2 * | 3/2018 | Cocker, III | E21B 33/14 |
| 10,094,188 | B1 | 10/2018 | Smith | |

(Continued)

OTHER PUBLICATIONS

Schaeffler, 81130-TV, Jul. 26, 2022.

(Continued)

*Primary Examiner* — Yong-Suk (Philip) Ro
(74) *Attorney, Agent, or Firm* — Conrad J. Hsu

(57) ABSTRACT

Techniques for implementing and/or operating a well system including a rotatable casing hanger and a rotatable running tool. The rotatable casing hanger includes a hanger body, which is to be secured to a casing string; a hanger sleeve secured circumferentially around the hanger body, in which the hanger sleeve is to be landed on another wellhead component; and a hanger bearing assembly disposed axially between the hanger body and the hanger sleeve. The rotatable running tool includes a tool body that defines a tool bore, in which the tool body is to be selectively secured to the hanger body; a tool sleeve secured circumferentially around the tool body to facilitate maintaining centralization of the tool body and, thus, the rotatable casing hanger; and a tool bearing assembly disposed between the tool body and the tool sleeve.

20 Claims, 14 Drawing Sheets

(56) References Cited

U.S. PATENT DOCUMENTS

| | | | | |
|---|---|---|---|---|
| 10,323,480 | B2 | 6/2019 | Cocker et al. | |
| 11,293,249 | B2 | 4/2022 | Wright | |
| 11,591,877 | B2 | 2/2023 | Qureshi et al. | |
| 2015/0159458 | A1* | 6/2015 | Tan | E21B 33/0407 166/348 |
| 2017/0101840 | A1* | 4/2017 | Kauffmann | E21B 23/01 |
| 2017/0167218 | A1* | 6/2017 | Cheah | E21B 23/02 |
| 2021/0324699 | A1 | 10/2021 | Trumbull et al. | |
| 2022/0127913 | A1 | 4/2022 | Armistead et al. | |

OTHER PUBLICATIONS

Cactus Wellhead, LO1128, Jul. 13, 2022.
Cactus Wellhead, LO1129, Jul. 15, 2022.
Cactus Wellhead, SDT3656, Jul. 26, 2022.
Wilkins, Danny R., Declaration Under 37 C.F.R. 1.132, Sep. 27, 2023.

* cited by examiner

CASING STRING ROTATION SYSTEMS AND METHODS

CROSS-REFERENCE

The present disclosure claims priority to and benefit of U.S. Provisional Application No. 63/540,696, entitled "CASING STRING ROTATION SYSTEMS AND METHODS" and filed Sep. 27, 2023, which is incorporated herein by reference in its entirety for all purposes.

BACKGROUND

The present disclosure generally relates to well systems and, more particularly, to techniques for rotating a casing string suspended within a wellbore by a wellhead, for example, while the casing string is being cemented within the wellbore to facilitate improving cement distribution (e.g., uniformity) around and, thus, effectiveness of the casing string.

Generally, a wellhead in a well system may facilitate drilling a well, such as an oil or gas well, and/or producing fluid from the well. In particular, a wellhead may, among other things, suspend a casing string within a wellbore of a well to facilitate structurally supporting the wellbore as well as fluidly isolating the wellbore from upstream ground formations. To facilitate improving effectiveness of a casing string, an annular space surrounding the casing string is often cemented within a wellbore. In other words, the effectiveness of a casing string may vary with the integrity of a cement layer formed therearound. For example, if a void is present in a cement layer formed therearound, the ability of a casing string to structurally support a corresponding wellbore and/or to provide fluid isolation within the wellbore may be reduced.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a well system includes a rotatable casing hanger and a rotatable running tool. The rotatable casing hanger includes a hanger body that defines a hanger bore, in which the hanger body is to be secured to a casing string to facilitate suspending the casing string within a wellbore; a hanger sleeve secured circumferentially around the hanger body, in which the hanger sleeve is to be landed on another wellhead component; and a hanger bearing assembly disposed axially between the hanger body and the hanger sleeve to facilitate rotating the hanger body relative to the hanger sleeve as well as transferring axial force between the hanger body and the hanger sleeve. The rotatable running tool includes a tool body that defines a tool bore, in which the tool body is to be selectively secured to the hanger body of the rotatable casing hanger to facilitate manipulating the rotatable casing hanger; a tool sleeve secured circumferentially around the tool body to facilitate maintaining centralization of the tool body and, thus, the rotatable casing hanger; and a tool bearing assembly disposed between the tool body and the tool sleeve to facilitate rotating the tool body and, thus, the hanger body of the rotatable casing hanger and the casing string relative to the tool sleeve.

In another embodiment, a method of operating a well system includes securing a tool body of a rotatable running tool to a hanger body of a rotatable casing hanger, in which the tool body of the rotatable running tool defines a tool bore that extends axially therethrough and the rotatable running tool includes a tool sleeve rotatably secured circumferentially around the tool body such that the tool body extends axially through the tool sleeve to facilitate maintaining centralization of the tool body and, thus, the rotatable casing hanger; securing the hanger body of the rotatable casing hanger to a casing string, in which the hanger body of the rotatable casing hanger defines a hanger bore that extends axially therethrough and the rotatable casing hanger comprises a hanger sleeve rotatably secured circumferentially around the hanger body such that the hanger body extends axially through the hanger sleeve to facilitate rotating the hanger body and, thus, the casing string relative to the hanger sleeve; and manipulating the rotatable casing hanger via the rotatable running tool such that the hanger sleeve of the rotatable casing hanger lands on another wellhead component and the casing string is suspended within a wellbore.

In a further embodiment, a well system includes a rotatable running tool, in which the rotatable running tool includes a tool body that defines a tool bore that extends axially therethrough, in which an upper end of the tool body is to be secured to a landing joint and a lower end of the tool body is to be secured to a casing hanger; a tool sleeve to be disposed circumferentially around the tool body such that the tool body extends axially through the tool sleeve to facilitate maintaining centralization of the tool body and, thus, the casing hanger; and a tool bearing assembly to be secured radially between the tool body and the tool sleeve to facilitate rotating the tool body and, thus, the casing hanger relative to the tool sleeve as well as securing the tool sleeve circumferentially around the tool body.

DETAILED DESCRIPTION

Figure 1:
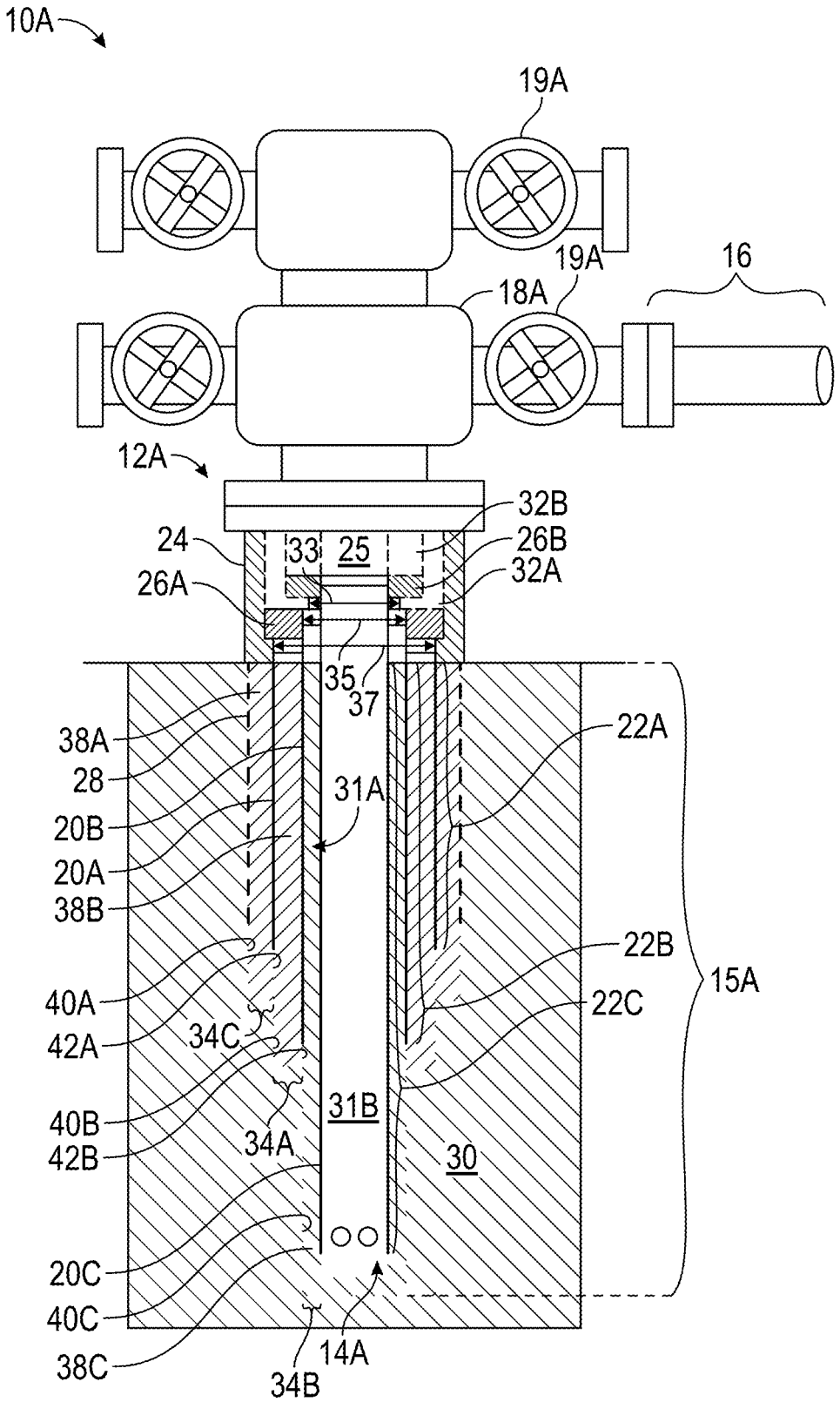
FIG. 1 is a partial cross-sectional view of an example of a well system during fluid production from a well, in accordance with an embodiment of the present disclosure.

One or more specific embodiments of the present disclosure will be described below with reference to the figures. As used herein, the term "coupled" or "coupled to" may indicate establishing either a direct or indirect connection and, thus, is not limited to either unless expressly referenced as such. The term "set" may refer to one or more items. Wherever possible, like or identical reference numerals are used in the figures to identify common or the same features. The figures are not necessarily to scale. In particular, certain features and/or certain views of the figures may be shown exaggerated in scale for purposes of clarification.

The present disclosure generally relates to well systems and, more particularly, to a wellhead that may be deployed in a well system to facilitate drilling a well and/or producing fluid from the well. Generally, a wellhead in a well system concentrically suspends one or more casing strings within the wellbore (e.g., borehole) of a well to facilitate structurally supporting the wellbore as well as fluidly isolating the wellbore from upstream ground formations, for example, in addition to providing access to an annular spaces surrounding a casing string, a casing bore of the casing string, and/or a wellhead bore of the wellhead. As an illustrative, non-limiting, example, a wellhead may concentrically suspend an outermost (e.g., surface) casing string via its housing (e.g., a casing head or a casing spool), an intermediate casing string via an intermediate (e.g., outer) casing hanger, and an innermost (e.g., production) casing string via an inner casing hanger.

To facilitate improving effectiveness of a casing string, an annular space surrounding the casing string within a wellbore is often cemented. Generally, to cement a casing string within a wellbore, liquid cement is pumped down a casing bore of the casing string such that the cement flows to the bottom of the well and back up an annular space between the casing string and a surrounding wall, such as another (e.g., outer or intermediate) casing string, an outer cement layer, and/or a ground formation. Once solidified, the cement may bond the casing string to the surrounding wall as well as seal the annular space between the casing string and the surrounding wall, which, at least in some instances, facilitates improving the structural support and/or fluid isolation provided by the casing string.

In other words, the effectiveness of a casing string suspended within a wellbore may vary with the integrity (e.g., uniformity) of a cement layer formed in an annular space surrounding the casing string. In particular, if a void (e.g., cavity or fissure) is present in a cement layer formed around a casing string, open space may be present between the casing string and a surrounding wall. As such, a void in a cement layer formed around a casing string may reduce the ability of the casing string to structurally support a corresponding wellbore and/or to provide fluid isolation within the wellbore.

Accordingly, to facilitate improving cement distribution (e.g., uniformity) within an annular space surrounding a casing string and, thus, effectiveness of the casing string, the present disclosure provides techniques for rotating the casing string while the casing string is being cemented within a wellbore. To facilitate suspending and rotating a casing string, in some embodiments, a wellhead in a well system may include a rotatable casing hanger, which is implemented to be secured to an upper end of the casing string. In particular, to facilitate reducing the likelihood of damaging (e.g., scoring) surrounding components during rotation, a rotatable casing hanger may enable a corresponding casing string to be rotated while the rotatable casing hanger is landed.

To facilitate rotating a casing string while landed, a rotatable casing hanger generally includes a hanger body, which is implemented to be secured to the casing string, a hanger sleeve, which is secured circumferentially around the hanger body, and a hanger bearing assembly, which is disposed axially between the hanger body and the hanger sleeve to facilitate rotating the hanger body relative to (e.g., within) the hanger sleeve as well as transferring axial force (e.g., load) between the hanger body and the hanger sleeve. In particular, to facilitate landing a rotatable casing hanger, the hanger sleeve of the rotatable casing hanger generally includes a downwardly-facing external landing shoulder, which is implemented (e.g., sized and/or shaped) to land on an upwardly-facing internal landing shoulder of another (e.g., outer) wellhead component. For example, in some embodiments, an external landing shoulder on the hanger sleeve of a rotatable casing hanger may be implemented (e.g., sized and/or shaped) to land on an internal landing shoulder on another (e.g., intermediate) casing hanger or on wellhead housing (e.g., a casing head or a casing spool). However, to facilitate reducing size and/or weight of a rotatable casing hanger and, thus, improving handling of the rotatable casing hanger and/or reducing implementation (e.g., manufacturing and/or material) cost associated with the rotatable casing hanger, in other embodiments, an external landing shoulder on the hanger sleeve of the rotatable casing hanger may be implemented (e.g., sized and/or shaped) to instead land on an internal landing shoulder on an annular packoff, which lands on another (e.g., intermediate) casing hanger, for example, due to the annular packoff having a smaller inner diameter than the other casing hanger and/or wellhead housing (e.g., a casing head or a casing spool).

In any case, to facilitate cementing a casing string using a rotatable casing hanger, the hanger body of the rotatable casing hanger generally defines a hanger bore that extends axially therethrough. Additionally, to enable the flow (e.g., circulation) of fluid, such as liquid cement, drilling mud, or water, therearound, in some embodiments, the hanger sleeve of a rotatable casing hanger may include fluid circulation pathways defined therethrough, for example, via hanger flutes. In fact, to facilitate dissipating produced heat, in some embodiments, fluid, such as water, may be flowed over (e.g., around) a rotatable casing hanger during rotation.

Furthermore, to facilitate transferring axial force between the hanger body and the hanger sleeve of a rotatable casing hanger, the hanger body may include a downwardly-facing external load shoulder while the hanger sleeve includes an (e.g., primary) upwardly-facing internal load shoulder, which are implemented to axially oppose one another. Thus, to facilitate securing the hanger sleeve of a rotatable casing hanger around a corresponding hanger body, in some embodiments, the rotatable casing hanger may include a securement notch or a securement protrusion, which has a smaller outer diameter than an inner diameter of the hanger sleeve, on the outer surface of the hanger body and a securement clamp (e.g., clip), which has a larger outer diameter than the inner diameter of the hanger sleeve, secured over (e.g., around and/or within) the securement protrusion or the securement notch on the hanger body adjacent to a lower end of the hanger sleeve, for example, after the securement protrusion or the securement notch on the hanger body is inserted past the lower end of the hanger sleeve.

Moreover, to facilitate transferring axial force between its hanger body and its hanger sleeve while facilitating (e.g., easing) rotation of the hanger body relative to (e.g., within) the hanger sleeve, the hanger bearing assembly of the rotatable casing hanger is generally disposed axially between the downwardly-facing external load shoulder on the hanger body and the upwardly-facing internal load shoulder on the hanger sleeve. In other words, the hanger bearing assembly of a rotatable casing hanger may generally raise its hanger body off of its hanger sleeve, thereby reducing rotational resistance therebetween while transferring the weight of a corresponding casing string, which can be in the range of tens of thousands of pounds, from the hanger body to the hanger sleeve and, thus, the hanger bearing assembly may be load bearing.

To facilitate transferring (e.g., bearing) substantial axial load while facilitating rotation, in some embodiments, the hanger bearing assembly of a rotatable casing hanger may be an axial roller bearing assembly. In particular, in some such embodiments, a hanger axial roller bearing assembly may include a roller (e.g., central) plate, which includes circumferentially-spaced and radially-oriented roller openings formed therethrough, roller bearings, which are each rotatably secured within a roller opening in the roller plate such that its circumference extends above as well as below the roller plate, an upper contact plate, which is disposed above the roller plate to contact an external load shoulder on a hanger body and the roller bearings, and a lower contact plate, which is disposed below the roller plate to contact an (e.g., primary) internal load shoulder on a hanger sleeve and the roller bearings.

However, in other embodiments, the hanger bearing assembly of a rotatable casing hanger may be a fluid bearing assembly, for example, to facilitate reducing heat produced during rotation. In particular, in some such embodiments, the downwardly-facing external load shoulder on the hanger body of a rotatable casing hanger and the upwardly-facing internal load shoulder on a corresponding hanger sleeve may be complimentarily tapered (e.g., slanted) to define a conical (e.g., tapered and/or slanted) region of a bearing fluid cavity therebetween. In addition to a conical region, in some embodiments, a bearing fluid cavity defined in a rotatable casing hanger may include an expanded cylindrical region, which is connected to a lower end of the conical region and disposed radially between the hanger body and the hanger sleeve with more clearance as compared to the conical region, for example, to collect material (e.g., metal) particles that are inadvertently present in the bearing fluid cavity such that likelihood of the material particles inadvertently damaging (e.g., scoring) the rotatable casing hanger during subsequent rotation is reduced.

Moreover, in other embodiments, the hanger bearing assembly of a rotatable casing hanger may be a magnetic bearing assembly or another type of bearing assembly. In any case, at least in some instances, the hanger bearing assembly in a rotatable casing hanger may be rated to handle substantial axial force but minimal radial (e.g., transverse) force.

Accordingly, to facilitate appropriately centralizing (e.g., blocking wobble without inadvertently increasing rotational resistance) its hanger body within its hanger sleeve and, thus, reducing radial force exerted on its hanger bearing assembly while reducing the likelihood of its hanger body and its hanger sleeve inadvertently rubbing, in some embodiments, a rotatable casing hanger may additionally include one or more centralizers disposed radially and circumferentially between its hanger body and its hanger sleeve. For example, a rotatable casing hanger may include an upper centralizer, which is disposed radially between its hanger body and an upper end of its hanger sleeve, and/or a lower centralizer, which is disposed radially between its hanger body and a lower end of its hanger sleeve.

To facilitate positioning a centralizer radially and circumferentially between the hanger body and the hanger sleeve of a rotatable casing hanger, the centralizer may be disposed within a corresponding centralizer notch in the rotatable casing hanger. In particular, in some embodiments, a rotatable casing hanger may include an internal centralizer notch on its hanger sleeve. For example, the hanger sleeve of a rotatable casing hanger may include an upper centralizer notch at an upper end, which accommodates an upper centralizer, and/or a lower centralizer notch at a lower end, which accommodates a lower centralizer. Nevertheless, in other embodiments, a rotatable casing hanger may include an external centralizer notch on its hanger body.

In any case, to facilitate blocking a hanger body from rubbing against a corresponding hanger sleeve, a centralizer in a rotatable casing hanger may extend radially out of a corresponding centralizer notch. In other words, to facilitate appropriate centralization, a protruding (e.g., inner) diameter of a centralizer may be smaller than a corresponding (e.g., adjacent) inner surface diameter of a corresponding hanger sleeve and slightly larger than a corresponding (e.g., opposing) outer surface diameter of a corresponding hanger body.

Accordingly, at least in some instances, sizing of a centralizer in a rotatable casing hanger may be highly dependent on the sizing of its hanger body and/or its hanger sleeve and, thus, tolerances of the centralizer may be tight. In fact, to facilitate achieving tight tolerances, in some embodiments, a centralizer may be customized (e.g., tailored) to a corresponding (e.g., specific) hanger body and/or a corresponding hanger sleeve, for example, by disposing the centralizer within a corresponding centralizer notch before machining a resulting protruding diameter based on a corresponding inner surface diameter of the hanger sleeve and/or a corresponding outer surface diameter of the hanger body. Nevertheless, in other embodiments, a centralizer in a rotatable casing hanger may be appropriately machined for its hanger body and/or its hanger sleeve before being disposed within a corresponding centralizer notch.

In any case, to facilitate maintaining a hanger body centralized within a hanger sleeve such that galling due to like materials rubbing is reduced, in some embodiments, a centralizer in a rotatable casing hanger may be a dissimilar material insert (e.g., bushing and/or ring), which is a different material as compared to the hanger body and the hanger sleeve. For example, a dissimilar material insert centralizer in a rotatable casing hanger may be bronze while the hanger body and the hanger sleeve of the rotatable casing hanger are steel.

Additionally or alternatively, to facilitate maintaining a hanger body centralized within a hanger sleeve while further reducing rotational resistance therebetween, in some embodiments, a centralizer in a rotatable casing hanger may be a radial ball bearing assembly. In particular, in some such embodiments, a radial ball bearing centralizer may include an outer housing (e.g., ring), which contacts a hanger sleeve, an inner housing (e.g., ring), which contacts a hanger body, and ball bearings, which are disposed radially and circumferentially between the outer housing and the inner housing.

In any case, to facilitate operation of a hanger bearing assembly in a rotatable casing hanger and, thus, improving rotational efficiency of its hanger body within its hanger sleeve, in some embodiments, fluid, such as lubricant or bearing fluid, may be supplied to and retained at the hanger bearing assembly. To facilitate supplying fluid to its hanger bearing assembly, in some embodiments, a rotatable casing hanger may include a hanger bearing port formed through its hanger sleeve to the hanger bearing assembly. Additionally, to facilitate retaining fluid at its hanger bearing assembly and, thus, defining a bearing fluid cavity, in some embodiments, a rotatable casing hanger may include an upper hanger seal, which is radially compressed between its hanger sleeve and its hanger body above the hanger bearing assembly, and a lower hanger seal, which is radially compressed between its hanger sleeve and its hanger body below the hanger bearing assembly.

To facilitate retaining a hanger seal in place, in some embodiments, a rotatable casing hanger may include an internal seal groove on its hanger sleeve and/or an external seal groove on its hanger body. For example, the hanger body of a rotatable casing hanger may include an external seal groove, which accommodates (e.g., retains) a first (e.g., upper) hanger seal. Additionally or alternatively, the hanger sleeve of a rotatable casing hanger may include an internal seal groove, which accommodates a second (e.g., lower) hanger seal.

In any case, to facilitate rotating and/or otherwise manipulating (e.g., lifting and/or lowering) a casing hanger, such as a rotatable casing hanger, and, thus, a corresponding casing string, in some embodiments, a well system may additionally include a rotatable running tool, which is implemented to selectively connect a landing joint to the casing hanger. In particular, a rotatable running tool may generally maintain the rotatable running tool and, thus, a corresponding casing hanger centralized within a wellhead bore, which, at least in some instances, may facilitate reducing the likelihood of the casing hanger and the casing string damaging (e.g., scoring and/or galling) surrounding components during rotation and/or reducing radial force exerted on the hanger bearing assembly of a rotatable casing hanger and, thus, improving lifespan of the hanger bearing assembly, for example, due to the hanger bearing assembly being primarily rated to handle axial force.

To facilitate connecting a landing joint to a casing hanger while maintaining centralization during rotation, a rotatable running tool generally includes a tool body, which has an upper end implemented (e.g., sized and/or shaped) to be secured to the landing joint and a lower end implemented to be secured to the casing hanger, a tool sleeve, which is secured circumferentially around the tool body, and a tool bearing assembly, which is disposed between the tool body and the tool sleeve to facilitate rotating the tool body relative to the tool sleeve, for example, as well as securing the tool sleeve to the tool body. In particular, to facilitate insertion of a rotatable running tool, in some embodiments, the tool sleeve of the rotatable running tool may include a tapered lower end. Additionally, to facilitate withdrawal of a rotatable running tool, in some embodiments, the tool sleeve of the rotatable running tool may include a tapered upper end. Furthermore, to enable the flow (e.g., circulation) of fluid, such as liquid cement, drilling mud, or water, therearound, in some embodiments, the tool sleeve of the rotatable running tool may include fluid circulation pathways defined therethrough, for example, via tool flutes.

In any case, to facilitate cementing a casing string while using a rotatable running tool, the tool body of the rotatable running tool generally defines a tool bore that extends axially therethrough. Additionally, to facilitate rotating the tool body of a rotatable running tool relative to a corresponding tool sleeve as well as securing the tool sleeve to the tool body, in some embodiments, the tool bearing assembly of the rotatable running tool may include ball bearings, which are implemented to be disposed within a radially-aligned external bearing groove on the tool body and a radially-aligned internal bearing groove on the tool sleeve. To facilitate proper alignment of an external bearing groove on a tool body and a corresponding internal bearing groove on a tool sleeve, in some such embodiments, the tool body may include an upwardly-facing external alignment shoulder while the tool sleeve may include a downwardly-facing internal alignment shoulder, which are implemented to axially oppose one another.

Furthermore, to facilitate disposing a ball bearing within an external bearing groove on the tool body of a rotatable running tool and a corresponding internal bearing groove on the tool sleeve of the rotatable running tool and, thus, securing the tool sleeve to the tool body, in some such embodiments, the rotatable running tool may include a corresponding tool bearing port formed through the tool sleeve to the internal bearing groove. In such embodiments, once the external bearing groove on the tool body and the internal bearing groove on the tool sleeve are radially aligned, ball bearings may be inserted through the tool bearing port into the bearing grooves. A bearing plug may then be used to plug (e.g., seal and/or close) the tool bearing port behind the bearing balls, which holds the bearing balls within the bearing grooves, thereby securing the tool sleeve to the tool body while enabling the tool body to rotate relative to the tool sleeve with improved efficiency. In this manner, as will be described in more detail below, the present disclosure provides techniques for implementing and/or operating a well system, which includes a rotatable running tool and/or a rotatable casing hanger, to facilitate rotating a casing string during cementing, which, at least in some instances, may facilitate improving cement distribution (e.g., uniformity) within an annular space surrounding the casing string and, thus, effectiveness of (e.g., structural support and/or fluid isolation provided by) the casing string.

To help illustrate, an example of a well system 10A, which includes a wellhead 12A secured over a wellbore 14A of a well 15A, is shown in FIG. 1. In particular, in the depicted example, the wellhead 12A is connected to a pipeline 16 and, thus, facilitates fluid production from the well 15A. To facilitate supplying fluid to the pipeline, the wellhead 12A includes a pressure control assembly 18—namely a production pressure control assembly 18A, such as a Christmas tree assembly—that includes one or more fluid valves 19A.

However, it should be appreciated that the depicted example is merely intended to be illustrative and not limiting. In particular, as will be described in more detail below, a wellhead 12 in a well system 10 may additional or alternatively be used to facilitate drilling a well 15.

In any case, a wellhead 12 in a well system 10 may, among other things, concentrically suspend (e.g., support) multiple casing strings 20 within a wellbore 14 of a well 15, for example, to facilitate structurally supporting and/or fluidly isolating the wellbore 14 while enabling the wellbore 14 to be cyclically deepened. In particular, in the depicted example, the wellhead 12A concentrically suspends an outermost (e.g., outer and/or surface) casing string 20A a first depth 22A within the wellbore 14A, an intermediate (e.g., outer or inner) casing string 20B a second depth 22B within the wellbore 14A that is greater than the first depth 22A of the outermost casing string 20A, and an innermost (e.g., inner and/or production) casing string 20B a third depth 22C within the wellbore 14A that is greater than the second depth 22B of the intermediate casing string 20B.

However, it should again be appreciated that the depicted example is merely intended to be illustrative and not limiting. In particular, in other embodiments, a wellhead 12 may concentrically suspend only two casing strings 20 within a wellbore 14 of a well 15—namely an outermost casing string 20A and an innermost casing string 20C, but not an intermediate casing string 20B. Alternatively, in other embodiments, a wellhead 12 may concentrically suspend multiple intermediate casing strings 20B and, thus, more than three (e.g., four, five, or more) casing strings 20 within a wellbore 14 of a well 15. Furthermore, in addition to suspending a casing string 20 within a well 15, in some embodiments, a wellhead 12 may provide access to an annular space 34 surrounding the casing string 20, a casing bore 31 of the casing string 20, and/or a wellhead bore 25 of the wellhead 12 via wellhead ports, for example, to facilitate returning cement during cementing of the casing string 20, producing fluid (e.g., oil and/or gas) from the well 15, injecting fluid (e.g., gas) into the well 15, and/or monitoring conditions (e.g., temperature, pressure, and/or fluid composition) within the well 15.

In any case, to facilitate suspending an outer (e.g., outermost or intermediate) casing string 20 within a wellbore 14 of a well 15 as well as securing a pressure control assembly 18 to the well 15, as depicted, a wellhead 12 generally includes wellhead housing 24, which defines a wellhead bore 25 that extends therethrough. In particular, in some embodiments, wellhead housing 24 of a wellhead 12 may include a casing head, which is implemented to suspend an outermost (e.g., surface) casing string 20A, and/or or a casing spool, which is implemented to suspend an intermediate casing string 20B. The wellhead housing 24 of a wellhead 12 additionally includes the housing of a pressure control assembly 18 included in the wellhead 12.

However, as in the depicted example, to facilitate suspending an inner (e.g., intermediate or innermost) casing string 20 within a wellbore 14 of a well 15, a wellhead 12 may additionally include a casing hanger 26, which is implemented to be secured (e.g., land) within its wellhead housing 24 and, thus, its wellhead bore 25. In particular, in the depicted example, the wellhead 12 includes an intermediate (e.g., first and/or outer) casing hanger 26A, which lands on the wellhead housing (e.g., a casing head or a casing spool) 24 and suspends the intermediate casing string 20B within the wellbore 14A of the well 15A, as well as an inner (e.g., second) casing hanger 26B, which suspends an innermost (e.g., production) casing string 20C within the wellbore 14A of the well 15A.

Nevertheless, it should again be appreciated that the depicted example is merely intended to be illustrative and not limiting. In particular, in other embodiments, a wellhead 12 in a well system 10 may include more than two (e.g., three, four, or more) casing hangers 26, for example, when the wellhead 12 is implemented to suspend multiple intermediate casing strings 20B. Alternatively, in other embodiments, a wellhead 12 in a well system 10 may include a single casing hanger 26, for example, when the wellhead 12 is not implemented to suspend an intermediate casing string 20B or the wellhead 12 is implemented to suspend the intermediate casing string 20B via its wellhead housing (e.g., a casing spool) 24.

In any case, as in the depicted example, in addition to casing strings 20 suspended by a wellhead 12, in some embodiments, a conductor pipe 28 may be disposed within a wellbore 14 of a well 15. In particular, in some such embodiments, a conductor pipe 28 may be driven into a ground formation 30 to serve as a foundation for a wellhead 12. Accordingly, as in the depicted example, in some such embodiments, the wellhead housing 24 of a wellhead 12 may rest (e.g., land) on a conductor pipe 28.

However, it should again be appreciated that the depicted example is merely intended to be illustrative and not limiting. In particular, in other embodiments, a well system 10 may not include a conductor pipe 28. Accordingly, in such embodiments, the wellhead housing 24 of a wellhead 12 may instead rest (e.g., land) directly on the surface of a ground formation 30.

In any case, as in the depicted example, in some embodiments, a wellhead 12 in a well system 10 may include one or more annular packoffs 32, which each lands on a casing hanger 26 that suspends a casing string 20, to facilitate sealing a casing bore 31 of the casing string 20 from an annular space 34 surrounding the casing string 20. In particular, in the depicted example, the wellhead 12A includes an intermediate (e.g., first and/or outer) annular packoff 32A, which lands on the intermediate casing hanger 26A to facilitate sealing an intermediate casing bore 31A of the intermediate casing string 20B from an intermediate annular space 34A between the intermediate casing string 20B and the outermost casing string 20A. Additionally, in the depicted example, the wellhead 12A includes an inner (e.g., second) annular packoff 32B, which lands on the inner casing hanger 26B to facilitate sealing an inner (e.g., production) casing bore 31B of the innermost casing string 20C from an innermost annular space 34B between the innermost casing string 20C and the intermediate casing string 20B.

In other words, as in the depicted example, in such embodiments, an inner (e.g., second) casing hanger 26B in a wellhead 12 may land on an intermediate annular packoff 32A, which lands on an intermediate (first and/or outer) casing hanger 26A in the wellhead 12, for example, instead of landing directly on the intermediate casing hanger 26A or the wellhead housing 24 of the wellhead 12. In fact, as in the depicted example, in some such embodiments, an inner diameter 33 of an intermediate annular packoff 32A, which is implemented to land on an intermediate casing hanger 26A, may be smaller than an inner diameter 35 of the intermediate casing hanger 26A and/or another inner diameter 37 of wellhead housing (e.g., a casing head or a casing spool) 24. Accordingly, in such embodiments, implementing (e.g., sizing and/or shaping) an inner casing hanger 26B to land on the intermediate annular packoff 32A instead of directly on the intermediate casing hanger 26A and/or the wellhead housing 24 may facilitate reducing the size and/or weight of the inner casing hanger 26B, which, at least in some instances, may facilitate improving handling and/or reducing implementation-associated (e.g., material and/or manufacturing) cost of the inner casing hanger 26B.

However, it should again be appreciated that the depicted example is merely intended to be illustrative and not limiting. In particular, in other embodiments, a wellhead 12 in a well system 10 may not include annular packoffs 32. Accordingly, in such embodiments, an inner casing hanger 26B in the wellhead 12 may instead land directly on an intermediate (e.g., outer) casing hanger 26A in the wellhead 12 or wellhead housing (e.g., a casing head or a casing spool) 24 of the wellhead 12.

In any case, as in the depicted example, to facilitate improving structural support and/or fluid isolation provided by a casing string 20, a layer of cement 38 is often formed in an annular space 34 surrounding the casing string 20. In particular, in the depicted example, an outermost (e.g., first) cement layer 38A is formed in an outermost annular space 34C, which extends between the outermost casing string 20A and the conductor pipe 28 as well as between the outermost casing string 20A and an outer (e.g., outermost and/or first) formation wall 40A of the well 15A. Additionally, in the depicted example, an intermediate (e.g., second) cement layer 38B is formed in the intermediate annular space 34A, which extends between the intermediate casing string 20B and the outermost casing string 20A, between the intermediate casing string 20B and a first cement wall 42A of the outermost cement layer 38A, as well as between the intermediate casing string 30B and an intermediate (e.g., second) formation wall 40B of the well 15A. Furthermore, in the depicted example, an innermost (e.g., third) cement layer 38C is formed in the innermost annular space 34B, which extends between the innermost casing string 20C and the intermediate casing string 20B, between the innermost casing string 20C and a second cement wall 42B of the intermediate cement layer 38B, as well as between the innermost casing string 20C and an inner (e.g., innermost and/or third) formation wall 40C of the well 15A. Accordingly, cement 38 is often formed around a casing string 20 that is suspended within the wellbore 14 of a well 15 during drilling of the well 15.

Figure 2:
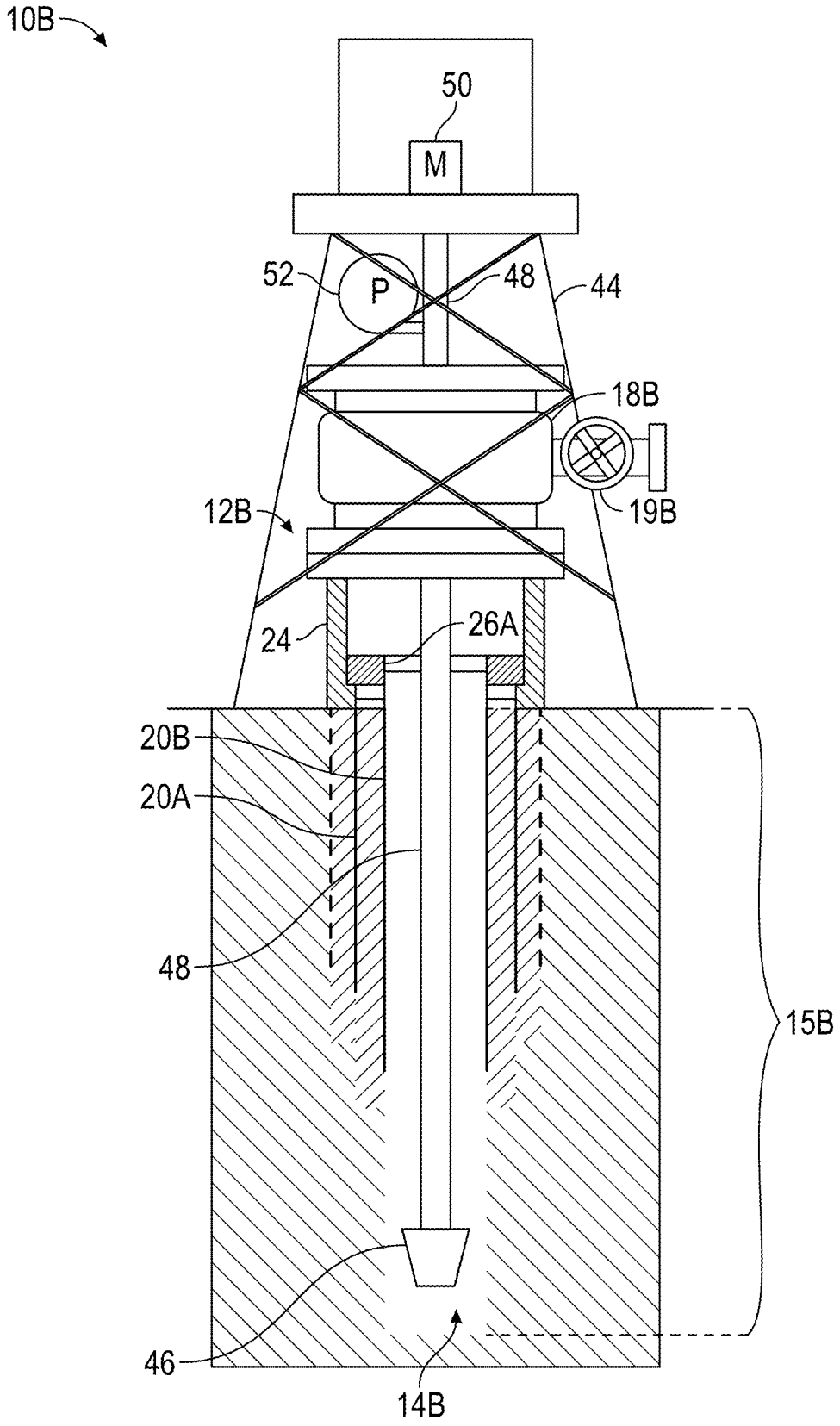
FIG. 2 is a partial cross-sectional view of the well system of FIG. 1 while a wellbore of the well is being drilled, in accordance with an embodiment of the present disclosure.

To help illustrate, an example of a well system 10B during the drilling of a well 15B is shown in FIG. 2. In particular, in FIG. 2, the well system 10B is in the process of drilling the wellbore 14B of the well 15B beyond an outermost (e.g., surface) casing string 20A and an intermediate casing string 20B.

Nevertheless, similar to FIG. 1, to facilitate drilling the well 15B, the well system 10B of FIG. 2 generally includes a wellhead 12B secured over the wellbore 14B of the well 15B. In particular, similar to FIG. 1, the wellhead 12B of FIG. 2 includes a pressure control assembly 18 having one or more fluid valves 19B. However, since the wellhead 12B is used during drilling of the well 15B, the pressure control assembly 18 in FIG. 2 is a drilling pressure control assembly 18B, such as a blowout preventer (BOP) assembly.

In addition to the drilling pressure control assembly 18B, similar to FIG. 1, the wellhead 12B of FIG. 2 includes wellhead housing (e.g., a casing head and/or a casing spool) 24, which is secured to an upper end of an outermost (e.g., surface) casing string 20A to facilitate suspending the outermost casing string 20A within the wellbore 14B of the well 15B as well as securing the drilling pressure control assembly 18B to the well 15B. Furthermore, similar FIG. 1, the wellhead 12B of FIG. 2 includes an intermediate (e.g., first and/or outer) casing hanger 26A, which is secured to an upper end of an intermediate casing string 20B and lands on the wellhead housing 24 to facilitate suspending the intermediate casing string 20B within the well 15C.

To facilitate drilling the well 15B, as depicted, in addition to the wellhead 12B, the well system 10B of FIG. 2 includes a derrick 44 for drilling equipment. In particular, to facilitate drilling the well 15B, the derrick 44 supports a drill bit (e.g., head) 46 via a drill string 48. Additionally, to facilitate drilling the well 15B, one or more fluid pumps 52 may circulate drilling fluid (e.g., mud) through the wellbore 14B of the well 15B. Furthermore, to facilitate drilling the well 15B, one or more motors 50 may drive actuation of the drill bit 46 and/or drive insertion and withdrawal of the drill string 48 and, thus, the drill bit 46.

However, it should be appreciated that the depicted example is merely intended to be illustrative and not limiting. In particular, in other embodiments, a motor 50 and/or a fluid pump 52 in a well system 10 may be included with a drill bit 46 in a downhole assembly, for example, instead of being located on a derrick 44. In any case, after the well 15B is deepened, an innermost (e.g., production) casing string 20C may be disposed within the wellbore 14B of the well 15B and a layer of cement 38 may be formed within an annular space 34 surrounding the innermost casing string 20C.

Figure 3:
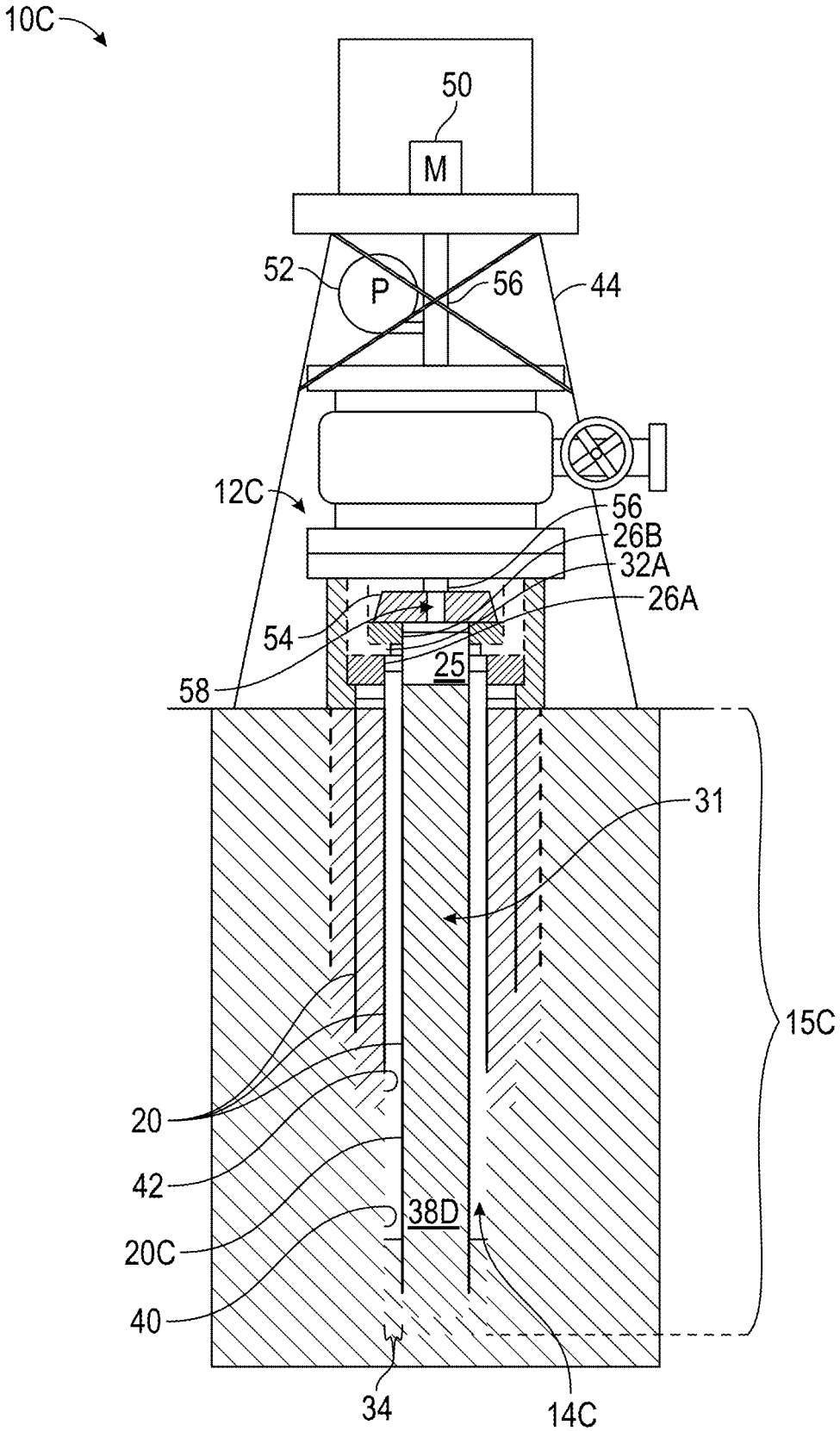
FIG. 3 is a partial cross-sectional view of the well system of FIG. 2 suspending a casing string within the wellbore while the casing string is being cemented, in accordance with an embodiment of the present disclosure.

To help illustrate, an example of a well system 10C during cementing of an innermost (e.g., production) casing string 20C within a wellbore 14C of a well 15C is shown in FIG. 3. Similar to FIG. 1, the well system 10C of FIG. 3 has a wellhead 12C that includes an inner (e.g., second) casing hanger 26B, which suspends the innermost casing string 20C within the wellbore 14C of the well 15C. In particular, similar to FIG. 1, the inner casing hanger 26B of FIG. 3 is secured to an upper end of the innermost casing string 20C and lands on an intermediate annular packoff 32A, which in turn lands on an intermediate (e.g., first and/or outer) casing hanger 26A, to facilitate suspending the innermost casing string 20C within the well 15C.

However, it should be appreciated that the depicted example is merely intended to be illustrative and not limiting. In particular, as mentioned above, in other embodiments, a wellhead 12 in a well system 10 may not include annular packoffs 32. Accordingly, in such embodiments, an inner (e.g., second) casing hanger 26B in a wellhead 12 may instead land directly on an intermediate (e.g., first and/or outer) casing hanger 26A in the wellhead 12.

In any case, to facilitate manipulating (e.g., lifting and/or lowering) and, thus, landing a casing hanger 26 within the wellhead bore 25 of a wellhead 12, as in the depicted example, a well system 10 often includes a running tool 54, which is implemented to be selectively securable to an upper end of the casing hanger 26. Additionally, to facilitate manipulating a running tool 54, as in the depicted example, the running tool 54 may be supported (e.g., suspended) from a derrick 44 via a landing joint 56. In particular, to facilitate inserting, withdrawing, rotating, and/or otherwise manipulating a running tool 54, a well system 10 may include one or more motors 50 connected to a corresponding landing joint 56.

Furthermore, to facilitate cementing an annular space 34 surrounding a casing string 20 in a well 15, as in the depicted example, a well system 10 may pump liquid cement 38D through a corresponding landing joint 56, a tool bore 58 of a corresponding running tool 54, and a wellhead bore 25 of a corresponding wellhead 12 into a casing bore 31 of the casing string 20, for example, via one or more fluid pumps 52. In particular, the well system 10 may continue to pump until the liquid cement 38D flows to the bottom of the well 15 and back up an annular space 34 between the casing string 20 and a surrounding wall, such as a formation wall 40, a cement wall 42, or an outer (e.g., intermediate or outermost) casing string 20.

Figure 4:
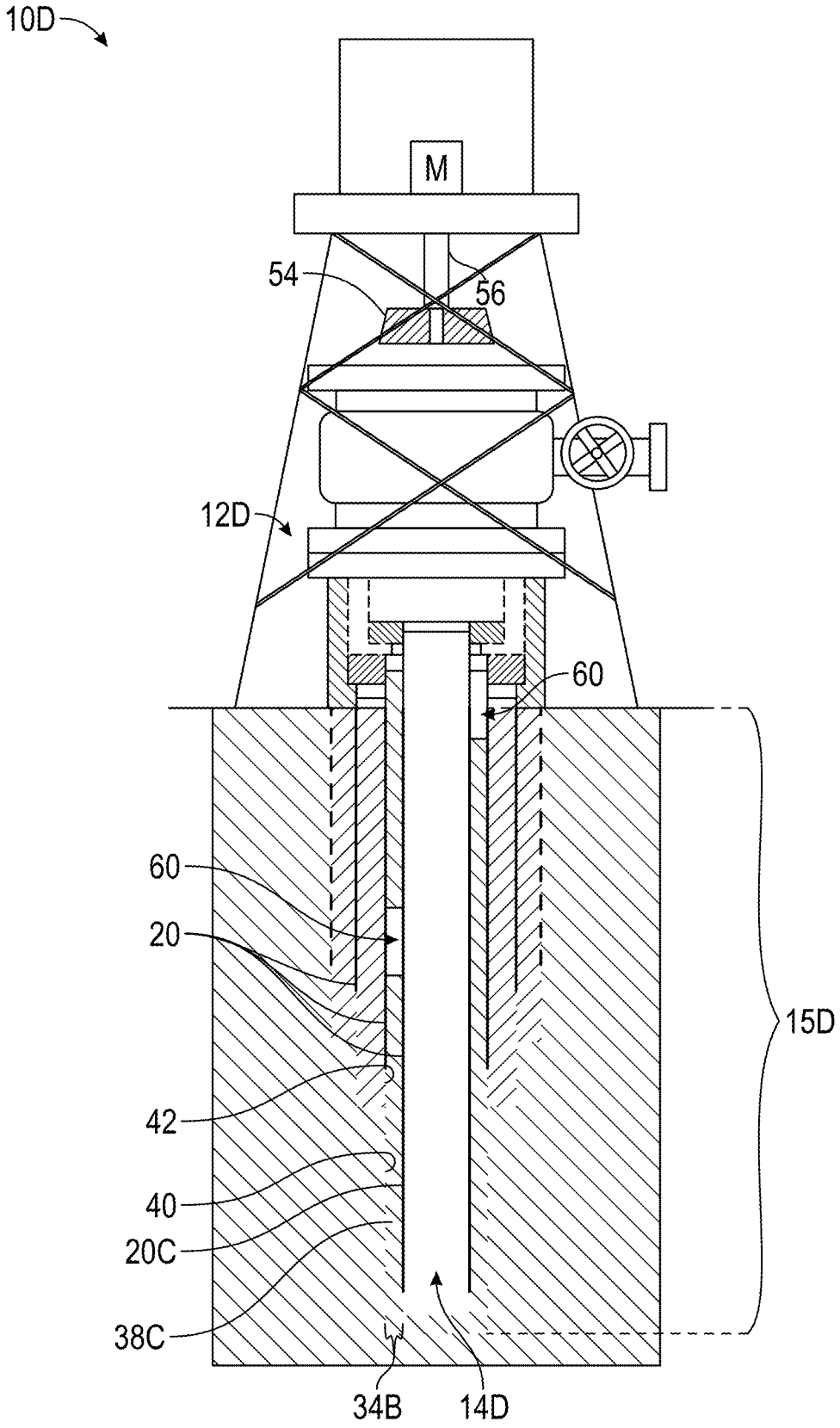
FIG. 4 is a partial cross-sectional view of the well system of FIG. 3 with example cement distribution within an annular space surrounding the casing string, in accordance with an embodiment of the present disclosure.

To help illustrate, an example of a well system 10D after an innermost (e.g., production) casing string 20C suspended by a wellhead 12D is cemented within a wellbore 14D of a well 15D is shown in FIG. 4. Similar to FIG. 1, the well system 10D of FIG. 4 includes an innermost cement layer 38C formed in an innermost annular space 34B surrounding the innermost casing string 20C.

However, as depicted in FIG. 4, voids (e.g., fissures and/or cavities) 60 are present in the innermost cement layer 38C surrounding the innermost casing string 20C. At least in some instances, a void 60 in a layer of cement 38 in an annular space 34 surrounding a casing string 20 may result due to liquid cement 38D not distributing uniformly within the annular space 34. In any case, a void 60 in a layer of cement 38 surrounding a casing string 20 may result in open space being present between the casing string 20 and a surrounding wall, such as a formation wall 40, a cement wall 42, or an outer (e.g., intermediate or outermost) casing string 20, which, at least in some instances, may reduce the ability of the casing string 20 to structurally support a corresponding wellbore 14 and/or to provide fluid isolation within the wellbore 14.

Accordingly, to facilitate improving distribution (e.g., uniformity) of cement 38 within an annular space 34 surrounding a casing string 20 and, thus, effectiveness of the casing string 20, the present disclosure provides techniques for rotating the casing string 20 while the casing string 20 is being cemented within a wellbore 14 of a well 15. In particular, to facilitate rotating a casing string 20, in some embodiments, a well system 10 may include a rotatable casing hanger 26, which is implemented to be secured to an upper end of the casing string 20. Additionally, to facilitate rotating a casing hanger 26 and, thus, a corresponding casing string 20, in some embodiments, a well system 10 may include a rotatable running tool 54, which is implemented to be secured between an upper end of the casing hanger 26 and a landing joint 56.

Figure 5:
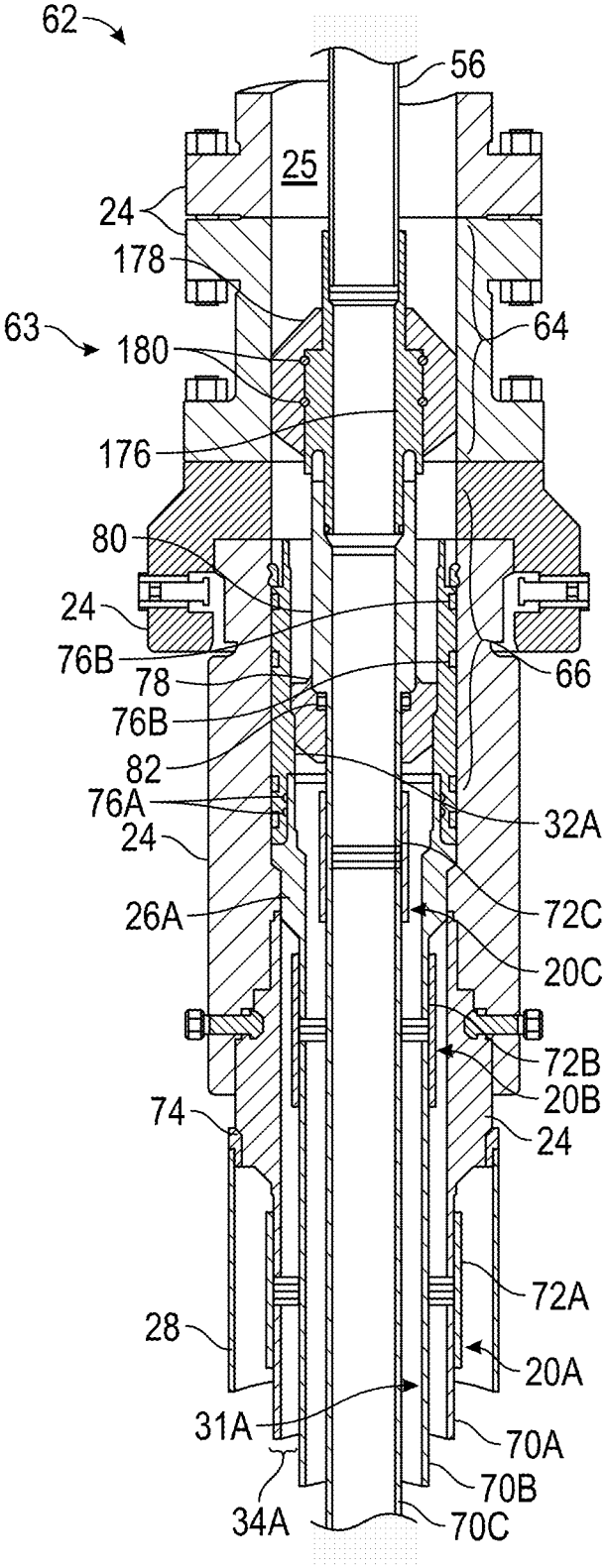
FIG. 5 is a cross-sectional view of an example of a portion of a well system that includes a rotatable casing hanger and a rotatable running tool, in accordance with an embodiment of the present disclosure.

To help illustrate, a more detailed example of a portion 62 of a well system 10, which includes an example of a running tool 54—namely a rotatable running tool 64—and a portion 63 of a wellhead 12 including an example of a casing hanger 26—namely a rotatable casing hanger 66, is shown in FIG. 5. However, it should be appreciated that the depicted example is merely intended to be illustrative and not limiting. In particular, in other embodiments, a rotatable casing hanger 66 may be used without a rotatable running tool 64. Alternatively, in other embodiments, a rotatable running tool 64 may be used with a casing hanger 26 other than a rotatable casing hanger 66.

In any case, as depicted, the portion 63 of the wellhead 12 concentrically suspends an outermost (e.g., surface) casing string 20A, an intermediate casing string 20B, and an innermost (e.g., production) casing string 20C. In particular, as in the depicted example, a casing string 20 suspended by a wellhead 12 generally includes casing pipes 70 secured via one or more casing joints 72. In other words, in the depicted example, the outermost casing string 20A includes outermost (e.g., surface) casing pipes 70A secured via one or more outermost (e.g., surface) casing joints 72A. Additionally, the intermediate casing string 20B includes intermediate casing pipes 70B secured via one or more intermediate casing joints 72B. Furthermore, the innermost casing string 20C includes innermost (e.g., production) casing pipes 70C secured via one or more innermost (e.g., production) casing joints 72C.

However, it should again be appreciated that the depicted example is merely intended to be illustrative and not limiting. In particular, in other embodiments, a wellhead 12 may concentrically suspend only two casing strings 20—namely an outermost casing string 20A and an innermost casing string 20C, but not an intermediate casing string 20B. Alternatively, in other embodiments, a wellhead 12 may concentrically suspend multiple intermediate casing strings 20B and, thus, more than three (e.g., four, five, or more) total casing strings 20.

In any case, as depicted, in addition to the rotatable casing hanger 66, the portion 63 of the wellhead 12 generally includes wellhead housing 24, which defines a wellhead bore 25 through the wellhead 12. In particular, as depicted, the wellhead housing (e.g., a casing head) 24 is secured to an upper end of the outermost casing string 20A. Additionally, as described above, a conductor pipe 28 may act as a foundation for a wellhead 12. Accordingly, in the depicted example, a lower end of the wellhead housing 24 rests (e.g., lands) on a landing ring 74, which is secured on a conductor pipe 28.

However, it should again be appreciated that the depicted example is merely intended to be illustrative and not limiting. In particular, in other embodiments, a wellhead 12 may be secured to a conductor pipe 28 in a different manner, for example, via a flanged connection. Alternatively, in other embodiments, a well system 10 may not include a conductor pipe 28 and, thus, a wellhead 12 in the well system 10 may instead rest (e.g., land) directly on the surface of a ground formation 30.

In any case, to facilitate concentrically suspending the intermediate casing string 20B, the portion 63 of the wellhead 12 additionally includes an intermediate (e.g., first and/or outer) casing hanger 26A. In particular, as depicted, the intermediate casing hanger 26A is secured to an upper end of the intermediate casing string 20B. Additionally, as depicted, the intermediate casing hanger 26A includes an external landing shoulder on its outer surface, which lands on an internal landing shoulder on the inner surface of the wellhead housing 24.

However, it should again be appreciated that the depicted example is merely intended to be illustrative and not limiting. In particular, to facilitate suspending an intermediate casing string 20B, in other embodiments, the wellhead housing (e.g., a casing spool) 24 of a wellhead 12 may be secured directly to an upper end of the intermediate casing string 20B.

In any case, to facilitate sealing an intermediate casing bore 31A of the intermediate casing string 20B from an intermediate annular space 34A surrounding the intermediate casing string 20B (e.g., between the intermediate casing string 20B and the outermost casing string 20A), in the depicted example, the portion 63 of the wellhead 12 includes an intermediate (e.g., first and/or outer) annular packoff 32A landed on the intermediate casing hanger 26A. In particular, to facilitate sealing the intermediate casing bore 31A of the intermediate casing string 20B from the intermediate annular space 34A, the intermediate annular packoff 32A includes one or more inner (e.g., internal) packoff seals 76A, which are radially compressed between the intermediate annular packoff 32A and the intermediate casing hanger 26A, as well as one or more outer (e.g., external) packoff seals 76B, which are radially compressed between the intermediate annular packoff 32A and the wellhead housing 24.

Additionally, as depicted, to facilitate concentrically suspending the innermost casing string 20C, the rotatable casing hanger 66 is secured to an upper end of the innermost casing string 20C and lands on the intermediate annular packoff 32A. In particular, as in the depicted example, to facilitate suspending a casing string 20 while enabling the casing string 20 to be rotated while landed, a rotatable casing hanger 66 in a wellhead 12 may generally include a hanger body 80, which has an upper end secured to a running tool 54, such as a rotatable running tool 64, and a lower end secured to the casing string 20, a hanger sleeve 78, which is secured circumferentially around the hanger body 80 and lands on another (e.g., outer) wellhead component, as well as a hanger bearing assembly 82, which is disposed axially between the hanger sleeve 78 and the hanger body 80 to facilitate rotating the hanger body 80 relative to (e.g., within) the hanger sleeve 78 as well as transferring axial force between the hanger body 80 and the hanger sleeve 78.

Figure 6:
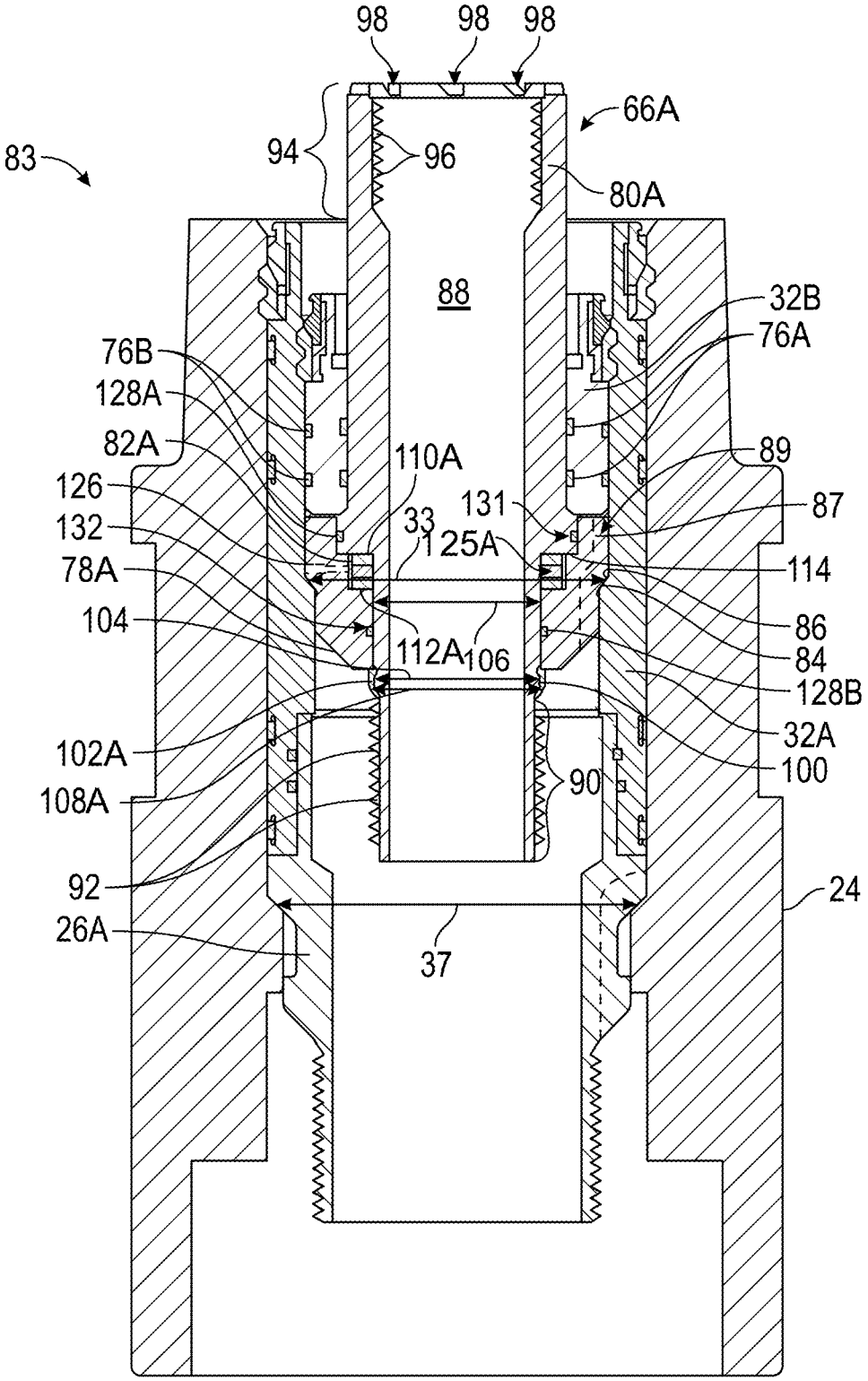
FIG. 6 is a more detailed cross-sectional view of an example of the rotatable casing hanger of FIG. 5, in accordance with an embodiment of the present disclosure.

To help more clearly illustrate, a more detailed example of a portion 83 of a wellhead 12, which includes an example of a rotatable casing hanger 66A, is shown in FIG. 6. As depicted, the rotatable casing hanger 66A generally includes a hanger sleeve 78A, a hanger body 80A, and a hanger bearing assembly 82A.

In particular, in the depicted example, the hanger sleeve 78A lands on an intermediate (e.g., first and/or outer) annular packoff 32A, which in turn lands on an intermediate (e.g., first and/or outer) casing hanger 26A, via engagement between a downwardly-facing external landing shoulder 84 on the outer surface of the hanger sleeve 78 and an upwardly-facing internal landing shoulder 86 on the inner surface of the intermediate annular packoff 32A. Additionally, in the depicted example, an inner (e.g., second) annular packoff 32B lands on the rotatable casing hanger 66A to facilitate sealing a casing bore 31 of a casing string 20 secured to the rotatable casing hanger 66A from an annular space 34 surrounding the casing string 20. In particular, to facilitate sealing a casing bore 31 of a corresponding casing string 20 from an annular space 34 surrounding the casing string 20, in the depicted example, the inner annular packoff 32B includes one or more inner packoff seals 76A, which are radially compressed between the inner annular packoff 32B and the hanger body 80A, as well as one or more outer packoff seals 76B, which are radially compressed between the inner annular packoff 32B and the intermediate annular packoff 32A.

However, it should be appreciated that the depicted example is merely intended to be illustrative and not limiting. In particular, in other embodiments, a wellhead 12 may not include an intermediate annular packoff 32A and/or an inner annular packoff 32B. For example, when a wellhead 12 does not include an inner annular packoff 32B, another (e.g., rotatable) casing hanger 26 may be landed on a rotatable casing hanger 66.

As another example, when a wellhead 12 does not include an intermediate annular packoff 32A, the hanger sleeve 78 of a rotatable casing hanger 66 may land directly on an another (e.g., intermediate) casing hanger 26 or the wellhead housing (e.g., a casing head or a casing spool) 24 of the wellhead 12. Nevertheless, as in the depicted example, since the inner diameter 33 of an intermediate annular packoff 32A may be smaller than an inner diameter 37 of wellhead housing (e.g., a casing hear or a casing spool) 24, in some embodiments, implementing a rotatable casing hanger 66 to land on an intermediate annular packoff 32A instead of directly on the wellhead housing 24 may facilitate reducing the size and/or weight of the rotatable casing hanger 66, which, at least in some instances, may facilitate improving handling of the rotatable casing hanger 66 and/or reducing implementation (e.g., material and/or manufacturing) cost associated with the rotatable casing hanger 66.

In any case, to facilitate flowing fluid, such as liquid cement 38D or drilling mud, to a casing bore 31 of a corresponding casing string 20, as in the depicted example, the hanger body 80 of a rotatable casing hanger 66 generally defines a hanger bore 88 that extends axially therethrough. In other words, as in the depicted example, a hanger sleeve 78 is generally secured circumferentially around a corresponding hanger body 80 such that the hanger body 80 extends through the hanger sleeve 78. Accordingly, as in the depicted example, to facilitate insertion of a rotatable casing hanger 66, in some embodiments, the hanger sleeve 78 of the rotatable casing hanger 66 may have a tapered lower end. Additionally, as in the depicted example, to enable flow (e.g., circulation) of fluid, such as liquid cement 38D, drilling mud, or water, past a rotatable casing hanger 66, in some embodiments, the hanger sleeve 78 of the rotatable casing hanger 66 may include hanger flutes 87 that define fluid circulation pathways 89 along its outer surface.

However, it should again be appreciated that the depicted example is merely intended to be illustrative and not limiting. In particular, to enable fluid flow past a rotatable casing hanger 66, in other embodiments, the rotatable casing hanger 66 may include fluid circulation pathways 89 that otherwise extend through its hanger sleeve 78 and/or its hanger body 80. Additionally or alternatively, in other embodiments, the hanger sleeve 78 of a rotatable casing hanger 66 may not have a tapered lower end.

In any case, as in the depicted example, to facilitate securement of a rotatable casing hanger 66 to a casing string 20 and, thus, suspension of the casing string 20 via the rotatable casing hanger 66, a lower end of its hanger body 80 generally includes a casing securement mechanism 90. In particular, in the depicted example, the casing securement mechanism 90 includes external threads 92 on an outer surface of the hanger body 80A. Additionally, to facilitate securement of a rotatable casing hanger 66 to a running tool 54 and, thus, manipulation (e.g., lifting, lowering, and/or rotation) of the rotatable casing hanger 66 via the running tool 54, as in the depicted example, an upper end of its hanger body 80 generally includes a tool securement mechanism 94. In particular, in the depicted example, the tool securement mechanism 94 includes internal threads 96 on an inner surface of the hanger body 80A as well as securement notches 98 along an upper axial end of the hanger body 80A.

However, it should again be appreciated that the depicted example is merely intended to be illustrative and not limiting. In particular, in other embodiments, a rotatable casing hanger 66 may include a different type of casing securement mechanism 90, for example, which includes internal threads on an inner surface of its hanger body 80 or a flanged connection. Additionally or alternatively, in other embodiments, a rotatable casing hanger 66 may include a different type of tool securement mechanism 94, for example, which includes external threads on an outer surface of its hanger body 80 and/or does not include securement notches 98.

In any case, to facilitate securing the hanger sleeve 78A circumferentially around the hanger body 80A such that the hanger body 80A is rotatable relative to (e.g., within) the hanger sleeve 78A, in the depicted example, the rotatable casing hanger 66A includes a securement protrusion 100 on the outer surface of the hanger body 80A adjacent to a lower end of the hanger sleeve 78A and a securement clamp 102A, which is secured circumferentially around the securement protrusion 100. In particular, in the depicted example, the securement protrusion 100 has an outer diameter 104 that is smaller than an inner diameter 106 of the hanger sleeve 78A while the securement clamp 102A has an outer diameter 108A that is larger than the inner diameter 106 of the hanger sleeve 78A. Accordingly, in such embodiments, a hanger sleeve 78 may be secured to a hanger body 80 at least in part by inserting the hanger body 80 through the hanger sleeve 78 until the securement protrusion 100 on the hanger body 80 moves past the lower end of the hanger sleeve 78 (e.g., and an external load shoulder 110 on the hanger body 80 directly abuts a corresponding hanger bearing assembly 82) and subsequently securing a securement clamp 102 around (e.g., on) the securement protrusion 100 adjacent to the lower end of the hanger sleeve 78.

However, it should again be appreciated that the depicted example is merely intended to be illustrative and not limiting. In particular, in other embodiments, the hanger body 80 of a rotatable casing hanger 66 may be rotatably secured to a corresponding hanger sleeve 78 in a different manner. For example, as will be described in more detail below, in other embodiments, a rotatable casing hanger 66 may include a securement notch on an outer surface of its hanger body 80 instead of a securement protrusion 100.

In any case, to facilitate rotating a hanger body 80 relative to a hanger sleeve 78 as well as transferring axial force therebetween, a hanger bearing assembly 82 is disposed axially between the hanger body 80 and the hanger sleeve 78. In particular, the hanger bearing assembly 82 is disposed between a downwardly-facing external load shoulder 110 on an outer surface of the hanger body 80 and an (e.g., primary) upwardly-facing internal load shoulder 112 on an inner surface of the hanger sleeve 78, which axially opposes one another, such that the hanger bearing assembly 82 raises the hanger body 80 off of the hanger sleeve 78. In this manner, the hanger bearing assembly 82 may facilitate reducing the rotational resistance the hanger sleeve 78 exerts on the hanger body 80 while transferring the weight of a corresponding casing string 20, which can be in the range of tens of thousands of pounds, from the hanger body 80 to the hanger sleeve 78 and, thus, the hanger bearing assembly 82 may be load bearing.

Due to the substantial axial load that may be placed on its hanger bearing assembly 82, as in the depicted example, to facilitate improving reliability of a rotatable casing hanger 66, in some embodiments, the hanger sleeve 78 of the rotatable casing hanger 66 may include, in addition to a primary internal load shoulder 112, a backup upwardly-facing internal load shoulder 114 on its inner surface, which axially opposes the external load shoulder 110 on the hanger body 80 of the rotatable casing hanger 66 and is radially outwardly as well as axially upwardly offset relative to the primary internal load shoulder 112. In other words, in such embodiments, the backup internal load shoulder 114 on the hanger sleeve 78 may be closer to the external load shoulder 110 on the hanger body 80 than the primary internal load shoulder 112 on the hanger sleeve 78. Accordingly, if the hanger bearing assembly 82 of the rotatable casing hanger 66 ever were to fail (e.g., crush) due to the weight of a corresponding casing string 20, in such embodiments, the hanger body 80 would drop a minimal distance before the external load shoulder 110 thereon is stopped by the backup internal load shoulder 114 on the hanger sleeve 78, which, at least in some instances, may facilitate reducing resulting disturbance to the remainder of a wellhead 12, for example, by enabling an inner annular packoff 32B that lands on the rotatable casing hanger 66 to nevertheless lock into an outer wellhead component, such as an intermediate annular packoff 32A or wellhead housing 24.

However, it should again be appreciated that the depicted example is merely intended to be illustrative and not limiting. In particular, in other embodiments, a rotatable casing hanger 66 may only include a single internal load shoulder 112 on its hanger sleeve 78 and, thus, not include a backup internal load shoulder 114. In any case, to facilitate bearing substantial axial force while improving rotational efficiency, in some embodiments, the hanger bearing assembly 82 of a rotatable casing hanger 66 may be an axial roller bearing assembly, which includes cylindrically-shaped roller bearings, for example, instead of spherically-shaped ball bearings.

Figure 7:
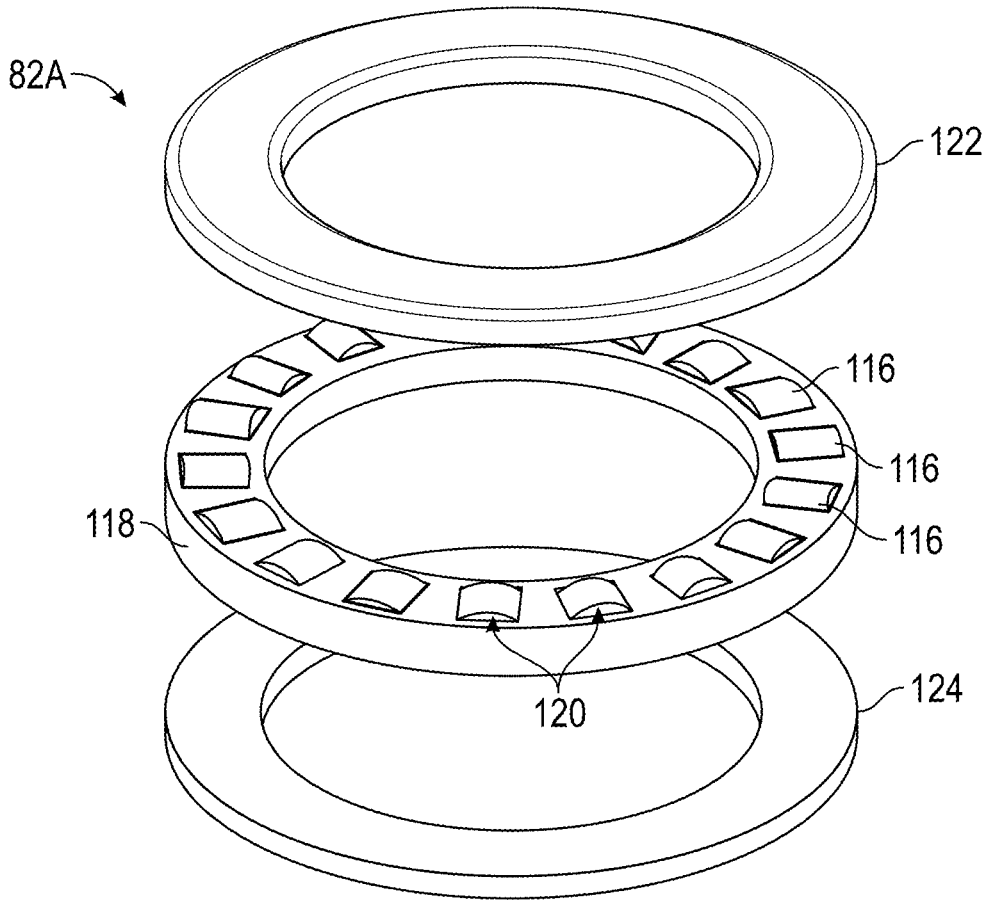
FIG. 7 is an exploded view of an example of a hanger bearing assembly that may be included in the rotatable casing hanger of FIG. 6, in accordance with an embodiment of the present disclosure.

To help illustrate, an example of a hanger axial roller bearing assembly 82A that may be included in a rotatable casing hanger 66 is shown in FIG. 7. As depicted, the hanger axial roller bearing assembly 82A generally includes multiple circumferentially-spaced, radially-oriented, and cylindrically-shaped roller bearings 116.

Additionally, as in the depicted example, to facilitate holding its roller bearings 116 in place, in some embodiments, a hanger axial roller bearing assembly 82A may include a ring-shaped roller (e.g., central) plate 118 that has circumferentially-spaced and radially-oriented roller openings 120 extending therethrough. In particular, in the depicted example, the roller bearings 116 are each rotatably secured within a corresponding roller opening 120 in the roller plate 118 via an axle, which is obfuscated from view, such that its circumference extends above the roller plate 118 and, although obfuscated from view, below the roller plate 118.

Furthermore, as in the depicted example, to facilitate circumferentially distributing load exerted thereon over more of its roller bearings 116 and, thus, improving its load capacity, in some embodiments, a hanger axial roller bearing assembly 82A may include a ring-shaped upper contact plate 122, which is disposed above the roller bearings 116, and a ring-shaped lower contact plate 124, which is disposed below the roller bearings 116. In particular, in the depicted example, the upper contact plate 122 may contact the roller bearings 116 as well as an external load shoulder 110 on the hanger body 80 of a rotatable casing hanger 66 while the lower contact plate 124 may contact the roller bearings 116 as well as an (e.g., primary) internal load shoulder 112 on the hanger sleeve 78 of the rotatable casing hanger 66. In this manner, the cylindrical shape of the roller bearings 116 may facilitate reducing resistance to rotation of the upper contact plate 122 relative to the lower contact plate 124 and, thus, resistance to rotation of the hanger body 80 of a corresponding rotatable casing hanger 66 relative to the hanger sleeve 78 of the rotatable casing hanger 66.

However, it should be appreciated that the depicted example is merely intended to be illustrative and not limiting. In particular, in other embodiments, a hanger axial roller bearing assembly 82A of a rotatable casing hanger 66 may not include a roller plate 118, for example, when an upper contact plate 122 of the hanger axial roller bearing assembly 82A includes circumferentially-spaced and radially-oriented roller notches on its lower surface and a lower contact plate 124 of the hanger axial roller bearing assembly 82A includes corresponding (e.g., axially aligned) circumferentially-spaced and radially-oriented roller notches on its upper surface that facilitate holding its roller bearings 116 in place. Additionally or alternatively, in other embodiments, a hanger axial roller bearing assembly 82A of a rotatable casing hanger 66 may not include an upper contact plate 122 and/or a lower contact plate 124, for example, when the roller bearings 116 of the hanger axial roller bearing assembly 82A are rated to accommodate ununiform loads expected to be placed thereon. Moreover, as will be described in more detail below, a hanger bearing assembly 82 of a rotatable casing hanger 66 may be a different type of bearing assembly, such as a magnetic bearing assembly or a fluid bearing assembly.

In any case, as described above, to facilitate transferring axial force between a hanger body 80 and a hanger sleeve 78 of a rotatable casing hanger 66 as well as rotating the hanger body 80 relative to the hanger sleeve 78, a hanger bearing assembly 82 may be disposed axially between a downwardly-facing external load shoulder 110 on the hanger body 80 and an upwardly-facing internal load shoulder 112 on the hanger sleeve 78. In particular, in the example depicted in FIG. 6, to accommodate the hanger axial roller bearing assembly 82A, the external load shoulder 110A on the hanger body 80A and the internal load shoulder 112A on the hanger sleeve 78A are substantially parallel to one another and/or substantially perpendicular (e.g., orthogonal) to an axial (e.g., longitudinal) extent of the rotatable casing hanger 66A.

However, it should again be appreciated that the depicted example is merely intended to be illustrative and not limiting. In particular, as will be described in more detail below, in other embodiments, an internal load shoulder 112 on the hanger sleeve 78 of a rotatable casing hanger 66 and/or an external load shoulder 110 on the hanger body 80 of the rotatable casing hanger 66 may have a different shape, for example, when the hanger bearing assembly 82 of the rotatable casing hanger 66 is a different type of hanger bearing assembly 82, such as a fluid bearing assembly. Additionally or alternatively, since its hanger bearing assembly 82 may be rated to handle substantial axial force but minimal radial force, in other embodiments, a rotatable casing hanger 66 may additionally include one or more centralizers disposed radially and circumferentially between its hanger body 80 and its hanger sleeve 78.

Figure 8:
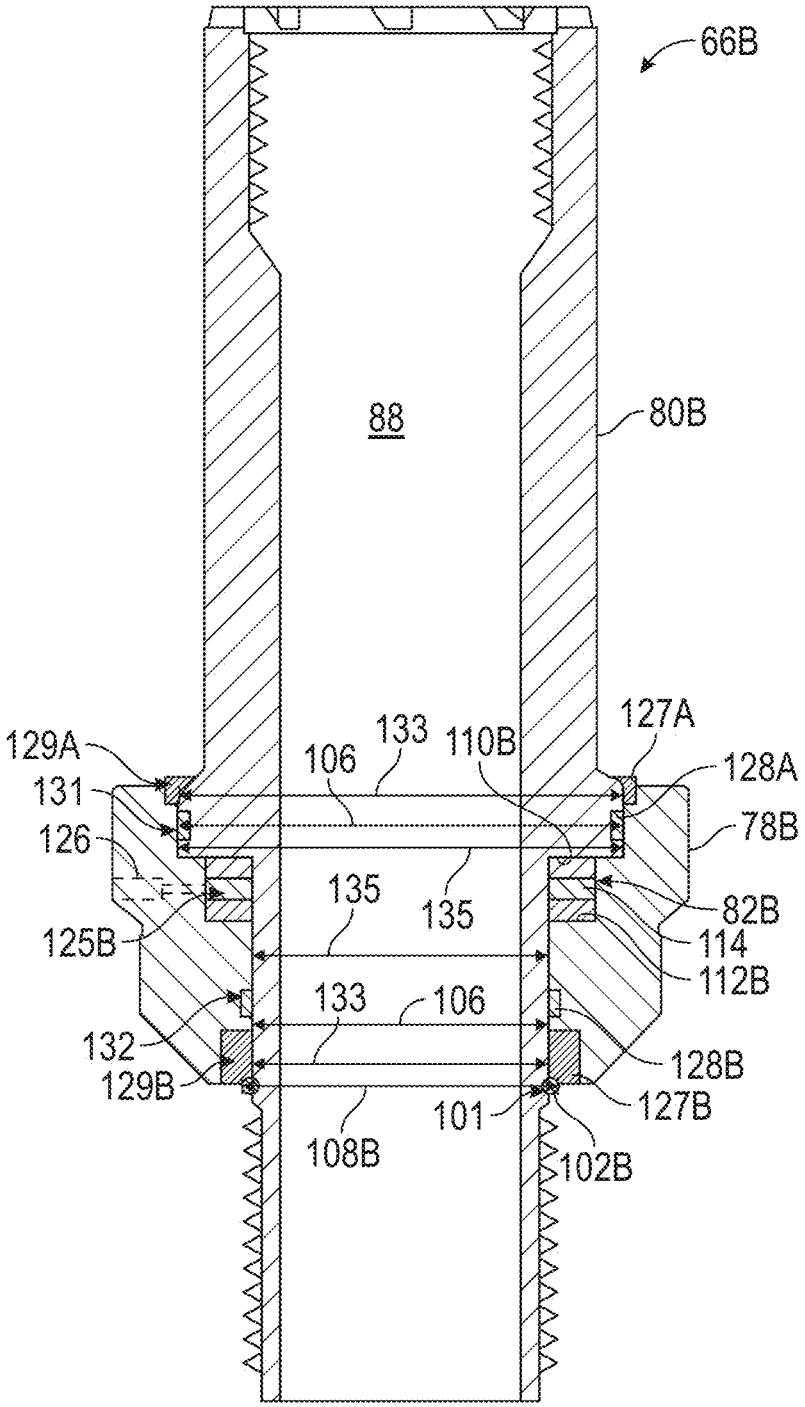
FIG. 8 is a cross-sectional view of another example of a rotatable casing hanger, in accordance with an embodiment of the present disclosure.

To help illustrate, another example of a rotatable casing hanger 66B that may be deployed in a wellhead 12 is shown in FIG. 8. Similar to the rotatable casing hanger 66A of FIG. 6, the rotatable casing hanger 66B of FIG. 8 generally includes a hanger body 80B, which defines a hanger bore 88, a hanger sleeve 78B, which is secured circumferentially around the hanger body 80B, and a hanger bearing assembly 82B, which is disposed axially between the hanger body 80B and the hanger sleeve 78B.

In fact, the hanger bearing assembly 82B of FIG. 8 generally matches the hanger bearing assembly 82A of FIG. 6. Additionally, the hanger body 80B of FIG. 8 generally matches the hanger body 80A of FIG. 6 except the hanger body 80B of FIG. 8 includes a securement notch 101 on its outer surface adjacent to the lower end of the hanger sleeve 78B instead of a securement protrusion 100. Nevertheless, similar to the rotatable casing hanger 66A of FIG. 6, to facilitate securing the hanger sleeve 78B to the hanger body 80B, the rotatable casing hanger 66B of FIG. 8 includes a securement clamp 102B, which has an outer diameter 108A that is larger than the inner diameter 106 of the hanger sleeve 78B, secured around (e.g., within and/or on) the securement notch 101.

However, as depicted in FIG. 8, the rotatable casing hanger 66B additionally includes centralizers 127 that are radially and circumferentially disposed between its hanger sleeve 78B and its hanger body 80B to facilitate maintaining the hanger body 80B appropriately centralized within the hanger sleeve 78B, for example, by blocking the hanger body 80B from wobbling as well as from directly abutting the hanger sleeve 78B without inadvertently increasing rotational resistance. In particular, in the depicted example, the rotatable casing hanger 66B includes an upper centralizer 127A, which is disposed radially between the hanger body 80B and an upper end of the hanger sleeve 78B, and a lower centralizer 127B, which is disposed radially between the hanger body 80B and a lower end of the hanger sleeve 78B.

However, it should be appreciated that the depicted example is merely intended to be illustrative and not limiting. In particular, in other embodiments, a rotatable casing hanger 66 may include more than two (e.g., three, four, or more) centralizers 127. For example, a rotatable casing hanger 66 may additionally or alternatively include an intermediate centralizer 127 disposed radially between its hanger body 80 and a more central portion of its hanger sleeve 78. Additionally, in other embodiments, a rotatable casing hanger 66 may include a single (e.g., upper, lower, or intermediate) centralizer 127. Furthermore, in other embodiments, an upper centralizer 127A in a rotatable casing hanger 66 may be the same size as or larger than a corresponding lower centralizer 127B, for example, instead of being smaller than the lower centralizer 127B. Moreover, in other embodiments, a rotatable casing hanger 66 that includes one or more centralizers 127 may utilize a securement protrusion 100 on its hanger body 80 instead of a securement notch 101.

In any case, as in the depicted example, to facilitate disposing a centralizer 127 radially and circumferentially between a hanger sleeve 78 and a corresponding hanger body 80, in some embodiments, the centralizer 127 may be disposed within a centralizer notch 129 in the hanger sleeve 78. In particular, in the depicted example, the upper centralizer 127A is disposed within an upper centralizer notch 129A at an upper end of an inner surface of the hanger sleeve 78B while the lower centralizer 127B is disposed within a lower centralizer notch 129B at a lower end of an inner surface of the hanger sleeve 78B.

Additionally, to facilitate retaining a centralizer 127 in place, in some embodiments, the centralizer 127 may be secured within a corresponding centralizer notch 129 using adhesive, such as glue. However, in other embodiments, a centralizer 127 may be retained within a corresponding centralizer notch 129 via gravity and/or a securement clamp 102.

In any case, to facilitate maintaining a hanger body 80 appropriately centralized within a corresponding hanger sleeve 78 while reducing the likelihood of galling due to like materials rubbing against one another, in some embodiments, a centralizer 127 in a rotatable casing hanger 66 may be a dissimilar material insert, which is a different material as compared to the hanger body 80 and/or the hanger sleeve 78. For example, when the hanger body 80 and/or the hanger sleeve 78 of a rotatable casing hanger 66 are steel, a dissimilar material insert centralizer 127 in the rotatable casing hanger 66 may be bronze.

In particular, to facilitate blocking an outer surface of a hanger body 80 from directly abutting the inner surface of a corresponding hanger sleeve 78 and, thus, like materials from rubbing against one another, in some embodiments, a centralizer 127, such as a dissimilar material insert centralizer 127, may be disposed within a corresponding centralizer notch 129 in the hanger sleeve 78 such that the centralizer 127 extends radially out of the centralizer notch 129 beyond an adjacent inner surface of the hanger sleeve 78. In other words, in such embodiments, the inner (e.g., protruding) diameter 133 of a centralizer 127 disposed within a centralizer notch 129 in a hanger sleeve 78 may be smaller than an inner diameter 106 of the hanger sleeve 78 at an adjacent inner surface and slightly larger than the outer diameter 135 of a corresponding hanger body 80 at an opposing outer surface.

Accordingly, in such embodiments, when the hanger body 80 is rotated within the hanger sleeve 78, the outer surface of the hanger body 80 may engage (e.g., directly abut and/or rub against) the inner surface of the centralizer 127 instead of the inner surface of the hanger sleeve 78. Additionally or alternatively, in such embodiments, when the hanger body 80 is rotated within the hanger sleeve 78, the inner surface of the hanger sleeve 78 may engage the outer surface of the centralizer 127 instead of the outer surface of the hanger body 80. In other words, when a dissimilar material insert, the centralizer 127 may cause dissimilar materials to rub against one another during rotation, which, at least in some instances, may reduce the likelihood of galling occurring in the rotatable casing hanger 66 as compared to like materials, such as the hanger body 80 and the hanger sleeve 78, rubbing.

However, it should again be appreciated that the depicted example is merely intended to be illustrative and not limiting. In particular, in other embodiments, a centralizer 127 in a rotatable casing hanger 66 may be disposed within a centralizer notch 129 on an outer surface of its hanger body 80. Accordingly, in such embodiments, the outer (e.g., protruding) diameter of the centralizer 127 may be larger than an outer diameter of a corresponding hanger body 80 at an adjacent outer surface and slightly smaller than an inner diameter of a corresponding hanger sleeve 78 at an opposing inner surface.

In any case, to facilitate appropriate centralization (e.g., block wobbling without inadvertently increasing rotational resistance), at least in some instances, sizing of a centralizer 127 in a rotatable casing hanger 66 may be highly dependent on sizing of its hanger body 80 and/or its hanger sleeve 78 and, thus, tolerances of the centralizer 127 may be tight. In fact, to facilitate achieving tight tolerances, in some embodiments, a centralizer 127 may be customized (e.g., tailored) to a specific hanger sleeve 78 and/or a specific hanger body 80. For example, to facilitate customization to a specific hanger sleeve 78 and a specific hanger body 80, a centralizer 127 may be disposed within a corresponding centralizer notch 129 in the hanger sleeve 78 and a resulting inner diameter 133 of the centralizer 127 may then be machined based on (e.g., slightly larger than) an opposing outer diameter 135 of the hanger body 80 and/or based on (e.g., smaller than) an adjacent inner diameter 106 of the hanger sleeve 78 before the hanger body 80 is disposed therethrough. Nevertheless, in other embodiments, a centralizer 127 in a rotatable casing hanger 66 may be appropriately machined for its hanger sleeve 78 and/or its hanger body 80 before being disposed within a corresponding centralizer notch 129.

In any case, it should again be appreciated that the depicted example is merely intended to be illustrative and not limiting. In particular, as will be described in more detail below, in other embodiments, a rotatable casing hanger 66 may include a different type of centralizer 127, such as a radial ball bearing assembly.

Additionally or alternatively, in other embodiments, a rotatable casing hanger 66 may include a different type of hanger bearing assembly 82. For example, in other embodiments, a hanger bearing assembly 82 of a rotatable casing hanger 66 may be a magnetic bearing assembly. In particular, in some such embodiments, a hanger magnetic bearing assembly 82 of a rotatable casing hanger 66 may include first magnetic material secured to a downwardly-facing external load shoulder 110 on its hanger body 80 and second magnetic material, which has the same polarity as the first magnetic material, secured to an axially opposing, upwardly-facing internal load shoulder 112 on its hanger sleeve 78. As another example, in other embodiments, a hanger bearing assembly 82 of a rotatable casing hanger 66 may be a fluid bearing assembly.

Figure 9:
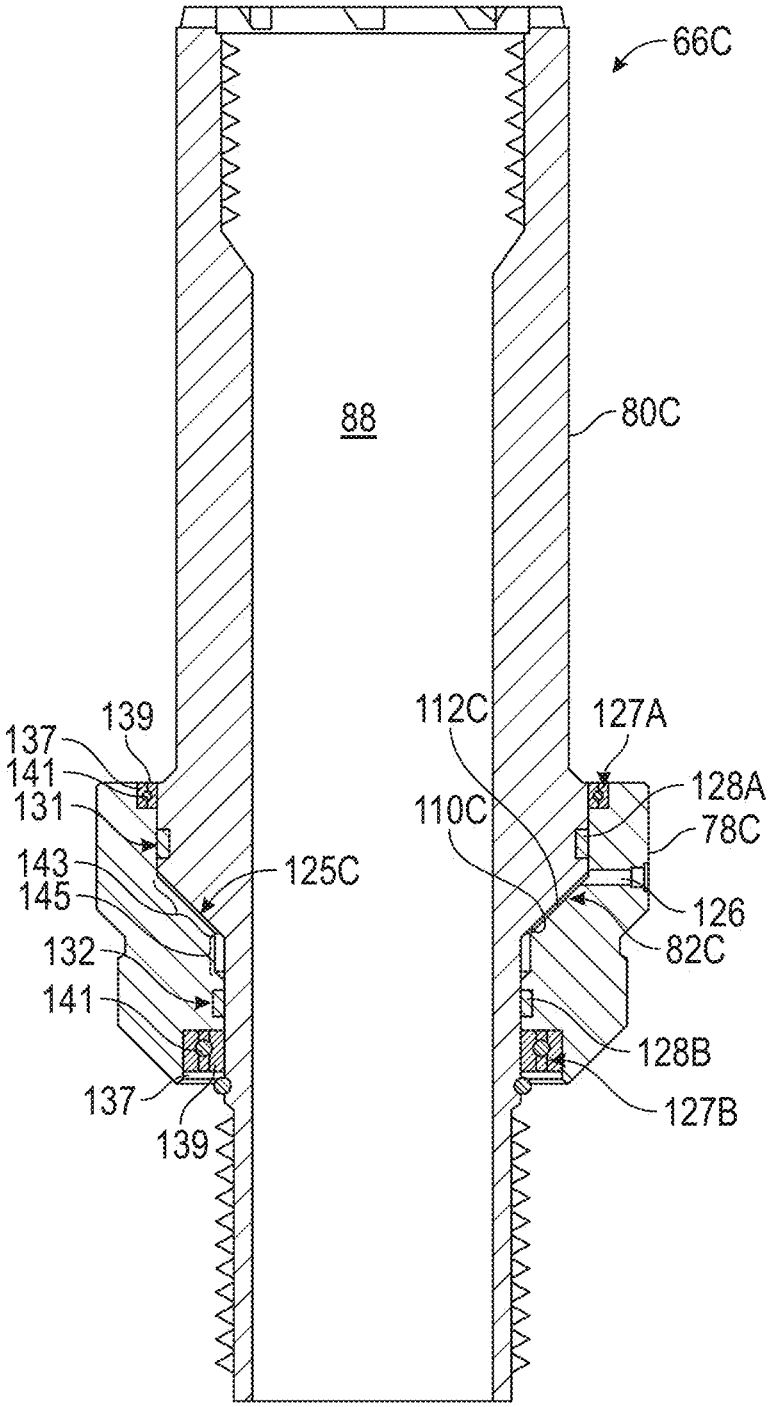
FIG. 9 is a cross-sectional view of a further example of a rotatable casing hanger, in accordance with an embodiment of the present disclosure.

To help illustrate, a further example of a rotatable casing hanger 66C that may be deployed in a wellhead 12 is shown in FIG. 9. Similar to the rotatable casing hanger 66B of FIG. 8, the rotatable casing hanger 66C of FIG. 9 generally includes a hanger body 80C, which defines a hanger bore 88, a hanger sleeve 78C, which is secured circumferentially around the hanger body 80C, a hanger bearing assembly 82C, which is disposed axially between the hanger body 80C and the hanger sleeve 78C, as well as an upper centralizer 127A and a lower centralizer 127B, which are disposed radially between the hanger body 80C and the hanger sleeve 78C.

However, to facilitate maintaining the hanger body 80C appropriately centralized within the hanger sleeve 78C while further reducing rotational resistance, each of the centralizers 127 in the rotatable casing hanger 66C of FIG. 9 is a radial ball bearing assembly, for example, instead of a dissimilar material insert. In particular, in the depicted example, each radial ball bearing centralizer 127 includes an outer housing (e.g., ring) 137, which abuts an inner surface of the hanger sleeve 78C, an inner housing (e.g., ring) 139, which abuts an outer surface of the hanger body 80C, and ball bearings 141, which are disposed radially and circumferentially between the outer housing 137 and the inner housing 139.

Additionally, the hanger bearing assembly 82C of FIG. 9 is a fluid bearing assembly, for example, instead of an axial roller bearing assembly. In particular, in the depicted example, the hanger fluid bearing assembly 82C includes bearing fluid disposed within a bearing fluid cavity (e.g., gap) 125C defined between a downwardly-facing external load shoulder 110C on the hanger body 80C and an opposing, upwardly-facing internal load shoulder 112C on the hanger sleeve 78C.

However, it should be appreciated that the depicted example is merely intended to be illustrative and not limiting. In particular, in other embodiments, a rotatable casing hanger 66 that includes a hanger fluid bearing assembly 82 may not include a centralizer 127 or may additionally or alternatively include a dissimilar material insert centralizer 127. In fact, in some embodiments, a rotatable casing hanger 66 may include a dissimilar material insert centralizer 127 as well as a radial ball bearing centralizer 127.

In any case, to facilitate optimizing the effectiveness of bearing fluid, in the depicted example, the external load shoulder 110C on the hanger body 80C and the internal load shoulder 112C on the hanger sleeve 78C are complimentarily tapered (e.g., slanted) to define a conical (e.g., tapered and/or slanted) region 143 of the bearing fluid cavity 125C. In particular, as depicted, in addition to axially overlapping, the external load shoulder 110C on the hanger body 80C radially overlaps with the internal load should 112C on the hanger sleeve 78C. In other words, in addition to exerting axial force to raise the hanger body 80C off of the hanger sleeve 78C, bearing fluid disposed within the bearing fluid cavity 125C may ease rotation of the hanger body 80C within the hanger sleeve 78C at least in part by exerting radial force to facilitate maintaining the hanger body 80C appropriately centralized within the hanger sleeve 78C.

Additionally, as compared to a bearing fluid cavity 125A defined in the rotatable casing hanger 66A of FIG. 6 as well as a bearing fluid cavity 125B defined in the rotatable casing hanger 66B of FIG. 8, the bearing fluid cavity 125C is defined in the rotatable casing hanger of FIG. 9 such that the external load shoulder 110C on the hanger body 80C and the internal load shoulder 112C on the hanger sleeve 78C are closer together, for example, due to the bearing fluid cavity 125C not needing to accommodate an axial roller bearing assembly.

Accordingly, if the hanger fluid bearing assembly 82C ever were to fail (e.g., crush) due to the weight of a corresponding casing string 20, the hanger body 80C would drop a minimal distance before the external load shoulder 110C thereon is stopped by the internal load shoulder 112C on the hanger sleeve 78C, which, at least in some instances, may facilitate reducing resulting disturbance to the remainder of a wellhead 12, for example, by enabling an inner annular packoff 32B that lands on the rotatable casing hanger 66C to nevertheless lock into an outer wellhead component, such as an intermediate annular packoff 32A or wellhead housing 24. In other words, at least in some embodiments, inclusion of a tapered external load shoulder 110 on the hanger body 80 of a rotatable casing hanger 66 and a tapered internal load shoulder 112 on the hanger sleeve 78 of the rotatable casing hanger 66 may obviate inclusion of a separate backup internal load shoulder 114 on the hanger sleeve 78.

However, it should again be appreciated that the depicted example is merely intended to be illustrative and not limiting. In particular, in other embodiments, a rotatable casing hanger 66 that includes a hanger fluid bearing assembly 82 may nevertheless utilize a (e.g., cylindrical and/or rectangular cross-sectional) bearing fluid cavity 125 similar to FIG. 6 or 8, for example, defined by an external load shoulder 110 on its hanger body 80 and an internal load shoulder 112 on its hanger sleeve 78, which axially oppose one another and are orthogonal (e.g., perpendicular) to an axial (e.g., longitudinal) extent of the rotatable casing hanger 66. In other words, at least in such embodiments, a rotatable casing hanger 66 that includes a hanger fluid bearing assembly 82 may nevertheless include a backup internal load shoulder 114 on its hanger sleeve 78.

In any case, in addition to the conical region 143, the bearing fluid cavity 125C of FIG. 9 includes an expanded cylindrical region 145 that is connected to a lower end of the conical region 143. In particular, as depicted, the bearing fluid cavity 125C is defined such that there is more clearance between the inner surface of the hanger sleeve 78C and the outer surface of the hanger body 80C in the cylindrical region 143 as compared to the conical region 143. Accordingly, due to gravity, material particles present in the bearing fluid cavity 125C (e.g., due to inadvertent contamination and/or the hanger body 80C inadvertently rubbing against the hanger sleeve 78C) may collect in the cylindrical region 145 of the bearing fluid cavity 125C while the increased clearance in the cylindrical region 145 may facilitate reducing the likelihood of the material particles inadvertently damaging (e.g., scoring) the rotatable casing hanger 66C during subsequent rotation.

However, it should again be appreciated that the depicted example is merely intended to be illustrative and not limiting. In particular, in other embodiments, a bearing fluid cavity 125 in a rotatable casing hanger 66 may include a conical region 143 but not a cylindrical region 145. In any case, at least in some embodiments, fluid, such as lubricant or bearing fluid, may be supplied to and retained at a hanger bearing assembly 82 of a rotatable casing hanger 66 to facilitate operation of the hanger bearing assembly 82.

As in the examples depicted in FIGS. 6, 8 and 9, to facilitate supplying fluid to its hanger bearing assembly 82, in some embodiments, a rotatable casing hanger 66 may include a hanger bearing port 126 that is fluidly connected to its hanger bearing assembly 82. In particular, in the depicted examples, the hanger bearing port 126 extends from an outer surface of the hanger sleeve 78 through the hanger sleeve 78 to an inner surface of the hanger sleeve 78 and, thus, the hanger bearing assembly 82.

However, it should again be appreciated that the depicted examples are merely intended to be illustrative and not limiting. In particular, in other embodiments, a hanger bearing port 126 of a rotatable casing hanger 66 may additionally or alternatively extend through the hanger body 80 of the rotatable casing hanger 66 to a corresponding hanger bearing assembly 82. Alternatively, in other embodiments, a rotatable casing hanger 66 may not include a hanger bearing port 126, for example, when fluid is supplied to its hanger bearing assembly 82 before the rotatable casing hanger 66 is assembled or when fluid does not need to be supplied to its hanger bearing assembly 82.

In any case, as in the depicted examples, to facilitate retaining fluid at its hanger bearing assembly 82, in some embodiments, a rotatable casing hanger 66 may include one or more hanger seals 128, which are each radially compressed between its hanger body 80 and its hanger sleeve 78. In particular, in the depicted examples, the rotatable casing hangers 66 each includes an upper hanger seal 128A, which is disposed above its hanger bearing assembly 82, and a lower hanger seal 128B, which is disposed below its hanger bearing assembly 82.

In some embodiments, a hanger seal 128 in a rotatable casing hanger 66 may be a rubber O-ring, for example, when its hanger bearing assembly 82 is an axial roller bearing assembly. However, to facilitate providing sealing during rotation, in other embodiments, a hanger seal 128 of a rotatable casing hanger 66 may be a different type of material, such as plastic or even metal. Additionally or alternatively, to facilitate providing sealing during rotation, in other embodiments, a hanger seal 128 of a rotatable casing hanger 66 may have a different cross-sectional shape, such as a rectangular cross-sectional shape or a trapezoidal cross-sectional shape. For example, to facilitate providing improved sealing integrity during rotation, a hanger seal 128 used with a hanger fluid bearing assembly 82 may be a T-seal.

In any case, as in the depicted examples, to facilitate retaining a hanger seal 128 in place, in some embodiments, a rotatable casing hanger 66 may include an external seal groove 131 on the outer surface of its hanger body 80 and/or an internal seal groove 132 on the inner surface of its hanger sleeve 78. In particular, in the depicted examples, the upper hanger seals 128A are each disposed within an external seal groove 131 on a corresponding hanger body 80. Additionally, in the depicted examples, the lower hanger seals 128B are each disposed within an internal seal groove 132 on a corresponding hanger sleeve 78.

However, it should again be appreciated that the depicted examples are merely intended to be illustrative and not limiting. In particular, in other embodiments, a rotatable casing hanger 66 may not include an upper hanger seal 128A and/or a lower hanger seal 128B, for example, when fluid does not need to be retained at its hanger bearing assembly 82 or engagement between its hanger sleeve 78 and its hanger body 80 provides sufficient sealing. Additionally, in other embodiments, an upper hanger seal 128A of a rotatable casing hanger 66 may be disposed within an internal seal groove 132 on the hanger sleeve 78 of the rotatable casing hanger 66 and/or a lower hanger seal 128B of the rotatable casing hanger 66 may be disposed within an external seal groove 131 on the hanger body 80 of the rotatable casing hanger 66. Furthermore, to facilitate improving sealing integrity, in other embodiments, a rotatable casing hanger 66 may include multiple upper hanger seals 128A and/or multiple lower hanger seals 128B. In any case, in this manner, a rotatable casing hanger 66 may facilitate rotating a corresponding casing string 20 while landed, which, at least in some instances, may facilitate reducing the likelihood of damaging (e.g., scoring) surrounding components during rotation and/or improving the integrity (e.g., uniformity) of cement 38 formed in an annular space 34 surrounding the casing string 20 and, thus, improving effectiveness of (e.g., structural support and/or fluid isolation provided by) the casing string 20.

Figure 10:
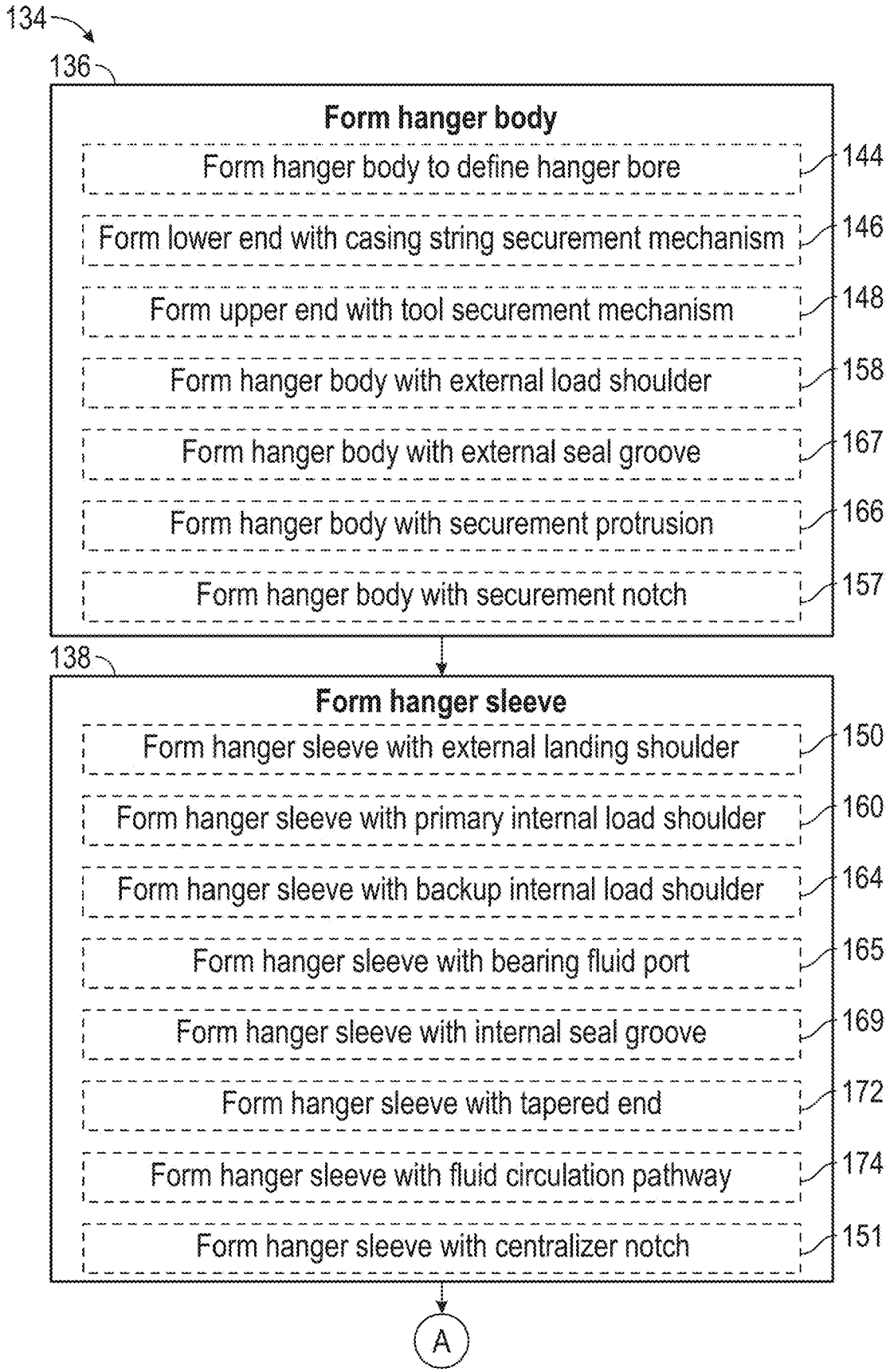
FIG. 10 is a flow diagram of an example of a process for implementing (e.g., manufacturing) a rotatable casing hanger, in accordance with an embodiment of the present disclosure.
Figure 10:
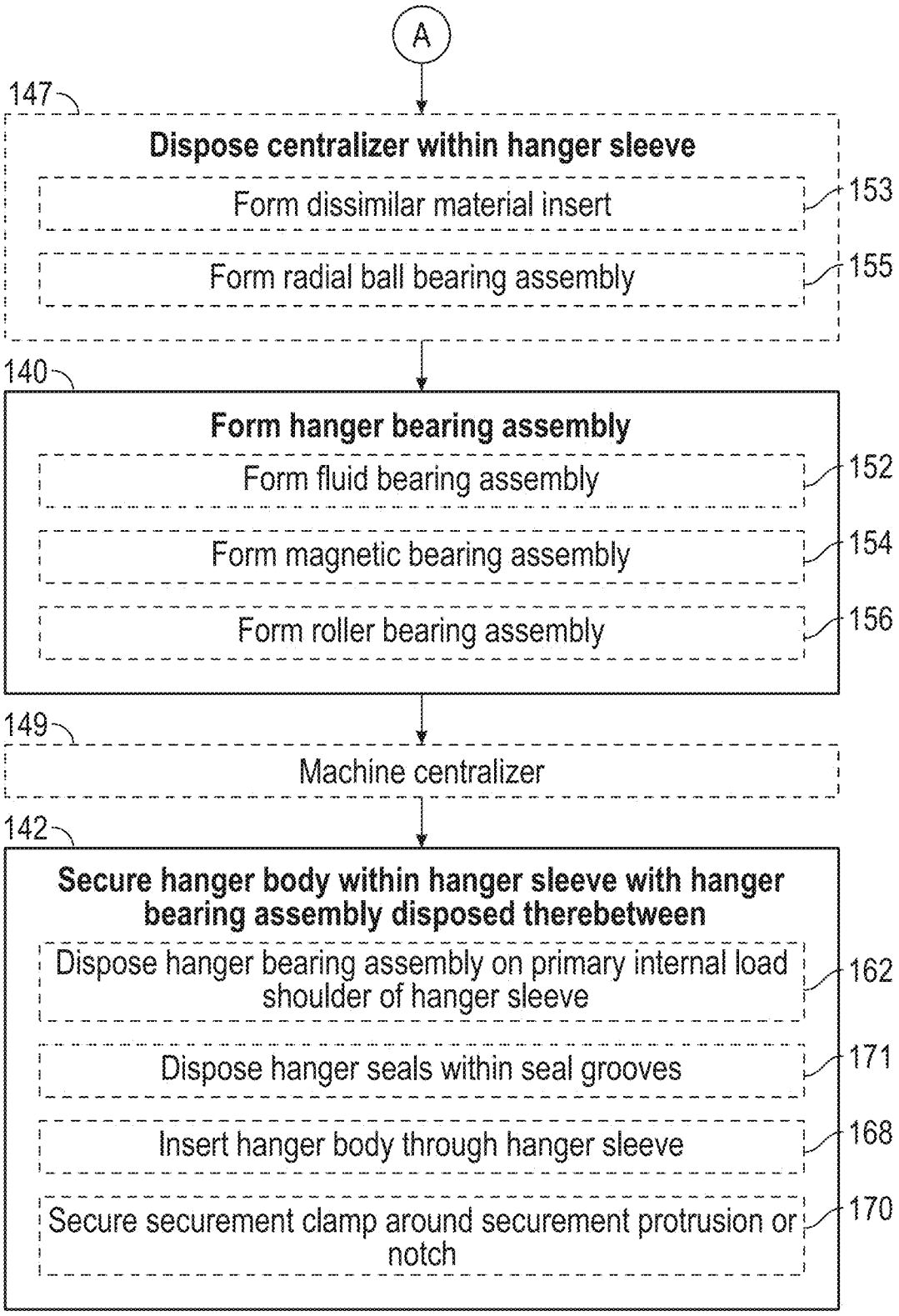

To help further illustrate, an example of a process 134 for implementing (e.g., manufacturing) a rotatable casing hanger 66 is described in FIG. 10. Generally, the process 134 includes forming a hanger body (process block 136) and forming a hanger sleeve (process block 138). Additionally, the process 134 generally includes forming a hanger bearing assembly (process block 140) and securing the hanger body within the hanger sleeve with the hanger bearing assembly disposed therebetween (process block 142).

However, it should be appreciated that the example process 134 is merely intended to be illustrative and not limiting. In particular, in other embodiments, the process 134 may perform the depicted process blocks in a different order. Additionally or alternatively, in other embodiments, the process 134 may include one or more additional process blocks and/or omit one or more of the depicted process blocks. For example, in some embodiments, the process 134 may additionally include disposing a centralizer within the hanger sleeve (process block 147) and/or machining the centralizer (process block 149).

In any case, as described above, a rotatable casing hanger 66 generally includes a hanger body 80. Accordingly, implementing a rotatable casing hanger 66 generally includes forming (e.g., milling, molding, casting, and/or forging) a hanger body 80 (process block 136). In particular, in some embodiments, the hanger body 80 of a rotatable casing hanger 66 may be formed from metal, such as carbon steel or stainless steel.

As described above, a rotatable casing hanger 66 generally enables the flow of fluid, such as liquid cement 38D and/or produced fluid, therethrough via a hanger bore 88 defined by its hanger body 80. Accordingly, forming the hanger body 80 of a rotatable casing hanger 66 may include forming the hanger body 80 to define a hanger bore 88 that extends axially therethrough (process block 144).

Additionally, as described above, to facilitate securement to a casing string 20 and, thus, suspension of the casing string 20 within a wellbore 14, a rotatable casing hanger 66 generally includes a casing securement mechanism 90 at a lower end of its hanger body 80. Accordingly, forming the hanger body 80 of a rotatable casing hanger 66 may include forming a casing securement mechanism 90 at a lower end of the hanger body 80 (process block 146). In particular, as described above, in some embodiments, a casing securement mechanism 90 of a rotatable casing hanger 66 may include external threads 92 on its hanger body 80. Accordingly, in such embodiments, forming a casing securement mechanism 90 at a lower end of a hanger body 80 may include forming external threads 92 on an outer surface of the hanger body 80.

Furthermore, as described above, to facilitate selective securement to a running tool 54 and, thus, manipulation (e.g., lifting, lowering, and/or rotation) via the running tool 54, a rotatable casing hanger 66 generally includes a tool securement mechanism 94 at an upper end of its hanger body 80. Accordingly, forming the hanger body 80 of a rotatable casing hanger 66 may include forming a tool securement mechanism 94 at an upper end of the hanger body 80 (process block 148). In particular, as described above, in some embodiments, a tool securement mechanism 94 of a rotatable casing hanger 66 may include internal threads 96 on its the hanger body 80 and/or securement notches 98 along an upper axial end of its hanger body 80. Accordingly, in such embodiments, forming a tool securement mechanism 94 at an upper end of a hanger body 80 may include forming internal threads 96 on an inner surface of the hanger body 80 and/or forming securement notches 98 along an upper axial end of the hanger body 80.

In any case, in addition to a hanger body 80, as described above, to facilitate landing thereof, a rotatable casing hanger 66 generally includes a hanger sleeve 78. Accordingly, implementing a rotatable casing hanger 66 generally includes forming (e.g., milling, molding, casting, and/or forging) a hanger sleeve 78 (process block 138). In particular, in some embodiments, the hanger sleeve 78 of a rotatable casing hanger 66 may be formed from metal, such as carbon steel or stainless steel.

As described above, a rotatable casing hanger 66 generally lands via engagement between a downwardly-facing external landing shoulder 84 on its hanger sleeve 78 and an upwardly-facing internal landing shoulder 86 on another (e.g., outer) wellhead component, such as an annular packoff 32, another casing hanger 26, or wellhead housing (e.g., a casing head or a casing spool) 24. Accordingly, forming the hanger sleeve 78 of a rotatable casing hanger 66 may include forming the hanger sleeve 78 with a downwardly-facing external landing shoulder 84 on its outer surface (process block 150). In particular, in some embodiments, an external landing shoulder 84 on the hanger sleeve 78 of a rotatable casing hanger 66 may be implemented (e.g., sized and/or shaped) to engage an internal landing shoulder 86 on another casing hanger 26 or wellhead housing (e.g., a casing head or a casing spool) 24. However, in other embodiments, an external landing shoulder 84 on the hanger sleeve 78 of a rotatable casing hanger 66 may be implemented (e.g., sized and/or shaped) to engage an internal landing shoulder 86 on an annular packoff 32, which, at least in some instances, may facilitate reducing size and/or weight of the rotatable casing hanger 66 and, thus, improving handling of the rotatable casing hanger 66 and/or reducing implementation (e.g., material and/or manufacturing) cost associated with the rotatable casing hanger 66, for example, due to an inner diameter 33 of the annular packoff 32 being smaller than an inner diameter 35 of another casing hanger 26 and/or an inner diameter 37 of wellhead housing (e.g., a casing head or a casing spool) 24.

To facilitate rotation of its hanger body 80 within its hanger sleeve 78 as well as transfer of axial force therebetween, as described above, a rotatable casing hanger 66 generally includes a hanger bearing assembly 82 disposed axially between the hanger body 80 and the hanger sleeve 78. Accordingly, implementing a rotatable casing hanger 66 generally includes implementing a hanger bearing assembly 82 (process block 140) and securing its hanger body 80 within its hanger sleeve 78 such that the hanger bearing assembly 82 is axially disposed therebetween (process block 142).

In particular, as described above, to facilitate transferring axial force between the hanger body 80 and the hanger sleeve 78 of a rotatable casing hanger 66, the hanger bearing assembly 82 of the rotatable casing hanger 66 may be disposed between an (e.g., primary) upwardly-facing internal load shoulder 112 on the hanger sleeve 78 and a downwardly-facing external load shoulder 110 on the hanger body 80, which axially oppose one another. Accordingly, securing the hanger body 80 of a rotatable casing hanger 66 within the hanger sleeve 78 of the rotatable casing hanger 66 may include disposing the hanger bearing assembly 82 of the rotatable casing hanger 66 on an (e.g., primary) internal load shoulder 112 of the hanger sleeve 78 (process block 162).

Additionally, implementing the hanger body 80 of a rotatable casing hanger 66 may include forming the hanger body 80 with a downwardly-facing external load shoulder 110 on its outer surface (process block 158) while forming the hanger sleeve 78 of the rotatable casing hanger 66 may include forming the hanger sleeve 78 with an (e.g., primary) upwardly-facing internal load shoulder 112 on its inner surface (process block 160). In particular, as described with regard to FIGS. 6 and 8, in some embodiments, the external load shoulder 110 on a hanger body 80 and the internal load shoulder 112 on a corresponding hanger sleeve 78 may be formed such that they will axially overlap and are orthogonal to an axial extent of the rotatable casing hanger 66. Alternatively, as described with regard to FIG. 9, in other embodiments, the external load shoulder 110 on a hanger body 80 and the internal load shoulder 112 on a corresponding hanger sleeve 78 may be formed such that they are complimentarily tapered (e.g., slanted) and, thus, will axially as well as radially overlap.

In any case, as described above, to facilitate improving rotational efficiency while enabling transfer of axial force, the hanger bearing assembly 82 of a rotatable casing hanger 66 generally raises the hanger body 80 of the rotatable casing hanger 66 off of a corresponding hanger sleeve 78 and, thus, bears load, for example, up to tens of thousands of pounds. Accordingly, as described with regard to FIGS. 6 and 8, in some embodiments, to facilitate reducing the amount its hanger body 80 drops relative to its hanger sleeve 78 if its hanger bearing assembly 82 ever were to fail (e.g., crush), which, at least in some instances, reduces disturbance to the remainder of a wellhead 12, in addition to a primary upwardly-facing internal load shoulder 112, a rotatable casing hanger 66 may include a backup upwardly-facing internal load shoulder 114 on its hanger sleeve 78, which axially opposes an external load shoulder 110 on the hanger body 80 and is radially outwardly as well as axially upwardly offset relative to the primary internal load shoulder 112. Thus, in such embodiments, forming the hanger sleeve 78 of a rotatable casing hanger 66 may include forming the hanger sleeve 78 with a backup upwardly-facing internal load shoulder 114 on its inner surface, which is radially outwardly as well as axially upwardly offset relative to a primary internal load shoulder 112 on the hanger sleeve 78 (process block 164).

In any case, as described above, in some embodiments, a hanger bearing assembly 82 of a rotatable casing hanger 66 may be a magnetic bearing assembly and, thus, implementing the hanger bearing assembly 82 may include implementing a magnetic bearing assembly (process block 154). In particular, in some such embodiments, a hanger magnetic bearing assembly 82 of a rotatable casing hanger 66 may include first magnetic material secured to a downwardly-facing external load shoulder 110 on its hanger body 80 and second magnetic material, which has the same polarity as the first magnetic material, secured to an axially opposing, upwardly-facing internal load shoulder 112 on its hanger sleeve 78. Accordingly, in such embodiments, implementing a hanger magnetic bearing assembly 82 of a rotatable casing hanger 66 may include securing first magnetic material to a downwardly-facing external load shoulder 110 on the hanger body 80 of the rotatable casing hanger 66 and securing second magnetic material, which has the same polarity as the first magnetic material, to an axially opposing, upwardly-facing internal load shoulder 112 on the hanger sleeve 78 of the rotatable casing hanger 66.

Additionally, as described with regard to FIGS. 6 and 8, in other embodiments, the hanger bearing assembly 82 of a rotatable casing hanger 66 may be an axial roller bearing assembly and, thus, implementing the hanger bearing assembly 82 may include implementing an axial roller bearing assembly (process block 156). In particular, as described above, a hanger axial roller bearing assembly 82 of a rotatable casing hanger 66 generally includes cylindrically-shaped, circumferentially-spaced, and radially-oriented roller bearings 116. Accordingly, implementing a hanger axial roller bearing assembly 82 of a rotatable casing hanger 66 generally includes forming cylindrically-shaped roller bearings 116, for example, from metal, such as carbon steel and/or stainless steel.

As described above, to facilitate retaining its roller bearings 116 in place, in some embodiments, a hanger axial roller bearing assembly 82A of a rotatable casing hanger 66 may include a ring-shaped roller (e.g., central) plate 118. In particular, as described above, the roller plate 118 may include circumferentially-spaced and radially-oriented roller openings 120 and the roller bearings 116 may each be rotatably secured within a corresponding roller opening 120 such that its circumference extends above and below the roller plate 118. Accordingly, in such embodiments, implementing the hanger axial roller bearing assembly 82A of a rotatable casing hanger 66 may include forming a ring-shaped roller plate 118 with circumferentially-spaced and radially oriented roller openings 120 that extend therethrough (e.g., from metal, such as carbon steel and/or stainless steel) and rotatably securing roller bearings 116 within the roller openings 120 (e.g., via axles) such that the circumference of the roller bearings 116 extends above and below the roller plate 118.

Additionally, as described above, to facilitate improving circumferential load distribution between its roller bearings 116, in some embodiments, a hanger axial roller bearing assembly 82 of a rotatable casing hanger 66 may include a ring-shaped upper contact plate 122, which is disposed above the roller bearing 116, and/or a ring-shaped lower contact plate 124, which is disposed below the roller bearings 116. Accordingly, in such embodiments, implementing the hanger axial roller bearing assembly 82 of a rotatable casing hanger 66 may include forming a ring-shaped upper contact plate 122 (e.g., from metal, such as carbon steel and/or stainless steel) and disposing the upper contact plate 122 above its roller bearings 116. Additionally or alternatively, in such embodiments, implementing the hanger axial roller bearing assembly 82 of a rotatable casing hanger 66 may include forming a ring-shaped lower contact plate 124 (e.g., from metal, such as carbon steel and/or stainless steel) and disposing the lower contact plate 124 below its roller bearings 116.

Furthermore, as described with regard to FIG. 9, in other embodiments, the hanger bearing assembly 82 of a rotatable casing hanger 66 may be a fluid bearing assembly and, thus, implementing the hanger bearing assembly 82 may include implementing a fluid bearing assembly (process block 152). In particular, in such embodiments, a hanger fluid bearing assembly 82 of a rotatable casing hanger 66 may include bearing fluid disposed within a bearing fluid cavity (e.g., gap) 125 defined between an external load shoulder 110 on its hanger body 80 and an opposing internal load shoulder 112 on its hanger sleeve 78. Thus, in such embodiments, implementing a hanger fluid bearing assembly 82 of a rotatable casing hanger 66 may include maintaining a gap between an external load shoulder 110 on the hanger body 80 of the rotatable casing hanger 66 and an opposing internal load shoulder 112 on the hanger sleeve 78 of the rotatable casing hanger 66 to facilitate defining a bearing fluid cavity 125 and filling the bearing fluid cavity 125 with bearing fluid.

In other words, to facilitate implementation and/or operation of a hanger bearing assembly 82, in some embodiments, fluid, such as lubricant and/or bearing fluid, may be supplied to and/or retained at the hanger bearing assembly 82. In particular, as described above, to facilitate supplying fluid to its hanger bearing assembly 82, in some embodiments, a rotatable casing hanger 66 may include a hanger bearing port 126 that extends through its hanger sleeve 78 to the hanger bearing assembly 82. Accordingly, in such embodiments, forming the hanger sleeve 78 of a rotatable casing hanger 66 may include forming a hanger bearing port 126 from an outer surface of the hanger sleeve 78 through the hanger sleeve 78 to an inner surface of the hanger sleeve 78 (process block 165).

Additionally, as described above, to facilitate retaining fluid at its hanger bearing assembly 82, in some embodiments, a rotatable casing hanger 66 may include one or more hanger seals 128, which are radially compressed between its hanger sleeve 78 and its hanger body 80. In particular, as described above, to facilitate retaining a hanger seal 128 in place, in some such embodiments, the hanger seal 128 may be disposed within an external seal groove 131 on the hanger body 80 of a rotatable casing hanger 66 and/or an internal seal groove 132 on the hanger sleeve 78 of the rotatable casing hanger 66. Accordingly, in such embodiments, forming the hanger body 80 of a rotatable casing hanger 66 may include forming the hanger body 80 with an external seal groove 131 on its outer surface (process block 167) and/or forming the hanger sleeve 78 of the rotatable casing hanger 66 may include forming the hanger sleeve 78 with an internal seal groove 132 on its inner surface (process block 169). Additionally, in such embodiments, securing the hanger body 80 of a rotatable casing hanger 66 within a corresponding hanger sleeve 78 may include disposing a hanger seal 128 within an external seal groove 131 on the hanger body 80 and/or an internal seal groove 132 on the hanger sleeve 78 (process block 171).

In particular, as described above, in some embodiments, a hanger seal 128 in a rotatable casing hanger 66 may be a rubber O-ring, for example, when the hanger bearing assembly 82 of the rotatable casing hanger 66 is an axial roller bearing assembly. Accordingly, in such embodiments, forming a hanger seal 128 of a rotatable casing hanger 66 may include forming rubber into a torus shape. However, as described above, to facilitate providing sealing during rotation, in other embodiments, a hanger seal 128 of a rotatable casing hanger 66 may be formed from a different material, such as plastic or even metal. Additionally or alternatively, as described above, to facilitate providing sealing during rotation, in other embodiments, a hanger seal 128 of a rotatable casing hanger 66 may be formed with a different cross-sectional shape, such as rectangular shape or a trapezoidal shape. For example, to facilitate providing improved sealing integrity during rotation, in some embodiments, a hanger seal 128 used with a hanger fluid bearing assembly 82 may be a T-seal and, thus, forming a hanger seal 128 of a rotatable casing hanger 66 may include forming elastomer (e.g., rubber) and plastic into a ring shape such that the plastic reinforces the elastomer.

In any case, as described with regard to FIGS. 8 and 9, to facilitate maintaining its hanger body 80 appropriately centralized within its hanger sleeve 78 (e.g., blocking wobbling without inadvertently increasing rotational resistance), in some embodiments, a rotatable casing hanger 66 may additionally include one or more centralizers 127 that are each radially and circumferentially disposed between its hanger body 80 and its hanger sleeve 78. In particular, as described above, to facilitate disposing a centralizer 127 radially and circumferentially between a hanger body 80 and a hanger sleeve, in some embodiments, the centralizer 127 may be disposed within a centralizer notch 129 on an inner surface of the hanger sleeve 78. Accordingly, in such embodiments, forming the hanger sleeve 78 of a rotatable casing hanger 66 may include forming the hanger sleeve 78 with a centralizer notch 129 on its inner surface, for example, at an upper end or a lower end of the hanger sleeve 78 (process block 151).

Additionally, in such embodiments, implementing a rotatable casing hanger 66 may include disposing a centralizer 127 within a corresponding centralizer notch 129 in its hanger sleeve 78 (process block 147). In particular, as described above, to facilitate retaining a centralizer 127 in place, in some embodiments, the centralizer 127 may be secured within a corresponding centralizer notch 129 using adhesive, such as glue. Nevertheless, as described above, in other embodiments, a centralizer 127 in a rotatable casing hanger 66 may be retained within a corresponding centralizer notch 129 using a securement clamp 102 and/or gravity.

In any case, as described with regard to FIG. 8, to facilitate blocking a hanger body 80 from directly abutting a corresponding hanger sleeve 78 and, thus, like materials from rubbing against one another, in some embodiments, a centralizer 127 in a rotatable casing hanger 66 may be a dissimilar material insert, which is a different material as compared to the hanger body 80 and/or the hanger sleeve 78. Accordingly, in such embodiments, implementing a centralizer 127 of a rotatable casing hanger 66 may include forming the centralizer (e.g., bushing and/or ring) 127 using a different material as compared to the hanger body 80 and/or the hanger sleeve 78 of the rotatable casing hanger 66 (process block 153). For example, the centralizer 127 may be formed from bronze when the hanger body 80 and/or the hanger sleeve 78 are formed from steel.

However, as described with regard to FIG. 9, to facilitate maintaining a hanger body 80 appropriately centralized within a hanger sleeve 78 while further reducing rotational resistance, in other embodiments, a centralizer 127 in a rotatable casing hanger 66 may be a radial ball bearing assembly. In particular, as described above, in some embodiments, a radial ball bearing centralizer 127 may include an outer housing 137, which contacts an inner surface of a hanger sleeve 78, an inner housing 139, which contacts an outer surface of a hanger body 80, and ball bearings 141, which are disposed radially and circumferentially between the outer housing 137 and the inner housing 139. Accordingly, in such embodiments, implementing a radial ball bearing centralizer 127 of a rotatable casing hanger 66 may include forming spherically-shaped ball bearings 141 (e.g., from metal, such as carbon steel and/or stainless steel), forming an outer housing (e.g., ring) 137 (e.g., from metal, such as carbon steel and/or stainless steel), forming an inner housing (e.g., ring) 139 (e.g., from metal, such as carbon steel and/or stainless steel), and disposing the ball bearings 141 radially and circumferentially between the inner housing 139 and the outer housing 137 (process block 155).

In any case, as described above, to facilitate appropriate centralization (e.g., block wobbling without inadvertently increasing rotational resistance), at least in some instances, sizing of a centralizer 127 in a rotatable casing hanger 66 may be highly dependent on sizing of its hanger body 80 and/or its hanger sleeve 78 and, thus, tolerances of the centralizer 127 may be tight. As described above, to facilitate achieving tight tolerances for a specific hanger body 80 and a specific hanger sleeve 78, in some embodiments, a centralizer 127 may be disposed within a corresponding centralizer notch 129 in the hanger sleeve 78 before a resulting inner diameter 133 of the centralizer 127 is machined based on (e.g., slightly smaller than) an adjacent inner diameter 106 of the hanger sleeve 78 and/or based on (e.g., slightly larger than) an opposing outer diameter 135 of the hanger body 80. In other words, in such embodiments, implementing a rotatable casing hanger 66 may include machining a resulting protruding diameter of a centralizer 127 after the centralizer 127 is disposed within a corresponding centralizer notch 129 (process block 149). Nevertheless, in other embodiments, a centralizer 127 may be appropriately machined for a corresponding (e.g., specific) hanger sleeve 78 and/or a corresponding (e.g., specific) hanger body 80 before being deployed in a corresponding centralizer notch 129.

In any case, as described above, the hanger body 80 of a rotatable casing hanger 66 may be secured to a corresponding hanger sleeve 78 such that the hanger body 80 extends through the hanger sleeve 78. In particular, as described with regard to FIG. 6, to facilitate securing its hanger sleeve 78 to its hanger body 80, in some embodiments, a rotatable casing hanger 66 may include a securement protrusion 100 on its hanger body 80, which is adjacent to a lower end of its hanger sleeve 78 and has an outer diameter 104 that is smaller than an inner diameter 106 of its hanger sleeve 78, and a securement clamp (e.g., clip) 102, which is secured around the securement protrusion 100 on the hanger body 80 and has an outer diameter 108 that is larger than the inner diameter 106 of its hanger sleeve 78. Accordingly, in such embodiments, forming the hanger body 80 of a rotatable casing hanger 66 may including forming the hanger body 80 with a securement protrusion 100 on its outer surface, for example, directly adjacent to (e.g., below) where a lower end of the hanger sleeve 78 of the rotatable casing hanger 66 is expected to be located (process block 166).

However, as described with regard to FIG. 8, to facilitate securing its hanger sleeve 78 to its hanger body 80, in some embodiments, a rotatable casing hanger 66 may include a securement notch 101 on its hanger body 80, which is adjacent to a lower end of its hanger sleeve 78, and a securement clamp (e.g., clip) 102, which is secured around (e.g., on and/or within) the securement notch 101 on the hanger body 80 and has an outer diameter 108 that is larger than the inner diameter 106 of the hanger sleeve 78. Accordingly, in such embodiments, forming the hanger body 80 of a rotatable casing hanger 66 may include forming the hanger body 80 with a securement notch 101 on its outer surface, for example, directly adjacent to (e.g., below) where a lower end of the hanger sleeve 78 of the rotatable casing hanger 66 is expected to be located (process block 157).

In any case, as described above, in such embodiments, securing the hanger body 80 of a rotatable casing hanger 66 within a corresponding hanger sleeve 78 may include inserting the hanger body 80 through the hanger sleeve 78, for example, until a securement protrusion 100 or a securement notch 101 on the hanger body 80 passes a lower end of the hanger sleeve 78 and/or a downwardly-facing external load shoulder 110 on the hanger body 80 directly abuts a corresponding hanger bearing assembly 82 (process block 168) and securing a securement clamp (e.g., clip) 102 around the securement protrusion 100 or the securement notch 101 on the hanger body 80, for example, directly adjacent to the lower end of the hanger sleeve 78 (process block 170). In other words, the hanger sleeve 78 of a rotatable casing hanger 66 may be secured circumferentially around the hanger body 80 of the rotatable casing hanger 66.

Accordingly, as described above, to facilitate insertion of a rotatable casing hanger 66, in some embodiments, the hanger sleeve 78 of the rotatable casing hanger 66 may have a tapered lower end. Thus, in such embodiments, forming the hanger sleeve 78 of a rotatable casing hanger 66 may include forming the hanger sleeve 78 with a tapered lower end (process block 172).

Additionally, as described above, to enable the flow of fluid, such as liquid cement 38D, drilling mud, and/or water, therearound, in some embodiments, a rotatable casing hanger 66 may include one or more fluid circulation pathways 89 that extend through its hanger sleeve 78. Accordingly, in such embodiments, forming the hanger sleeve 78 of a rotatable casing hanger 66 may include forming the hanger sleeve 78 to include one or more fluid circulation pathways 89 that extend therethrough (process block 174). In particular, as described above, in some such embodiments, fluid circulation pathways 89 through a rotatable casing hanger 66 may be defined by hanger flutes 87 formed along an outer surface of its hanger sleeve 78.

In this manner, a rotatable casing hanger 66, which facilitates rotation of a corresponding casing string 20 in a well system 10 while landed and, thus, improving the integrity (e.g., uniformity) of cement 38 formed in an annular space 34 surrounding the casing string 20, may be implemented (e.g., manufactured). As described above, to facilitate manipulating (e.g., lifting, lowering, and/or rotating) a casing hanger 26, such as a rotatable casing hanger 66, and, thus, a corresponding casing string 20, in some embodiments, a well system 10 may include a rotatable running tool 64. In particular, as in the example depicted in FIG. 5, to facilitate maintaining centralization and, thus, reducing radial force exerted on a casing hanger 26, a rotatable running tool 64 generally includes a tool body 176, which has an upper end secured to a landing joint 56 and a lower end secured to the casing hanger 26, a tool sleeve 178, which is secured circumferentially around the tool body 176, and a tool bearing assembly 180, which is disposed between the tool body 176 and the tool sleeve 178 to facilitate rotating the tool body 176 relative to (e.g., within) the tool sleeve 178.

Figure 11:
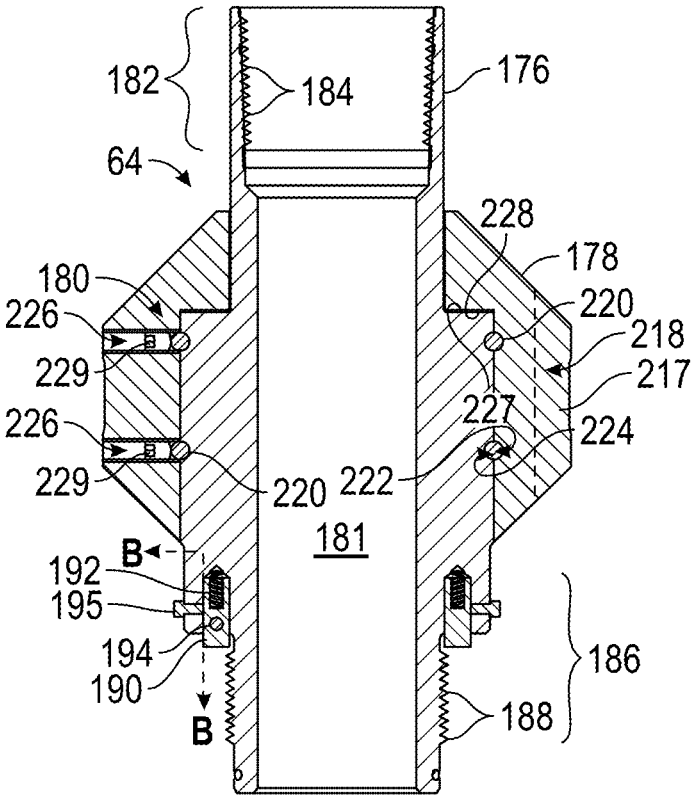
FIG. 11 is a more detailed cross-sectional view of an example of the rotatable running tool of FIG. 5, in accordance with an embodiment of the present disclosure.

To help more clearly illustrate, a more detailed example of a rotatable running tool 64 that may be used in a well system 10 is shown in FIG. 11. As depicted, the rotatable running tool 64 generally includes a tool body 176, a tool sleeve 178, and a tool bearing assembly 180. In particular, to facilitate supplying fluid, such as liquid cement 38D or drilling mud, to a hanger bore 88 of a corresponding casing hanger 26 and, thus, a casing bore 31 of a corresponding casing string 20, as depicted, the tool body 176 generally defines a tool bore 181 that extends axially through the rotatable running tool 64.

Additionally, to facilitate securement of a landing joint 56 to a rotatable running tool 64 and, thus, manipulation (e.g., lifting, lowering, and/or rotation) of the rotatable running tool 64 via the landing joint 56, an upper end of the tool body 176 of the rotatable running tool 64 generally includes a landing joint securement mechanism 182. In particular, in the depicted example, the landing joint securement mechanism 182 includes internal threads 184 on an inner surface of the tool body 176.

However, it should be appreciated that the depicted example is merely intended to be illustrative and not limiting. In particular, in other embodiments, a rotatable running tool 64 may include a different type of landing joint securement mechanism 182, for example, which includes external threads on an outer surface of its tool body 176.

In any case, to facilitate securement of a rotatable running tool 64 to a casing hanger 26 and, thus, manipulation of the casing hanger 26 via the rotatable running tool 64, a lower end of the tool body 176 of the rotatable running tool 64 generally includes a hanger securement mechanism 186, which engages a tool securement mechanism 94 on the casing hanger 26. In particular, in the depicted example, the hanger securement mechanism 186 includes external threads 188 on an outer surface of the tool body 176, for example, which matingly interlock with internal threads 96 on a casing hanger 26. Additionally, to facilitate blocking overtightening of the rotatable running tool 64 on a casing hanger 26, in the depicted example, the hanger securement mechanism 186 includes securement tabs 190 as well as corresponding activation springs 192 and activation fasteners 195, which selectively control axial extension of the securement tabs 190 out from the tool body 176 and, thus, engagement of the securement tabs 190 with securement notches 98 on the casing hanger 26, for example, in addition to a retention fastener 194, which facilitates retaining the securement tabs 190 with the remainder of the tool body 176.

Figure 12:
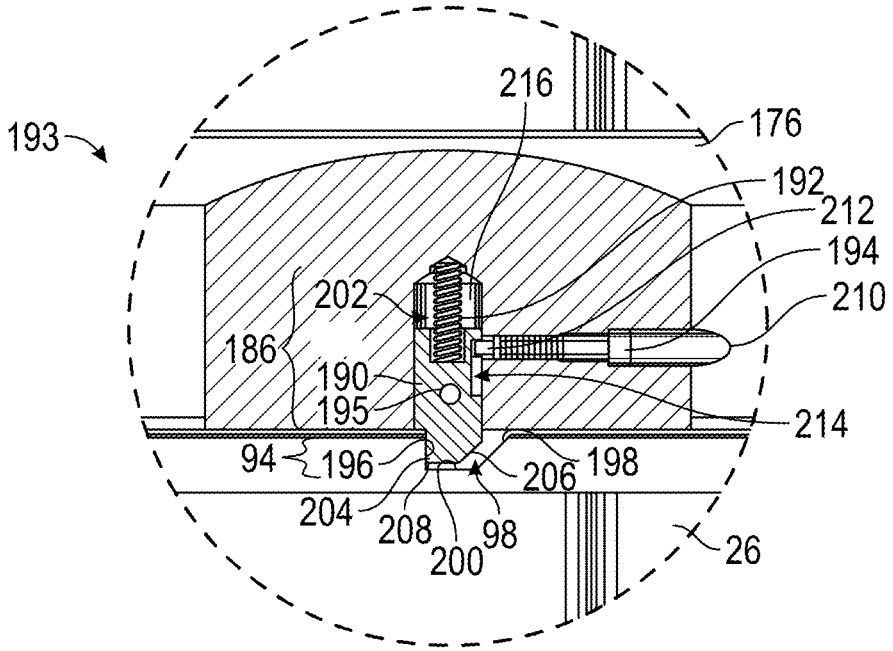
FIG. 12 is a partial cross-sectional view of an example of an interface between the rotatable running tool of FIG. 11 and a casing hanger, in accordance with an embodiment of the present disclosure.

To help more clearly illustrate, an example of an interface 193 between a hanger securement mechanism 186 on a tool body 176 of a rotatable running tool 64 and a tool securement mechanism 94 of a casing hanger 26, such as a rotatable casing hanger 66, is shown in FIG. 12. Similar to the tool securement mechanism 94 of FIG. 6, the tool securement mechanism 94 of FIG. 12 includes a securement notch 98 at an upper axial end of the casing hanger 26. In particular, in the depicted example, the securement notch 98 includes a vertical sidewall 196, a slanted sidewall 198, and a horizontal base wall 200, which connects the vertical sidewall 196 and the slanted sidewall 198.

Additionally, although obfuscated from view, similar to the tool securement mechanism 94 of FIG. 6, the tool securement mechanism 94 of FIG. 12 includes internal threads 96 on an inner surface of the casing hanger 26. Furthermore, although obfuscated from view, similar to the hanger securement mechanism 186 of FIG. 11, the hanger securement mechanism 186 of FIG. 12 includes external threads 188 on an outer surface of the tool body 176. In other words, the tool body 176 of the rotatable running tool 64 may be secured to the casing hanger 26 at least in part by rotating the tool body 176 in a first (e.g., right) direction relative to the casing hanger 26 and disconnected (e.g., unsecured) from the casing hanger 26 at least in part by rotating the tool body 176 in a second (e.g., left and/or opposite) direction relative to the casing hanger 26.

As depicted, the hanger securement mechanism 186 of the rotatable running tool 64 additionally includes a securement tab 190, an activation spring 192, an activation fastener 195, and a retention fastener 194. In particular, in the depicted example, the securement tab 190 is disposed within a tab cavity 202 in the tool body 176 and the activation spring 192 is disposed within the tab cavity 202 between the securement tab 190 and a closed end of the tab cavity 202 and, thus, the tool body 176. Accordingly, the activation spring 192 may urge the securement tab 190 from a withdrawn state in which a lower end of the securement tab 190 is withdrawn into the tab cavity toward an extended state in which the lower end of the securement tab 190 extends axially out of the tab cavity 202 and, thus, out of the tool body 176 to enable the securement tab 190 to matingly interlock with the securement notch 98 on the casing hanger 26.

In other words, as in the depicted example, the shape of a securement tab 190 on the tool body 176 of a rotatable running tool 64 may generally correspond to the shape of a securement notch 98 on a corresponding casing hanger 26. In particular, in the depicted example, the securement tab 190 includes a vertical edge 204, which opposes the vertical sidewall 196 of the securement notch 98, a slanted edge 206, which opposes the slanted sidewall 198 of the securement notch 98, and a horizontal lower edge 208, which connects the vertical edge 204 and the slanted edge 206 of the securement tab 190 and opposes the horizontal base wall 200 of the securement notch 98. Accordingly, when the securement tab 190 is disposed within the securement notch 98, engagement between the vertical edge 204 of the securement tab 190 and the vertical sidewall 196 of the securement notch 98 may block the tool body 176 of the rotatable running tool 64 from rotating in a first (e.g., right) direction relative to the casing hanger 26 while engagement between the slanted edge 206 of the securement tab 190 and the slanted sidewall 198 of the securement notch 98 may enable the tool body 176 to rotate in a second (e.g., left and/or opposite) direction relative to the casing hanger 26. In other words, when matingly interlocked with the securement notch 98, the securement tab 190 may block the rotatable running tool 64 from further being tightened and, thus, overtightened on the casing hanger 26—particularly when the rotatable running tool 64 is used to rotate the casing hanger 26, for example, while a corresponding casing string 20 is being cemented within a wellbore 14—while still enabling the rotatable running tool 64 to be disconnected from the casing hanger 26 and withdrawn from the wellbore 14, for example, after the casing string 20 is cemented within the wellbore 14.

Accordingly, as in the depicted example, to enable the tool body 176 of a rotatable running tool 64 to be tightened on and, thus, secured to a casing hanger 26, an activation fastener 195 may be used to control extension of a corresponding securement tab 190 from the tool body 176. In particular, in the depicted example, the activation fastener 195 is disposed within an activation fastener opening in the tool body 176, which is perpendicular to and connected to the tab cavity 202, such that a tip of the activation fastener 195 extends into the tab cavity 202.

As such, to enable the tool body 176 to be tightened on the casing hanger 26, the securement tab 190 may be pushed into the tab cavity 202 and the activation fastener 195 may be tightened against the securement tab 190 to hold the securement tab 190 in a withdrawn state. Additionally, to facilitate retaining the securement tab 190 with the tool body 176 while the securement tab 190 is in its extended state, in the depicted example, a tip 212 of the retention fastener 194 is disposed within a retention notch 214 along an edge of the securement tab 190 such that the tip 212 of the retention fastener 194 engages a retention lip 216 at an upper end of the securement tab 190 while the securement tab 190 is in its extended state.

However, it should be appreciated that the depicted example is merely intended to be illustrative and not limiting. In particular, in other embodiments, a hanger securement mechanism 186 of a rotatable running tool 64 may not include a retention fastener 194, for example, when a tip of a corresponding activation fastener 195 is disposed within a retention notch 214 on a corresponding securement tab 190. Additionally or alternatively, in other embodiments, a securement tab 190 in a rotatable running tool 64 may not include a retention notch 214, for example, when a corresponding activation fastener 195 is retightened against the securement tab 190 after the securement tab 190 transitions from its withdrawn state to its extended state.

In any case, after the tool body 176 of the rotatable running tool 64 is sufficiently tightened on the casing hanger 26, to block further tightening, the activation fastener 195 may be loosened from the securement tab 190 to enable the activation spring 192 to transition the securement tab 190 from its withdrawn state to its extended state. To enable the securement tab 190 to matingly interlock with the securement notch 98 on the casing hanger 26, in some embodiments, the tool body 176 may be slightly loosened from the casing hanger 26. In other words, in such embodiments, the tool body 176 of a rotatable running tool 64 may be secured to a casing hanger 26 at least in part by rotating the tool body 176 in a first (e.g., right) direction relative to the casing hanger 26 to tighten the tool body 176 on the casing hanger 26 before enabling a securement tab 190 of the rotatable running tool 64 to transition from its withdrawn state to its extended state by loosening a corresponding activation fastener 195 and rotating the tool body 176 in a second (e.g., left and/or opposite) direction relative to the casing hanger 26 to matingly interlock the securement tab 190 with a securement notch 98 on the casing hanger 26.

However, it should again be appreciated that the depicted example is merely intended to be illustrative and not limiting. In particular, in other embodiments, a rotatable running tool 64 may include a different type of hanger securement mechanism 186, for example, which does not include a securement tab 190 and/or includes internal threaded on an inner surface of its tool body 176. Additionally or alternatively, in other embodiments, an interface between a landing joint 56 and a landing joint securement mechanism 182 of a rotatable running tool 64 may utilize a securement tab 190 and a securement notch 98 in an analogous manner, for example, to facilitate blocking overtightening of the landing joint 56 on the rotatable running tool 64—particularly when the landing joint 56 is used to rotate the rotatable running tool 64, for example, while a casing string 20 is being cemented within a wellbore 14.

In any case, returning to the rotatable running tool 64 of FIG. 11, as depicted, the tool sleeve 178 is secured circumferentially around the tool body 176 such that the tool body 176 extends through the tool sleeve 178. In particular, since secured circumferentially around the tool body 176, the tool sleeve 178 may facilitate maintaining centralization of the tool body 176 and, thus, a casing hanger 26 secured to the tool body 176, which at least in some instances, may facilitate reducing likelihood of the casing hanger 26 and/or a corresponding casing string damaging (e.g., scoring and/or galling) surrounding wellhead components-particularly during rotation. Additionally, maintaining centralization of a rotatable casing hanger 66 may facilitate reducing radial force exerted on its hanger bearing assembly 82, which, at least in some instances, may facilitate improving lifespan of the hanger bearing assembly 82 and, thus, the rotatable casing hanger 66, for example, due to the hanger bearing assembly 82 being rated primarily to accommodate axial force but minimal radial force.

Since secured circumferentially around the tool body 176 of a rotatable running tool 64, as in the depicted example, to facilitate insertion of the rotatable running tool 64, in some embodiments, the tool sleeve 178 of the rotatable running tool 64 may have a tapered lower end. Furthermore, as in the depicted example, to facilitate withdrawal of a rotatable running tool 64, in some embodiments, the tool sleeve 178 of the rotatable running tool 64 may have a tapered upper end. Moreover, as in the depicted example, to enable circulation of fluid, such as liquid cement 38D, drilling mud, and/or water, therearound, in some embodiments, the rotatable running tool 64 may include tool flutes 217 that define fluid circulation pathways 218 along its outer surface.

However, it should again be appreciated that the depicted example is merely intended to be illustrative and not limiting. In particular, to enable circulation of fluid past a rotatable running tool 64, in other embodiments, the rotatable running tool 64 may include fluid circulation pathways 218 that otherwise extend through its tool sleeve 178 and/or its tool body 176. Additionally or alternatively, in other embodiments, the tool sleeve 178 of a rotatable running tool 64 may not have a tapered lower end and/or a tapered upper end.

In any case, in the depicted example, to facilitate rotating the tool body 176 relative to the tool sleeve 178, the tool bearing assembly 180 is disposed radially between the tool body 176 and the tool sleeve 178. In particular, in the depicted example, the tool bearing assembly 180 includes spherically-shaped ball bearings 220, which are disposed within external bearing grooves 222 on an outer surface of the tool body 176 as well as corresponding (e.g., radially-aligned) internal bearing grooves 224 on an inner surface of the tool sleeve 178. Accordingly, once disposed within a radially-aligned external bearing groove 222 on the tool body 176 and a radially-aligned internal bearing groove 224 on the tool sleeve 178, a ball bearing 220 may facilitate improving rotational efficiency of the tool body 176 as well as securement of the tool sleeve 178 to the tool body 176.

As in the depicted example, to facilitate radial alignment of an external bearing groove 222 on its tool body 176 with an internal bearing groove 224 on its tool sleeve 178, in some embodiments, a rotatable running tool 64 may include an upwardly-facing external alignment shoulder 227 on an outer surface of the tool body 176 and a downwardly-facing internal alignment shoulder 228 on an inner surface of the tool sleeve 178, which axially opposes the external alignment shoulder 227 on the tool body 176. Additionally, as in the depicted example, to facilitate disposing a ball bearing 220 within an external bearing groove 222 on its tool body 176 and a corresponding (e.g., radially-aligned) internal bearing groove 224 on its tool sleeve 178, in some embodiments, a rotatable running tool 64 may include a tool bearing port 226 that extends from an outer surface of the tool sleeve 178 through the tool sleeve 178 to an inner surface of the tool sleeve 178 and, thus, the internal bearing groove 224 and the external bearing groove 222. Furthermore, as in the depicted example, to facilitate retaining a ball bearing 220 within an external bearing groove 222 on its tool body 176 and a corresponding internal bearing groove 224 on its tool sleeve 178, in some embodiments, a rotatable running tool 64 may include a bearing plug 229 that is disposed within a corresponding tool bearing port 226 after the ball bearing 220 to plug the tool bearing port 226 behind the ball bearing 220.

However, it should again be appreciated that the depicted example is merely intended to be illustrative and not limiting. In particular, in other embodiments, the tool bearing assembly 180 of a rotatable running tool 64 may be disposed axially between the tool body 176 and the tool sleeve 178 of the rotatable running tool 64. Additionally, in other embodiments, a rotatable running tool 64 may include a single internal bearing groove 224 on its tool sleeve 178 and a single external bearing groove 222 on its tool body 176 or more than two (e.g., three, four, or more) internal bearing grooves 224 on its tool sleeve 178 and more than two (e.g., three, four, or more) external bearing grooves 222 on its tool body 176. Furthermore, in other embodiments, a rotatable running tool 64 may not include an external alignment shoulder 227 on its tool body 176 and/or may not include an internal alignment shoulder 228 on its tool sleeve 178. In any case, in this manner, a rotatable running tool 64 may facilitate manipulating (e.g., lifting, lowering, and/or rotating) a casing hanger 26 and, thus, a corresponding casing string 20 while maintaining centralization, which, at least in some instances, may facilitate improving lifespan of the casing hanger 26 and/or improving the integrity (e.g., uniformity) of cement 38 formed in an annular space 34 surrounding the casing string 20 and, thus, improving effectiveness of (e.g., structural support and/or fluid isolation provided by) the casing string 20.

Figure 13:
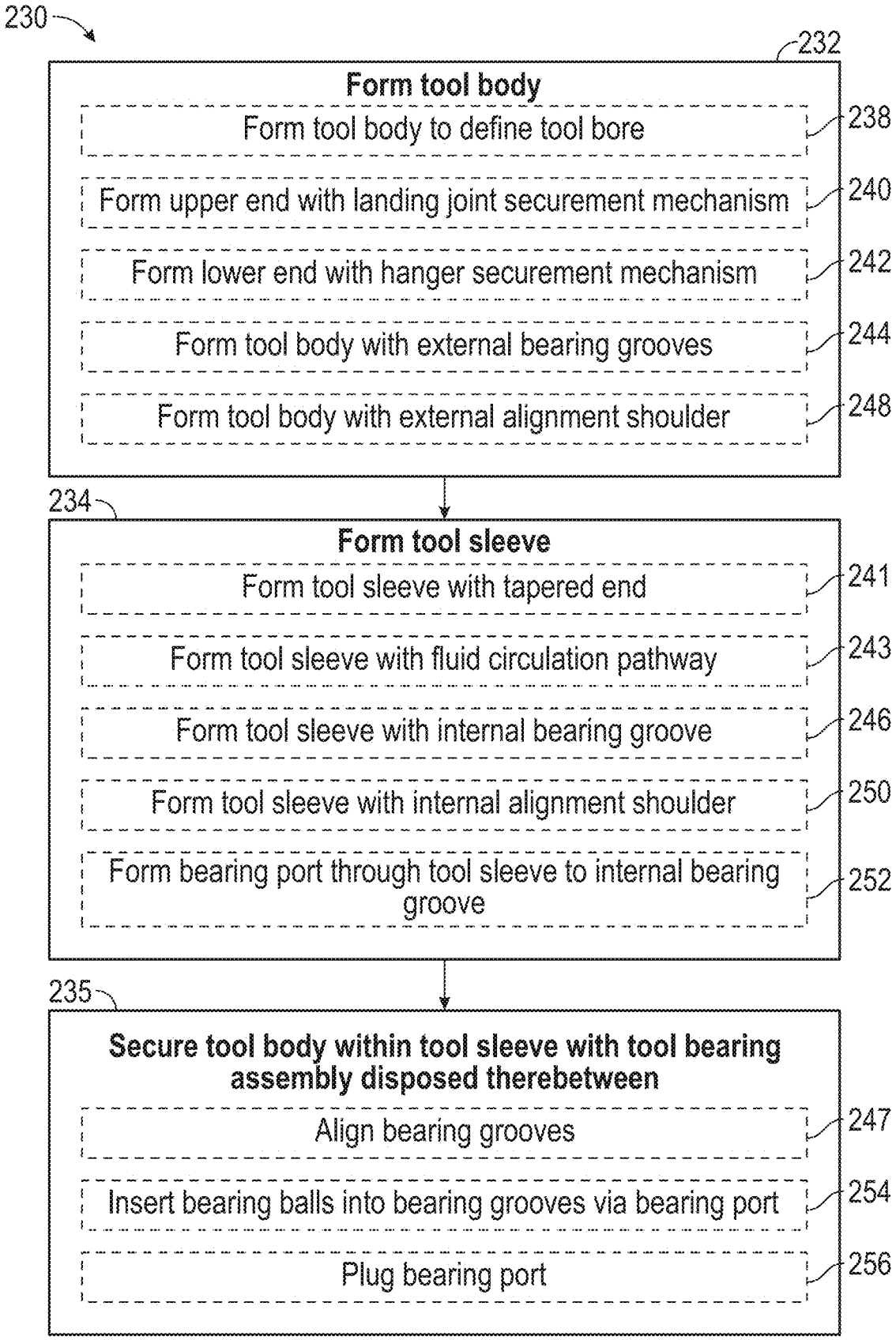
FIG. 13 is a flow diagram of an example of a process for implementing (e.g., manufacturing) a rotatable running tool, in accordance with an embodiment of the present disclosure.

To help further illustrate, an example of a process 230 for implementing (e.g., manufacturing) a rotatable running tool 64 is described in FIG. 13. Generally, the process 230 includes forming a tool body (process block 232) and forming a tool sleeve (process block 234). Additionally, the process 230 generally includes securing the tool body within the tool sleeve (process block 235).

However, it should be appreciated that the example process 230 is merely intended to be illustrative and not limiting. In particular, in other embodiments, the process 230 may perform the depicted process blocks in a different order. Additionally or alternatively, in other embodiments, the process 230 may include one or more additional process blocks and/or omit one or more of the depicted process blocks.

In any case, as described above, a rotatable running tool 64 generally includes a tool body 176. Accordingly, implementing a rotatable running tool 64 generally includes forming (e.g., milling, molding, casting, and/or forging) a tool body 176 (process block 232). In particular, in some embodiments, the tool body 176 of a rotatable running tool 64 may be formed from metal, such as carbon steel or stainless steel.

As described above, a rotatable running tool 64 generally enables the flow of fluid, such as liquid cement 38D, drilling mud, and/or produced fluid, therethrough via a tool bore 181 defined by its tool body 176. Accordingly, forming the tool body 176 of a rotatable running tool 64 may include forming the tool body 176 to define a tool bore 181 that extends axially therethrough (process block 238).

Additionally, as described above, to facilitate selective securement to a landing joint 56 and, thus, manipulation (e.g., lifting, lowering, and/or rotation) via the landing joint 56, a rotatable running tool 64 generally includes a landing joint securement mechanism 182 at an upper end of its tool body 176. Accordingly, forming the tool body 176 of a rotatable running tool 64 may include forming a landing joint securement mechanism 182 at an upper end of the tool body 176 (process block 240). In particular, as described above, in some embodiments, a landing joint securement mechanism 182 on a tool body 176 may include internal threads 184 on an inner surface of the tool body 176. Accordingly, in such embodiments, forming a landing joint securement mechanism 182 at an upper end of a tool body 176 may include forming internal threads 184 on an inner surface of the tool body 176.

Furthermore, as described above, to facilitate selective securement to a casing hanger 26 and, thus, manipulation (e.g., lifting, lowering, and/or rotation) of the casing hanger 26, a rotatable running tool 64 generally includes a hanger securement mechanism 186 at a lower end of its tool body 176. Accordingly, forming the tool body 176 of a rotatable running tool 64 may include forming a hanger securement mechanism 186 at a lower end of the tool body 176 (process block 242). In particular, as described above, in some embodiments, the hanger securement mechanism 186 of a rotatable running tool 64 may include external threads 188 on an outer surface of the tool body 176. Accordingly, in such embodiments, forming a hanger securement mechanism 186 at a lower end of a tool body 176 may include forming external threads 188 on an outer surface of the tool body 176.

As described above, to facilitate blocking overtightening of a rotatable running tool 64 on a casing hanger 26—particularly when the rotatable running tool 64 is used to rotate the casing hanger 26, in some embodiments, the hanger securement mechanism 186 of the rotatable running tool 64 may additionally include a securement tab 190, which is disposed within a tab cavity 202 in the tool body 176 of the rotatable running tool 64, and, to facilitate controlling extension of a lower end of the securement tab 190 out from the tool body 176 and, thus, engagement (e.g., interlocking) of the securement tab 190 with a securement notch 98 on the casing hanger 26, an activation spring 192, which is axially disposed within the tab cavity 202 between the securement tab 190 and a closed end of the tab cavity 202, and an activation fastener 195, which is disposed within an activation fastener opening in the tool body 176 such that a tip of the activation fastener 195 is selectively extendable perpendicularly into the tab cavity 202, for example, in addition to a retention fastener 194, which is disposed within a retention fastener opening 210 such that a tip 212 of the retention fastener 194 is selectively extendable perpendicularly into the tab cavity 202.

Accordingly, in such embodiments, forming the hanger securement mechanism 186 of a rotatable running tool 64 may include forming a tab cavity 202 in the tool body 176 of the rotatable running tool 64 such that the tab cavity 202 extends axially upward into the tool body 176 and forming a activation fastener opening in the tool body 176 such that the activation fastener opening is perpendicular and connected to the tab cavity 202, for example, in addition to forming a retention fastener opening 210 in the tool body 176 such that the retention fastener opening 210 is perpendicular and connected to the tab cavity 202. Additionally, in such embodiments, forming the hanger securement mechanism 186 of the rotatable running tool 64 may include disposing an activation spring 192 within the tab cavity 202, disposing a securement tab 190 in the tab cavity 202 behind the activation spring 192, and disposing an activation fastener 195 in the activation fastener opening, for example, in addition to disposing a retention fastener 194 in the retention fastener opening 210 such that a tip 212 of the retention fastener 194 extends into the tab cavity 202.

In particular, as described above, to facilitate blocking overtightening of a rotatable running tool 64 on a casing hanger 26 while enabling the rotatable running tool 64 to be selectively disconnected from the casing hanger 26, in some such embodiments, a securement notch 98 on the casing hanger 26 may include a vertical sidewall 196, a slanted sidewall 198, and a horizontal base wall 200, which connects the vertical sidewall 196 and the slanted sidewall 198, while a securement tab 190 of the rotatable running tool 64 may include a vertical edge 204, which opposes the vertical sidewall 196 of the securement notch 98, a slanted edge 206, which opposes the slanted sidewall 198 of the securement notch 98, and a horizontal lower edge 208, which opposes the horizontal base wall 200 of the securement notch 98 and connects the vertical edge 204 and the slanted edge 206.

Accordingly, in such embodiments, forming a tool securement mechanism 94 at an upper end of a hanger body 80 may include forming a securement notch 98 at an upper axial end of the hanger body 80 such that the securement notch 98 has a vertical sidewall 196, a slanted sidewall 198, and a horizontal base wall 200, which connects the vertical sidewall 196 and the slanted sidewall 198. Additionally, in such embodiments, forming a hanger securement mechanism 186 at a lower end of a tool body 176 may include forming a securement tab 190 such that the securement tab 190 has a vertical edge 204, which is formed to oppose a vertical sidewall 196 of a corresponding securement notch 98, a slanted edge 206, which is formed to oppose a slanted sidewall 198 of the securement notch 98, and a horizontal lower edge 208, which is formed to oppose a horizontal base wall 200 of the securement notch 98 and to connect the vertical edge 204 and the slanted edge 206.

Furthermore, as described above, to facilitate retaining a securement tab 190 after the securement tab has been transitioned from its withdrawn state to its extended state, in some embodiments, a retention fastener 194 may extend into a corresponding tab cavity 202 such that its tip 212 remains within a retention notch 214 along an edge of the securement tab 190 while the securement tab 190 is in its extended state and, thus, engages a retention lip 216 at an upper end of the securement tab 190. Accordingly, in such embodiments, forming a hanger securement mechanism 186 at a lower end of a tool body 176 may include forming a securement tab 190 with a retention notch 214 along an edge and extending a retention fastener 194 into a corresponding tab cavity 202 such that the tip 212 of the retention fastener 194 extends into the retention notch 214.

In any case, in addition to a tool body 176, as described above, to facilitate maintaining centralization of the tool body 176 and, thus, a corresponding casing hanger 26, a rotatable running tool 64 generally includes a tool sleeve 178. Accordingly, implementing a rotatable running tool 64 generally includes forming (e.g., milling, molding, casting, and/or forging) a tool sleeve 178 (process block 234). In particular, in some embodiments, the tool sleeve 178 of a rotatable running tool 64 may be formed from metal, such as carbon steel or stainless steel.

To facilitate rotating the tool body 176 of a rotatable running tool 64 relative to a corresponding tool sleeve 178 as well as securing the tool sleeve 178 to the tool body 176, as described above, the tool body 176 is generally secured within the tool sleeve 178 such that a tool bearing assembly 180 is disposed therebetween. Accordingly, implementing a rotatable running tool 64 generally includes securing a tool body 176 within a tool sleeve 178 such that a tool bearing assembly 180 is disposed therebetween (process block 235).

In other words, the tool sleeve 178 of a rotatable running tool 64 may be secured circumferentially around the tool body 176 of the rotatable running tool 64 such that the tool body 176 extends through the tool sleeve 178. Accordingly, as described above, to facilitate insertion of a rotatable running tool 64, in some embodiments, the tool sleeve 178 of the rotatable running tool 64 may have a tapered lower end. Additionally, as described above, to facilitate withdrawal of a rotatable running tool 64, in some embodiments, the tool sleeve 178 of the rotatable running tool 64 may have a tapered upper end. Thus, in such embodiments, forming the tool sleeve 178 of a rotatable running tool 64 may include forming the tool sleeve 178 with a tapered lower end and/or a tapered upper end (process block 241).

Additionally, as described above, to enable the flow of fluid, such as liquid cement 38D, drilling mud, and/or water, therearound, in some embodiments, a rotatable running tool 64 may include one or more fluid circulation pathways 218 that extend through its tool sleeve 178. Accordingly, in such embodiments, forming the tool sleeve 178 of a rotatable running tool 64 may include forming the tool sleeve 178 to include one or more fluid circulation pathways 218 that extend therethrough (process block 243). In particular, as described above, in some such embodiments, fluid circulation pathways 218 around a rotatable running tool 64 may be defined by tool flutes 217 formed along an outer surface of its tool sleeve 178.

Furthermore, as described above, to facilitate securing the tool sleeve 178 of a rotatable running tool 64 to a corresponding tool body 176, the tool bearing assembly 180 of the rotatable running tool 64 may include ball bearings 220 disposed within an internal bearing groove 224 on the tool sleeve 178 and a corresponding (e.g., radially-aligned) external bearing groove 222 on the tool body 176. Accordingly, in such embodiments, forming the tool body 176 of a rotatable running tool 64 may include forming the tool body 176 with an external bearing groove 222 on its outer surface (process block 244) and forming the tool sleeve 178 of the rotatable running tool may include forming the tool sleeve 178 with an internal bearing groove 224 on its inner surface (process block 246). Additionally, in such embodiments, securing the tool body 176 of a rotatable running tool 64 to a corresponding tool sleeve 178 may include inserting the tool body 176 through the tool sleeve 178 such that an external bearing groove 222 on the tool body 176 is radially aligned with an internal bearing groove 224 on the tool sleeve 178 (process block 247).

As described above, to facilitate radially aligning an external bearing groove 222 on its tool body 176 with an internal bearing groove 224 on its tool sleeve 178, in some embodiments, a rotatable running tool 64 may include an upwardly-facing external alignment shoulder 227 on its tool body 176 and a downwardly-facing internal alignment shoulder 228 on its tool sleeve 178, which axially oppose one another. Accordingly, in such embodiments, forming the tool body 176 of a rotatable running tool 64 may include forming the tool body 176 with an upwardly-facing external alignment shoulder 227 on its outer surface (process block 248) and forming the tool sleeve 178 of the rotatable running tool 64 may include forming the tool sleeve 178 with a downwardly-facing internal alignment shoulder 228 on its inner surface (process block 250).

Additionally, as described above, to facilitate disposing ball bearings 220 within an external bearing groove 222 on its tool body 176 and a corresponding (e.g., radially-aligned) internal bearing groove 224 on its tool sleeve 178 and, thus, securing the tool body 176 within the tool sleeve 178, in some embodiments, a rotatable running tool 64 may include a tool bearing port 226 that extends through the tool sleeve 178 to the internal bearing groove 224. Accordingly, in such embodiments, forming the tool sleeve 178 of a rotatable running tool 64 may include forming a tool bearing port 226 through from an outer surface of the tool sleeve 178 through the tool sleeve 178 to an internal bearing groove 224 on an inner surface of the tool sleeve 178 (process block 252). Additionally, in such embodiments, securing the tool body 176 of a rotatable running tool 64 to a corresponding tool sleeve 178 may include inserting a ball bearing 220 into an external bearing groove 222 on the tool body 176 and a corresponding internal bearing groove 224 on the tool sleeve 178 via a corresponding tool bearing port 226 that extends through the tool sleeve 178 to the internal bearing groove 224 (process block 254).

Furthermore, as described above, to facilitate retaining a ball bearing 220 within an external bearing groove 222 on its tool body 176 and a corresponding internal bearing groove 224 on its tool sleeve 178 and, thus, securing the tool sleeve 178 around the tool body 176, in some embodiments, a rotatable running tool 64 may include a bearing plug 229 disposed within a corresponding tool bearing port 226 behind (e.g., after) the ball bearing 220. Accordingly, in such embodiments, securing the tool body 176 of a rotatable running tool 64 to a corresponding tool sleeve 178 may include disposing a bearing plug 229 within a tool bearing port 226 after a ball bearing 220 to plug the tool bearing port 226 behind the ball bearing 220 (process block 256).

In this manner, a rotatable running tool 64, which facilitates manipulation (e.g., lifting, lowering, and/or rotation) of a corresponding casing hanger 26 while maintaining centralization and, thus, reducing radial force exerted on the casing hanger 26 and/or likelihood of damaging (e.g., scoring and/or galling) surrounding components, may be implemented (e.g., manufactured). As described above, the hanger bearing assembly 82 of a rotatable casing hanger 66 may be rated to primarily accommodate axial force but minimal radial force. Accordingly, using a rotatable running tool 64 to manipulate a rotatable casing hanger 66 in a well system 10 may facilitate reducing radial force exerted on the hanger bearing assembly 82 of the rotatable casing hanger 66, which, at least in some instances, may facilitate improving lifespan of the hanger bearing assembly 82 and, thus, the rotatable casing hanger 66.

Figure 14:
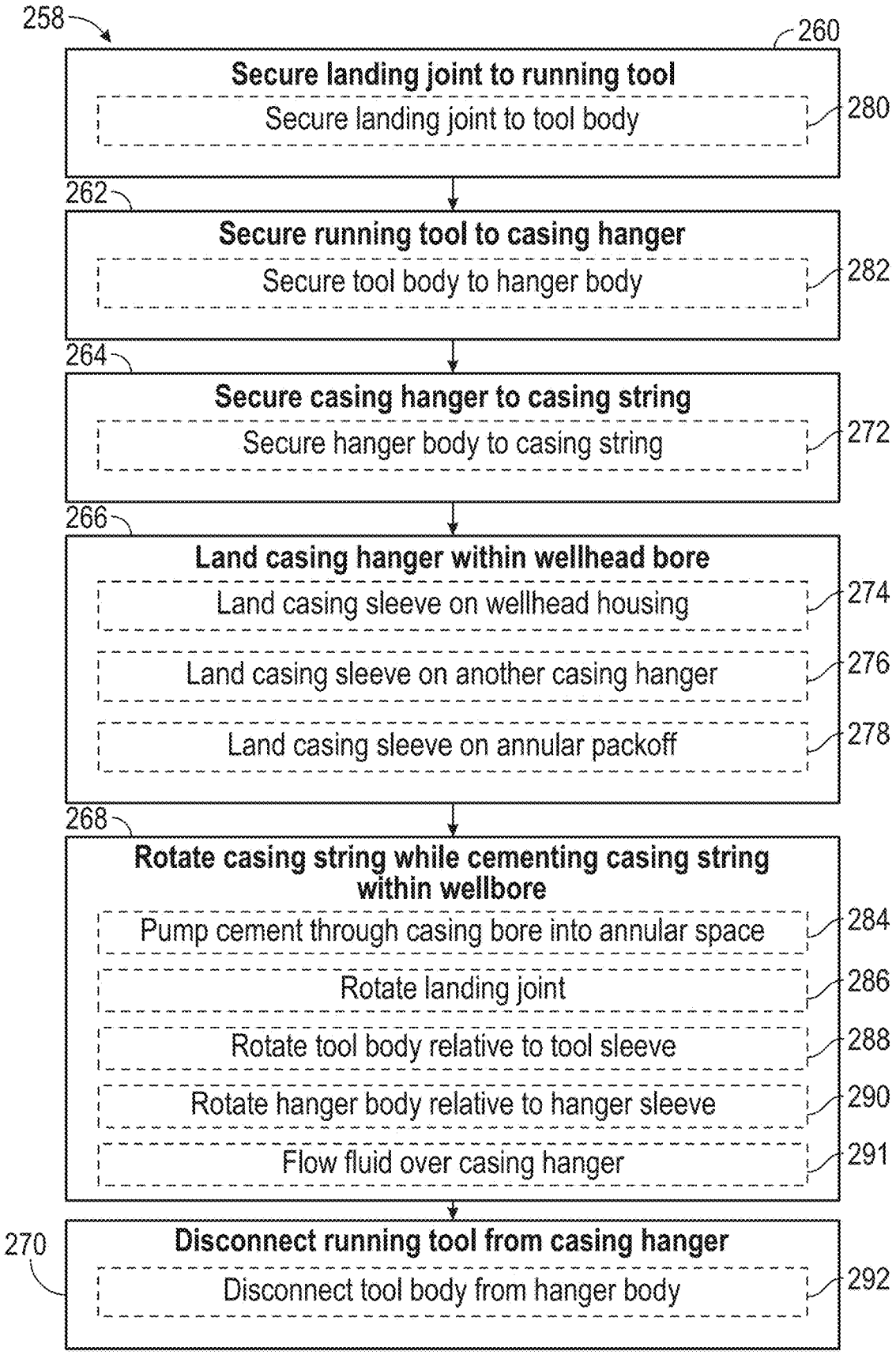
FIG. 14 is a flow diagram of an example of a process for operating a well system that includes a rotatable casing hanger and/or a rotatable running tool, in accordance with an embodiment of the present disclosure.

To help further illustrate, an example of a process 258 for operating a well system 10 is described in FIG. 14. Generally, the process 258 includes securing a landing joint to a running tool (process block 260), securing the running tool to a casing hanger (process block 262), and securing the casing hanger to a casing string (process block 264). Additionally, the process 258 generally includes landing the casing hanger within a wellhead bore (process block 266), rotating the casing string while cementing the casing string within a wellbore (process block 268), and disconnecting the running tool from the casing hanger (process block 270).

However, it should be appreciated that the example process 258 is merely intended to be illustrative and not limiting. In particular, in other embodiments, the process 258 may perform the depicted process blocks in a different order. Additionally or alternatively, in other embodiments, the process 258 may include one or more additional process blocks and/or omit one or more of the depicted process blocks.

In any case, as described above, to facilitate suspending a casing string 20 within a wellbore 14 of a well system 10, a casing hanger 26 may be secured to an upper end of the casing string 20. Accordingly, operating a well system 10 may generally include securing a casing hanger 26, such as a rotatable casing hanger 66, to an upper end of a (e.g., intermediate or innermost) casing string 20 (process block 264).

In particular, as described above, a rotatable casing hanger 66 may be secured to a casing string 20 via a casing securement mechanism 90 at a lower end of its hanger body 80. Accordingly, securing a rotatable casing hanger 66 to a casing string 20 may include securing the hanger body 80 of the rotatable casing hanger 66 to the casing string 20 via a casing securement mechanism 90 on the hanger body 80 (process block 272). More specifically, as described above, in some embodiments, the casing securement mechanism 90 of a rotatable casing hanger 66 may include external threading 92 on the hanger body 80 of the rotatable casing hanger 66 and, thus, securing the hanger body 80 to a casing string 20 may include rotating the hanger body 80 relative to the casing string 20.

Additionally, as described above, to facilitate suspending a casing string 20 within a wellbore 14 of a well system 10, a casing hanger 26 secured to the casing string 20 may be landed on another component of a wellhead 12 within a wellhead bore 25 of the wellhead 12. Accordingly, operating a well system 10 may generally include landing a casing hanger 26, such as a rotatable casing hanger 66, on another wellhead component within a wellhead bore 25 of a wellhead 12 (process block 266).

As described above, a rotatable casing hanger 66 may generally land via engagement between an external landing shoulder 84 on its hanger sleeve 78 and an internal landing shoulder 86 on another wellhead component. In particular, as described above, in some embodiments, the hanger sleeve 78 of a rotatable casing hanger 66 may be implemented (e.g., sized and/or shaped) to land on wellhead housing (e.g., a casing head or a casing spool) 24 of a wellhead 12. Accordingly, in such embodiments, landing a rotatable casing hanger 66 within a wellhead bore 25 of a wellhead 12 may include landing an external landing shoulder 84 of its hanger sleeve 78 on an internal landing shoulder 86 of wellhead housing (e.g., a casing head or a casing spool) 24 of the wellhead 12 (process block 274)

Furthermore, as described above, in some embodiments, the hanger sleeve 78 of a rotatable casing hanger 66 may be implemented (e.g., sized and/or shaped) to land on another casing hanger 26. Accordingly, in such embodiments, landing a rotatable casing hanger 66 within a wellhead bore 25 of a wellhead 12 may include landing an external landing shoulder 84 of its hanger sleeve 78 on an internal landing shoulder 86 of another casing hanger 26, such as another rotatable casing hanger 66, in the wellhead 12 (process block 276).

However, as described above, to facilitate reducing size and/or weight of a rotatable casing hanger 66 and, thus, improving handling of and/or reducing implementation cost associated with the rotatable casing hanger 66, in other embodiments, the hanger sleeve 78 of the rotatable casing hanger 66 may be implemented (e.g., sized and/or shaped) to land on an annular packoff 32, which lands on another casing hanger 26, for example due to an inner diameter 33 of the annular packoff 32 being smaller than an inner diameter 35 of the other casing hanger 26 and/or an inner diameter 37 of wellhead housing (e.g., a casing head or a casing spool) 24. Accordingly, in such embodiments, landing a rotatable casing hanger 66 with a wellhead bore 25 of a wellhead 12 may include landing an external landing shoulder 84 of its hanger sleeve 78 on an internal landing shoulder 86 of an annular packoff 32, which is landed on another casing hanger 26, such as another rotatable casing hanger 66 (process block 278).

In any case, to facilitate manipulation (e.g., lifting, lowering, and/or rotation) of a casing hanger 26 and, thus, a corresponding casing string 20, a landing joint 56 may be selectively secured to the casing hanger 26 via a running tool 54. Accordingly, operating a well system 10 generally includes securing a landing joint 56 to a running tool 54, such as a rotatable running tool 64, (process block 260) and securing the running tool 54 to a casing hanger 26, such as a rotatable casing hanger 66, (process block 262).

In particular, as described above, a rotatable running tool 64 may be secured to a landing joint 56 via a landing joint securement mechanism 182 at an upper end of its tool body 176. Accordingly, securing a landing joint 56 to a rotatable running tool 64 may include securing the landing joint 56 to the tool body 176 of the rotatable running tool 64 via a landing joint securement mechanism 182 on the tool body 176 (process block 280). More specifically, as described above, in some embodiments, the landing joint securement mechanism 182 of a rotatable running tool 64 may include internal threading 184 on the tool body 176 of the rotatable running tool 64 and, thus, securing a landing joint 56 to the tool body 176 of the rotatable running tool 64 may include rotating the tool body 176 relative to the landing joint 56.

Additionally, as described above, a rotatable running tool 64 may be secured to a casing hanger 26 via a hanger securement mechanism 186 at a lower end of its tool body 176 while a rotatable casing hanger 66 may be secured to a running tool 54 via a tool securement mechanism 94 at an upper end of its hanger body 80. Accordingly, securing a rotatable running tool 64 to a rotatable casing hanger 66 may include engaging a hanger securement mechanism 186 on the tool body 176 of the rotatable running tool 64 with a tool securement mechanism 94 on the hanger body 80 of the rotatable casing hanger 66 (process block 282). More specifically, as described above, in some embodiments, the hanger securement mechanism 186 of a rotatable running tool 64 may include external threading 188 on the tool body 176 of the rotatable running tool 64 while the tool securement mechanism 94 of a rotatable casing hanger 66 may include internal threading 96 on the hanger body 80 of the rotatable casing hanger 66. Accordingly, in such embodiments, securing the tool body 176 of a rotatable running tool 64 to the hanger body 80 of a rotatable casing hanger 66 may include rotating the tool body 176 in a first (e.g., right) direction relative to the hanger body 80.

However, as described above, to facilitate blocking overtightening of a rotatable running tool 64 on a casing hanger 26—particularly when the rotatable running tool 64 is used to rotate the casing hanger 26 and, thus, a corresponding casing string 20, in some embodiments, the hanger securement mechanism 186 of the rotatable running tool 64 may additionally include a securement tab 190, which selectively extends axially out of the tool body 176 of the rotatable running tool 64 to enable a lower end of the securement tab 190 to matingly interlock with a securement notch 98 at an upper axial end of a casing hanger 26. In particular, as described above, in such embodiments, the securement tab 190 and the securement notch 98 may be implemented (e.g., sized and/or shaped) such that, when matingly interlocked, the securement tab 190 on the tool body 176 blocks the tool body 176 from rotating further in a first (e.g., right) direction relative to the casing hanger 26 and, thus, from being further tightened on the casing hanger 26 while enabling the tool body 176 to be rotated in a second (e.g., left and/or opposite) direction relative to the casing hanger 26 and, thus, disconnected from the casing hanger 26. Accordingly, in such embodiments, securing the tool body 176 of a rotatable running tool 64 to a casing hanger 26, such as a rotatable casing hanger 66, may include initially rotating the tool body 176 in a first (e.g., right) direction relative to the casing hanger 26 to tighten the tool body 176 on the casing hanger 26, enabling a securement tab 190 on the tool body 176 to transition from its withdrawn state to its extended state, and subsequently rotating the tool body 176 in a second (e.g., left and/or opposite) direction relative to the casing hanger 26 to matingly interlock the securement tab 190 on the tool body 176 with the securement notch 98 on the casing hanger 26, thereby blocking the tool body 176 from being further tightened on the casing hanger 26 while enabling the rotatable running tool 64 to be disconnected form the casing hanger 26.

As described above, to facilitate controlling movement of a securement tab 190 between its withdrawn state and its extended state, in such embodiments, the hanger securement mechanism 186 of a rotatable running tool 64 may additionally include an activation spring 192, which urges the securement tab 190 toward its extended state, and an activation fastener 195, which selectively engages the securement tab 190 to hold the securement tab in its withdrawn state. Accordingly, in such embodiments, enabling a securement tab 190 on the tool body 176 of a rotatable running tool 64 to transition from its withdrawn state to its extended state may include loosening a corresponding activation fastener 195 from the securement tab 190 to enable a corresponding activation spring 192 to actuate (e.g., extend) the securement tab 190 such that a lower end of the securement tab 190 is extended out of the tool body 176.

In any case, as described above, to facilitate improving integrity (e.g., uniformity) of cement 38 formed in an annular space 34 surrounding a casing string 20 that is suspended within a wellbore 14 of a well system 10 and, thus, effectiveness of (e.g., structural support and/or fluid isolation provided by) the casing string 20, the casing string 20 may be rotated while being cemented within the wellbore 14. According, operating a well system 10 generally includes rotating a casing string 20 suspended within a wellbore 14 while the casing string 20 is being cemented within the wellbore 14, for example, while landed via a corresponding casing hanger 26, such as a rotatable casing hanger 66 (process block 268).

In particular, as described above, liquid cement 38D may be flowed into an annular space 34 surrounding a casing string 20 that is suspended within a wellbore 14 by flowing the liquid cement 38D down the casing bore 31 of the casing string 20 to the bottom of the wellbore 14 and back up the annular space 34. Accordingly, cementing a casing string 20 within a wellbore 14 may include pumping liquid cement 38D through the casing bore 31 of the casing string 20 such that the liquid cement 38D flows into an annular space 34 surrounding the casing string 20, for example, via a fluid pump 52 (process block 284).

As described above, to enable fluid, such as liquid cement 38D and/or drilling mud, to be supplied to the casing bore 31 of a casing string 20, the hanger body 80 of a rotatable casing hanger 66 may define a hanger bore 88 that extends therethrough. Accordingly, in such embodiments, pumping liquid cement 38D into the casing bore 31 of a casing string 20 suspended by a rotatable casing hanger 66 may include pumping liquid cement 38D through a hanger bore 88 defined by the hanger body 80 of the rotatable casing hanger 66.

Additionally, as described above, to enable fluid, such as liquid cement 38D and/or drilling mud, to be supplied to the hanger bore 88 of a casing hanger 26 and, thus, the casing bore 31 of a corresponding casing string 20, the tool body 176 of a rotatable running tool 64 may define a tool bore 181 that extends therethrough. Accordingly, in such embodiments, pumping liquid cement 38D into a hanger bore 88 of a casing hanger 26 connected to a rotatable running tool 64 and, thus, the casing bore 31 of a corresponding casing string 20 may include pumping liquid cement 38D through a tool bore 181 defined by the tool body 176 of the rotatable running tool 64.

Furthermore, as described above, a running tool 54 and, thus, a corresponding casing hanger 26 and a corresponding casing string 20 may be rotated via a landing joint 56. Accordingly, rotating a casing string 20 suspended within a wellbore 14 may include rotating a corresponding landing joint 56 to rotate a corresponding running tool 54, such as a rotatable running tool 64, and, thus, a corresponding casing hanger 26, such as a rotatable casing hanger 66, and a corresponding casing string 20, for example, via a motor 50 (process block 286).

Moreover, as described above, to facilitate maintaining centralization of a corresponding casing hanger 26—particularly during rotation—and, thus, reducing radial force exerted on the casing hanger 26 and/or likelihood of damaging (e.g., scoring and/or galling) surrounding components, the tool sleeve 178 of a rotatable running tool 64 may be rotatably secured circumferentially around a corresponding tool body 176. Accordingly, rotating a rotatable running tool 64 may include rotating its tool body 176 relative to its tool sleeve 178 (process block 288).

Additionally, as described above, to facilitate rotating a corresponding casing string 20 while landed, the hanger sleeve 78 of a rotatable casing hanger 66 may be landed on another wellhead component and rotatably secured circumferentially around a corresponding hanger body 80. Accordingly, rotating a rotatable casing hanger 66 may include rotating its hanger body 80 relative to its hanger sleeve 78 (process block 290). In fact, to facilitate dissipating heat produced due to a rotatable casing hanger 66 rotating while landed, which could otherwise degrade a hanger seal 128 and/or a centralizer 127 in the rotatable casing hanger 66 over time, in some embodiments, fluid, such as water, may be flowed over (e.g., around) the rotatable casing hanger 66 during rotation (process block 291).

In any case, as described above, after a casing string 20 is cemented within a wellbore 14 of a well system 10, a corresponding running tool 54 may be disconnected from the casing hanger 26 and withdrawn from the wellbore 14. Accordingly, operating a well system 10 generally includes disconnecting a running tool 54, such as a rotatable running tool 64, from a corresponding casing hanger 26, such as a rotatable casing hanger 66, within a wellbore 14 and withdrawing the running tool 54 from the wellbore 14 (process block 270).

As described above, a rotatable running tool 64 may be secured to a casing hanger 26 via a hanger securement mechanism 186 at a lower end of its tool body 176 while a rotatable casing hanger 66 may be secured to a running tool 54 via a tool securement mechanism 94 at an upper end of its hanger body 80. Accordingly, disconnecting a rotatable running tool 64 from a rotatable casing hanger 66 may include disengaging a hanger securement mechanism 186 on the tool body 176 of the rotatable running tool 64 from a tool securement mechanism 94 on the hanger body 80 of the rotatable casing hanger 66 (process block 292). In particular, as described above, in some embodiments, the hanger securement mechanism 186 of a rotatable running tool 64 may include external threading 188 on the tool body 176 of the rotatable running tool 64 while the tool securement mechanism 94 of a rotatable casing hanger 66 may include internal threading 96 on the hanger body 80 of the rotatable casing hanger 66 and, thus, the tool body 176 may be tightened on the hanger body 80 at least in part by rotating the tool body 176 in a first (e.g., right) direction relative to the hanger body 80. Accordingly, in such embodiments, disconnecting the tool body 176 of a rotatable running tool 64 from the hanger body 80 of a rotatable casing hanger 66 may include rotating the tool body 176 in a second (e.g., left and/or opposite) direction relative to the hanger body 80.

In this manner, a rotatable casing hanger 66 and/or a rotatable running tool 64 may be used in a well system 10 to facilitate improving the effectiveness of (e.g., structural support and/or fluid isolation provided by) a casing string 20 deployed therein. In particular, as described above, a rotatable casing hanger 66 may facilitate rotating and, thus, cementing a corresponding casing string 20 while landed, which, at least in some instances, may facilitate reducing the likelihood that rotation of the rotatable casing hanger 66 damages (e.g., scores) surrounding wellhead components as well as improving the integrity (e.g., uniformity) of cement 38 formed in an annular space 34 surrounding the casing string 20. Additionally, as described above, a rotatable running tool 64 may facilitate maintaining centralization of a corresponding casing hanger 26 and, thus, reducing radial force exerted on the casing hanger 26—particularly during rotation, which, at least in some instances, may facilitate reducing the likelihood that rotation of the casing hanger 26 and a corresponding casing string 20 damages (e.g., scores) surrounding components and/or improving lifespan of the hanger bearing assembly 82 of a rotatable casing hanger 66 and, thus, the rotatable casing hanger 66, for example, due to the hanger bearing assembly 82 being implemented to primarily accommodate axial force but minimal radial force.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A well system comprising:

a casing hanger, wherein the casing hanger comprises:

a hanger body that defines a hanger bore, wherein the hanger body is configured to be secured to a casing string to facilitate suspending the casing string within a wellbore;

a hanger sleeve secured circumferentially around the hanger body, wherein the hanger sleeve is configured to land within a wellhead housing; and a hanger bearing assembly disposed axially between the hanger body and the hanger sleeve to facilitate rotating the hanger body relative to the hanger sleeve as well as transferring axial force between the hanger body and the hanger sleeve; and a rotatable running tool, wherein the rotatable running tool comprises:

a tool body that defines a tool bore, wherein the tool body is configured to be selectively secured to the hanger body of the casing hanger to facilitate manipulating the casing hanger;

a tool sleeve secured circumferentially around the tool body to facilitate maintaining centralization of the tool body and, thus, the casing hanger; and a tool bearing assembly disposed between the tool body and the tool sleeve to facilitate rotating the tool body and, thus, the hanger body of the casing hanger and the casing string relative to the tool sleeve.

2. The well system of claim 1, comprising:

another casing hanger configured to be secured to another casing string to facilitate suspending the another casing string within the wellbore;

a first annular packoff configured to land on the another casing hanger to facilitate sealing a first casing bore of the another casing string from a first annular space surrounding the another casing string, wherein the hanger sleeve of the casing hanger is configured to land on the first annular packoff; and a second annular packoff configured to land on the casing hanger after the rotatable running tool is disconnected from the casing hanger to facilitate sealing a second casing bore of the casing string from a second annular space surrounding the casing string.

3. The well system of claim 1, wherein:

the tool body of the rotatable running tool comprises an external bearing groove formed on an outer surface;

the tool sleeve of the rotatable running tool comprises an internal bearing groove formed on an inner surface such that the internal bearing groove on the tool sleeve is radially aligned with the external bearing groove on the tool body; and a plurality of ball bearings disposed within the external bearing groove on the tool body and the internal bearing groove on the tool sleeve to facilitate rotating the tool body relative to the tool sleeve as well as securing the tool sleeve circumferentially around the tool body.

4. The well system of claim 1, wherein:

the hanger body of the casing hanger comprises a downwardly-facing external load shoulder;

the hanger sleeve of the casing hanger comprises:

a primary upwardly-facing internal load shoulder that axially opposes the downwardly-facing external load shoulder on the hanger body; and a backup upwardly-facing internal load shoulder that axially opposes the downwardly-facing external load shoulder on the hanger body and is axially upwardly as well as radially outwardly offset relative to the primary upwardly-facing internal load shoulder; and the hanger bearing assembly of the casing hanger is disposed axially between the downwardly-facing external load shoulder on the hanger body and the primary upwardly-facing internal load shoulder on the hanger sleeve.

5. The well system of claim 1, wherein the hanger bearing assembly of the casing hanger comprises:

a plurality of circumferentially-spaced and radially-oriented roller bearings, wherein each of the plurality of circumferentially-spaced and radially-oriented roller bearings is cylindrically shaped;

a ring-shaped roller plate having a plurality of circumferentially-spaced and radially-oriented roller openings that open therethrough, wherein each of the plurality of circumferentially-spaced and radially-oriented roller bearings is rotatably secured within a corresponding roller opening in the plurality of circumferentially-spaced and radially-oriented roller openings in the ring-shaped roller plate to facilitate holding the plurality of circumferentially-spaced and radially-oriented roller bearings in place within the casing hanger;

a ring-shaped upper contact plate disposed between an external load shoulder on the hanger body and the plurality of circumferentially-spaced and radially-oriented roller bearings to facilitate distributing axial load circumferentially between the plurality of circumferentially-spaced and radially-oriented roller bearings; and a ring-shaped lower contact plate disposed between an internal load shoulder on the hanger sleeve and the plurality of circumferentially-spaced and radially-oriented roller bearings to facilitate distributing axial load circumferentially between the plurality of circumferentially-spaced and radially-oriented roller bearings.

6. The well system of claim 1, wherein:

the hanger body of the casing hanger comprises a downwardly-facing external load shoulder;

the hanger sleeve of the casing hanger comprises an upwardly-facing internal load shoulder, wherein the downwardly-facing external load shoulder on the hanger body and the upwardly-facing internal load shoulder on the hanger sleeve are complimentarily tapered to define a conical region of a bearing fluid cavity therebetween; and the hanger bearing assembly of the casing hanger comprises bearing fluid disposed within the bearing fluid cavity.

7. The well system of claim 1, wherein the casing hanger comprises:

a hanger bearing port that extends through the hanger sleeve of the casing hanger to the hanger bearing assembly of the casing hanger to facilitate supplying fluid to the hanger bearing assembly;

an upper hanger seal radially compressed between the hanger body and the hanger sleeve of the casing hanger above the hanger bearing assembly of the casing hanger to facilitate retaining fluid at the hanger bearing assembly; and a lower hanger seal radially compressed between the hanger body and the hanger sleeve of the casing hanger below the hanger bearing assembly of the casing hanger to facilitate retaining fluid at the hanger bearing assembly.

8. The well system of claim 1, wherein the casing hanger comprises a centralizer disposed radially and circumferentially between the hanger body and the hanger sleeve to facilitate maintaining the hanger body centralized within the hanger sleeve.

9. The well system of claim 8, wherein the centralizer of the casing hanger is a different material as compared to the hanger body and the hanger sleeve of the casing hanger.

10. The well system of claim 8, wherein the centralizer of the casing hanger comprises:

an outer housing configured to engage an inner surface of the hanger sleeve of the casing hanger;

an inner housing configured to engage an outer surface of the hanger body of the casing hanger; and a plurality of ball bearings disposed radially and circumferentially between the outer housing and the inner housing.

11. The well system of claim 1, wherein the tool bearing assembly of the rotatable running tool is configured to be secured radially between the tool body and the tool sleeve to facilitate rotating the tool body and, thus, the casing hanger relative to the tool sleeve as well as securing the tool sleeve circumferentially around the tool body.

12. A well system comprising:

a casing hanger, wherein the casing hanger is configured to land within a wellhead housing and to be secured to a casing string to facilitate suspending the casing string within a wellbore; and a rotatable running tool, wherein the rotatable running tool comprises:

a tool body that defines a tool bore that extends axially therethrough, wherein:

the tool body of the rotatable running tool comprises an external bearing groove on an outer surface;

an upper end of the tool body is configured to be secured to a landing joint; and a lower end of the tool body is configured to be secured to the casing hanger;

a tool sleeve configured to be disposed circumferentially around the tool body such that the tool body extends axially through the tool sleeve to facilitate maintaining centralization of the tool body and, thus, the casing hanger, wherein the tool sleeve comprises an internal bearing groove on an inner surface that is configured to be radially aligned with the external bearing groove on the tool body; and a tool bearing assembly configured to be secured radially between the tool body and the tool sleeve, wherein the tool bearing assembly comprises a plurality of ball bearings configured to be disposed within the internal bearing groove on the tool sleeve and the external bearing groove on the tool body to facilitate rotating the tool body and, thus, the casing hanger relative to the tool sleeve as well as securing the tool sleeve circumferentially around the tool body.

13. The well system of claim 12, wherein the rotatable running tool comprises:

a tool bearing port that extends through the tool sleeve of the rotatable running tool to the internal bearing groove on the tool sleeve, wherein the plurality of ball bearings is configured to be disposed within the internal bearing groove on the tool sleeve and the external bearing groove on the tool body via the tool bearing port; and a bearing plug configured to be disposed in the tool bearing port after the plurality of ball bearings to facilitate plugging the tool bearing port behind the plurality of ball bearings and, thus, retaining the plurality of ball bearings within the internal bearing groove on the tool sleeve and the external bearing groove on the tool body.

14. The well system of claim 12, wherein the rotatable running tool comprises:

an upwardly-facing external alignment shoulder on an outer surface of the tool body; and a downwardly-facing internal alignment shoulder on an inner surface of the tool sleeve, wherein the downwardly-facing internal alignment shoulder on the tool sleeve is configured to axially oppose the upwardly-facing external alignment shoulder on the tool body to facilitate radially aligning the external bearing groove on the tool body with the internal bearing groove on the tool sleeve.

15. The well system of claim 12, wherein the casing hanger comprises:

a hanger body that defines a hanger bore, wherein the hanger body is configured to be secured to the casing string to facilitate suspending the casing string within the wellbore;

a hanger sleeve secured circumferentially around the hanger body, wherein the hanger sleeve is configured to land within the wellhead housing; and a hanger bearing assembly disposed axially between the hanger body and the hanger sleeve to facilitate rotating the hanger body relative to the hanger sleeve as well as transferring axial force between the hanger body and the hanger sleeve.

16. A well system comprising:

a casing hanger, wherein the casing hanger is configured to land within a wellhead housing and to be secured to a casing string to facilitate suspending the casing string within a wellbore; and a rotatable running tool, wherein the rotatable running tool comprises:

a tool body that defines a tool bore that extends axially therethrough, wherein an upper end of the tool body is configured to be secured to a landing joint and a lower end of the tool body is configured to be secured to the casing hanger;

a tool sleeve configured to be disposed circumferentially around the tool body such that the tool body extends axially through the tool sleeve to facilitate maintaining centralization of the tool body and, thus, the casing hanger;

a tool bearing assembly configured to be secured radially between the tool body and the tool sleeve to facilitate rotating the tool body and, thus, the casing hanger relative to the tool sleeve as well as securing the tool sleeve circumferentially around the tool body;

a securement tab configured to be disposed within a tab cavity in the tool body;

an activation spring configured to be disposed within the tab cavity between a closed end of the tab cavity and the securement tab to facilitate selectively transitioning the securement tab from a withdrawn state in which a lower end of the securement tab is withdrawn into the tab cavity and an extended state in which the lower end of the securement tab extends axially out from the tab cavity and, thus, the tool body; and an activation fastener configured to be disposed within an activation fastener opening in the tool body that is connected to the tab cavity to enable the activation fastener to be selectively:

tightened against the securement tab to hold the securement tab in the withdrawn state; and loosened from the securement tab to enable the activation spring to transition the securement tab from the withdrawn state to the extended state such that the securement tab matingly interlocks with a securement notch at an axial upper end of the casing hanger to block the tool body from being further tightened on the casing hanger while enabling the tool body to be disconnected from the casing hanger.

17. The well system of claim 16, wherein:

the tool body of the rotatable running tool comprises an external bearing groove on an outer surface;

the tool sleeve of the rotatable running tool comprises an internal bearing groove on an inner surface, wherein the internal bearing groove on the tool sleeve is configured to be radially aligned with the external bearing groove on the tool body; and the tool bearing assembly comprises a plurality of ball bearings configured to be disposed within the internal bearing groove on the tool sleeve and the external bearing groove on the tool body to facilitate rotating the tool body and, thus, the casing hanger relative to the tool sleeve as well as securing the tool sleeve circumferentially around the tool body.

18. The well system of claim 17, wherein the rotatable running tool comprises:

a tool bearing port that extends through the tool sleeve of the rotatable running tool to the internal bearing groove on the tool sleeve, wherein the plurality of ball bearings is configured to be disposed within the internal bearing groove on the tool sleeve and the external bearing groove on the tool body via the tool bearing port;

a bearing plug configured to be disposed in the tool bearing port after the plurality of ball bearings to facilitate plugging the tool bearing port behind the plurality of ball bearings and, thus, retaining the plurality of ball bearings within the internal bearing groove on the tool sleeve and the external bearing groove on the tool body an upwardly-facing external alignment shoulder on an outer surface of the tool body; and a downwardly-facing internal alignment shoulder on an inner surface of the tool sleeve, wherein the downwardly-facing internal alignment shoulder on the tool sleeve is configured to axially oppose the upwardly-facing external alignment shoulder on the tool body to facilitate radially aligning an external bearing groove on the tool body with an internal bearing groove on the tool sleeve.

19. The well system of claim 16, wherein the securement tab of the rotatable running tool comprises:

a vertical edge that is configured to oppose a vertical sidewall of the securement notch in the casing hanger to block the tool body from being further tightened on the casing hanger; and a slanted edge that is configured to oppose a slanted sidewall of the securement notch in the casing hanger to enable the tool body to be disconnected from the casing hanger.

20. The well system of claim 16, wherein the casing hanger comprises:

a hanger body that defines a hanger bore, wherein the hanger body is configured to be secured to the casing string to facilitate suspending the casing string within the wellbore;

a hanger sleeve secured circumferentially around the hanger body, wherein the hanger sleeve is configured to land in the wellhead; and a hanger bearing assembly disposed axially between the hanger body and the hanger sleeve to facilitate rotating the hanger body relative to the hanger sleeve as well as transferring axial force between the hanger body and the hanger sleeve.

* * * * *